US007791566B2

(12) United States Patent
Kimura

(10) Patent No.: US 7,791,566 B2
(45) **Date of Patent: *Sep. 7, 2010**

(54) SIGNAL LINE DRIVING CIRCUIT AND LIGHT EMITTING DEVICE

(75) Inventor: Hajime Kimura, Atsugi (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 795 days.

This patent is subject to a terminal disclaimer.

(21) Appl. No.: 11/296,387

(22) Filed: Dec. 8, 2005

(65) Prior Publication Data

US 2006/0103610 A1 May 18, 2006

Related U.S. Application Data

(62) Division of application No. 10/283,370, filed on Oct. 30, 2002, now Pat. No. 7,193,619.

(30) Foreign Application Priority Data

Oct. 31, 2001 (JP) ..... 2001-335917
Sep. 30, 2002 (JP) ..... 2002-287921

(51) Int. Cl.
*G09G 3/30* (2006.01)

(52) U.S. Cl. ..... 345/76; 345/82; 345/204

(58) Field of Classification Search ..... 345/76–82, 345/98–100, 204; 315/169.1–169.3
See application file for complete search history.

(56) References Cited

U.S. PATENT DOCUMENTS 4,967,140 A 10/1990 Groeneveld et al.

(Continued)

FOREIGN PATENT DOCUMENTS

EP 0 359 315 3/1990

(Continued)

OTHER PUBLICATIONS

Official Action for U.S. Appl. No. 10/282,234 date mailed Aug. 25, 2005.

(Continued)

*Primary Examiner*—Regina Liang
(74) *Attorney, Agent, or Firm*—Eric J. Robinson; Robinson Intellectual Property Law Office, P.C.

(57) ABSTRACT

Dispersion occurs in the characteristics of the transistors. The invention is a signal line driving circuit having a first and a second current source circuits corresponding to each of a plurality of signal lines, a shift register, and a constant current source for video signal, in which the first current source circuit is disposed in a first latch and the second current source circuit is disposed in a second latch. The first current source circuit includes capacitive means for converting the current supplied from the constant current source for video signal into a voltage, according to a sampling pulse supplied from the shift register, and supplying means for supplying the current corresponding to the converted voltage. The second current source circuit includes capacitive means for converting the current supplied from the first latch into a voltage, according to a latch pulse, and supplying means for supplying the current corresponding to the converted voltage.

20 Claims, 42 Drawing Sheets

U.S. PATENT DOCUMENTS

| | | | | |
|---|---|---|---|---|
| 5,041,823 | A | 8/1991 | Johnson et al. | |
| 5,138,310 | A | 8/1992 | Hirane et al. | |
| 5,266,936 | A | 11/1993 | Saitoh | |
| 5,517,207 | A | 5/1996 | Kawada et al. | |
| 5,594,463 | A | 1/1997 | Sakamoto | |
| 5,680,149 | A | 10/1997 | Koyama et al. | |
| 5,783,952 | A | 7/1998 | Kazazian | |
| 5,793,163 | A | 8/1998 | Okuda | |
| 5,844,368 | A | 12/1998 | Okuda et al. | |
| 5,923,309 | A | 7/1999 | Ishizuka et al. | |
| 5,952,789 | A | 9/1999 | Stewart et al. | |
| 5,953,003 | A | 9/1999 | Kwon et al. | |
| 6,091,203 | A | 7/2000 | Kawashima et al. | |
| 6,201,822 | B1 | 3/2001 | Okayasu | |
| 6,222,357 | B1 | 4/2001 | Sakuragi | |
| 6,229,506 | B1 | 5/2001 | Dawson et al. | |
| 6,268,842 | B1 * | 7/2001 | Yamazaki et al. | 345/98 |
| 6,310,589 | B1 | 10/2001 | Nishigaki et al. | |
| 6,331,844 | B1 | 12/2001 | Okumura et al. | |
| 6,344,843 | B1 | 2/2002 | Koyama et al. | |
| 6,369,516 | B1 | 4/2002 | Iketsu et al. | |
| 6,373,454 | B1 | 4/2002 | Knapp et al. | |
| 6,426,743 | B1 | 7/2002 | Yeo et al. | |
| 6,473,064 | B1 | 10/2002 | Tsuchida et al. | |
| 6,498,438 | B1 | 12/2002 | Edwards | |
| 6,501,466 | B1 | 12/2002 | Yamagishi et al. | |
| 6,535,185 | B2 | 3/2003 | Kim et al. | |
| 6,545,651 | B2 | 4/2003 | Nishigaki et al. | |
| 6,548,960 | B2 | 4/2003 | Inukai | |
| 6,552,702 | B1 | 4/2003 | Abe et al. | |
| 6,556,646 | B1 | 4/2003 | Yeo et al. | |
| 6,650,060 | B2 | 11/2003 | Okuda | |
| 6,714,091 | B2 | 3/2004 | Norskov et al. | |
| 6,731,264 | B2 | 5/2004 | Koyama et al. | |
| 6,756,740 | B2 | 6/2004 | Inukai | |
| 6,765,560 | B1 | 7/2004 | Ozawa | |
| 6,788,231 | B1 | 9/2004 | Hsueh | |
| 6,806,857 | B2 | 10/2004 | Sempel et al. | |
| 6,809,320 | B2 | 10/2004 | Iida et al. | |
| 6,859,193 | B1 | 2/2005 | Yumoto | |
| 6,876,350 | B2 | 4/2005 | Koyama | |
| 6,936,846 | B2 | 8/2005 | Koyama et al. | |
| 6,937,233 | B2 | 8/2005 | Sakuma et al. | |
| 6,963,336 | B2 | 11/2005 | Kimura | |
| 6,985,072 | B2 | 1/2006 | Omidi et al. | |
| 6,999,048 | B2 | 2/2006 | Sun et al. | |
| 7,015,882 | B2 | 3/2006 | Yumoto | |
| 7,023,482 | B2 | 4/2006 | Sakuragi | |
| 7,049,991 | B2 | 5/2006 | Kimura | |
| 7,142,781 | B2 | 11/2006 | Koyama et al. | |
| 7,180,479 | B2 | 2/2007 | Kimura | |
| 7,193,591 | B2 | 3/2007 | Yumoto | |
| 7,193,619 | B2 * | 3/2007 | Kimura | 345/76 |
| 7,256,756 | B2 | 8/2007 | Abe | |
| 7,271,784 | B2 | 9/2007 | Koyama | |
| 7,379,039 | B2 | 5/2008 | Yumoto | |
| 7,388,564 | B2 | 6/2008 | Yumoto | |
| 2001/0048410 | A1 | 12/2001 | Nishigaki et al. | |
| 2002/0057244 | A1 | 5/2002 | Koyama et al. | |
| 2002/0135309 | A1 | 9/2002 | Okuda | |
| 2003/0048669 | A1 | 3/2003 | Abe | |
| 2003/0128199 | A1 | 7/2003 | Kimura | |
| 2003/0128200 | A1 | 7/2003 | Yumoto | |
| 2003/0156102 | A1 | 8/2003 | Kimura | |
| 2003/0169250 | A1 | 9/2003 | Kimura | |
| 2004/0056705 | A1 | 3/2004 | Dabral | |
| 2004/0085270 | A1 | 5/2004 | Kimura | |
| 2004/0174282 | A1 | 9/2004 | Sun et al. | |
| 2004/0207578 | A1 | 10/2004 | Koyama | |
| 2004/0222985 | A1 | 11/2004 | Kimura | |
| 2005/0001794 | A1 | 1/2005 | Nakanishi et al. | |
| 2005/0200300 | A1 | 9/2005 | Yumoto | |
| 2006/0103610 | A1 | 5/2006 | Kimura | |
| 2006/0119552 | A1 | 6/2006 | Yumoto | |
| 2007/0146249 | A1 | 6/2007 | Kimura | |
| 2007/0217275 | A1 | 9/2007 | Abe | |
| 2009/0033649 | A1 | 2/2009 | Kimura | |

FOREIGN PATENT DOCUMENTS

| | | | |
|---|---|---|---|
| EP | 1 039 440 | | 9/2000 |
| EP | 1 063 630 | A2 | 12/2000 |
| EP | 1 102 234 | | 5/2001 |
| EP | 1111574 | A | 6/2001 |
| EP | 1 130 565 | | 9/2001 |
| EP | 1 333 422 | | 8/2003 |
| EP | 1 447 787 | | 8/2004 |
| EP | 1 450 342 | | 8/2004 |
| EP | 1 463 026 | | 9/2004 |
| JP | 62-122488 | | 8/1987 |
| JP | 02-105907 | | 4/1990 |
| JP | 05-042488 | | 10/1993 |
| JP | 06-118913 | | 4/1994 |
| JP | 08-095522 | | 4/1996 |
| JP | 08-101669 | | 4/1996 |
| JP | 08-106075 | | 4/1996 |
| JP | 09-244590 | | 9/1997 |
| JP | 09-329806 | A | 12/1997 |
| JP | 10-312173 | | 11/1998 |
| JP | 11-045071 | | 2/1999 |
| JP | 11-231834 | | 8/1999 |
| JP | 11-282419 | | 10/1999 |
| JP | 2000-039926 | | 2/2000 |
| JP | 2000-039926 | A | 2/2000 |
| JP | 2000-081920 | | 3/2000 |
| JP | 2000-105574 | | 4/2000 |
| JP | 2000-105574 | A | 4/2000 |
| JP | 2000-122607 | | 4/2000 |
| JP | 2000-122608 | | 4/2000 |
| JP | 2000-122608 | A | 4/2000 |
| JP | 2000-305522 | | 11/2000 |
| JP | 2001-005426 | | 1/2001 |
| JP | 2001-034221 | | 2/2001 |
| JP | 2001-042822 | | 2/2001 |
| JP | 2001-056667 | | 2/2001 |
| JP | 2001-147659 | | 5/2001 |
| JP | 2001-290469 | | 10/2001 |
| JP | 2001-005426 | | 1/2002 |
| JP | 2002-152565 | | 5/2002 |
| JP | 2002-514320 | | 5/2002 |
| JP | 2002-517806 | | 6/2002 |
| JP | 2002-215095 | | 7/2002 |
| JP | 2002-278497 | | 9/2002 |
| JP | 2003-150112 | | 5/2003 |
| JP | 2003-195812 | | 7/2003 |
| JP | 2003-195815 | | 7/2003 |
| KR | 2001-085788 | | 9/2001 |
| WO | WO-98/11554 | | 3/1998 |
| WO | WO 98/48403 | | 10/1998 |
| WO | WO 99/65011 | | 12/1999 |
| WO | WO-01/06484 | | 1/2001 |
| WO | WO 01/26088 | | 4/2001 |
| WO | WO 01/91095 | | 11/2001 |
| WO | WO 02/39420 | | 5/2002 |

OTHER PUBLICATIONS

K. Morosawa et al., *A Novel Poly-Si TFT Current DAC Circuit for AM-OLED Displays*, AM-LCD Digest of Technical Papers, Jan. 1, 2003, pp. 301-304.

International Preliminary Examination Report dated Oct. 14, 2004 for Application No. PCT/JP2002/011278.

International Preliminary Examination Report dated Oct. 14, 2004 for Application No. PCT/JP2002/011280.

International Preliminary Examination Report dated Oct. 14, 2004 for Application No. PCT/JP2002/011354.
International Preliminary Examination Report dated Oct. 14, 2004 for Application No. PCT/JP2002/011355.
International Preliminary Examination Report dated Oct. 14, 2004 for PCT/JP2002/011279.
Reiji Hattori et al., "Analog-Circuit Simulation of the Current-Programmed Active-Matrix Pixel Electrode Circuits Based on Poly-Si TFT for Organic Light-Emitting Displays," The Japan Society of Applied Physics, AM-LCD '01, Jul. 11-13, 2001, pp. 223-226.
Reiji Hattori et al., *Circuit Simulation of Poly-Si TFT Based Current-Writing Active-Matrix Organic LED Display*, The Institute of Electronics, Information and Communication Engineers, Technical Report of IEICE, ED2001-8, SDM2001-8 (Apr. 2001), pp. 7-14, Abst.
Reiji Hattori et al., *Analog-Circuit Simulation of the Current-Programmed Active-Matrix Pixel Electrode Circuits Based on Poly-Si TFT for Organic Light-Emitting Displays*, AM-LCD '01, pp. 223-226.
Abe et al., 16-1: *A Poly-Si TFT 6-Bit Current Data Driver for Active Matrix Organic Light Emitting Diode Displays*, Eurodisplay 2002, pp. 279-282.
Hattori, *Data-Line Driver Circuits for Current Programmed Active-Matrix OLED Based on Poly-Si TFTs*, AM-LCD '02, pp. 17-20.
Yumoto et al., *Pixel-Driving Methods for Large-Sized Poly-Si AM-OLED Displays*, Asia Display/IDW '01, pp. 1395-1398.
Tseng et al., "An Active Matrix OLED Display Employing an Improving Gray Scale Structure," IDW '03: Proceedings of the 10th International Display Workshops, 2003, pp. 523-526.
Office Action (Application No. 95121256; TW6041/6637D1) dated May 22, 2008.
Office Action (Application No. 2004-7006576) dated Dec. 19, 2008 with English translation.
Search Report (Application No. 02775442.3 Dated Jun. 22, 2009).
Inukai, K. et al., "4.0-In. TFT-OLED Displays and a Novel Digital Driving Method," SID Digest '00 : SID International Symposium Digest of Technical Papers, 2000, vol. 31, pp. 924-927.
Morosawa, K. et al., A Novel Poly-Si TFT Current DAC Circuit for AM-OLED Displays, AM-LCD '03 Digest of Technical Papers, Jan. 1, 2003, pp. 301-304.
Hattori, R. et al., "Circuit Simulation of Poly-Si TFT Based Current-Writing Active-Matrix Organic LED Display," The Institute of Electronics, Information and Communication Engineers, Technical Report of IEICE, ED2001-8, SDM2001-8 (Apr. 2001), vol. 101, No. 15, pp. 7-14.

* cited by examiner

Fig. 17A signal input time
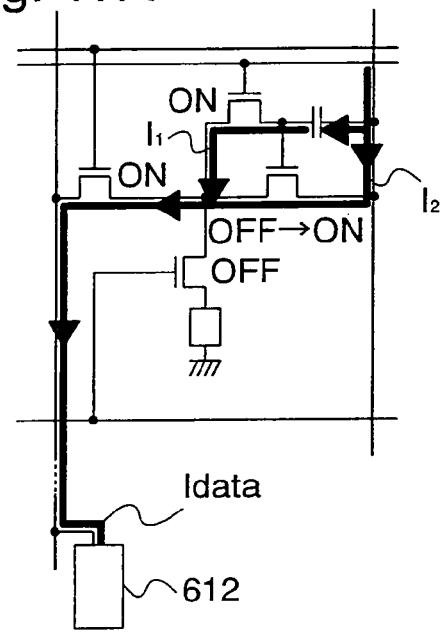
Fig. 17B signal input complete time
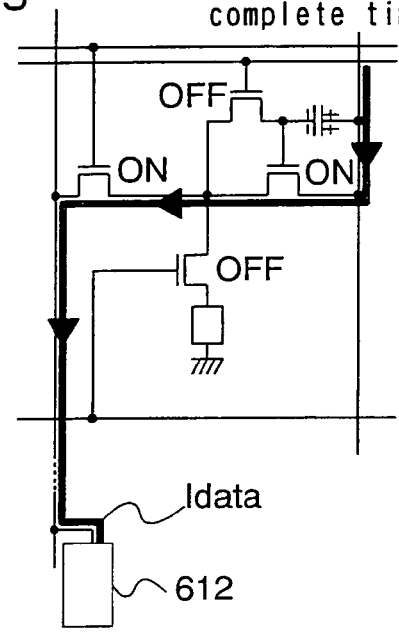
Fig. 17C light emitting time
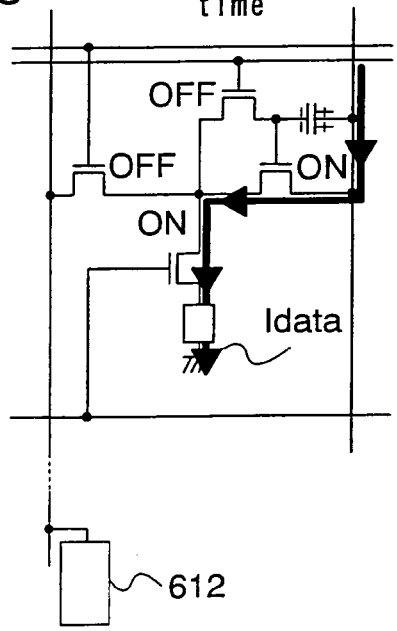
Fig. 17D
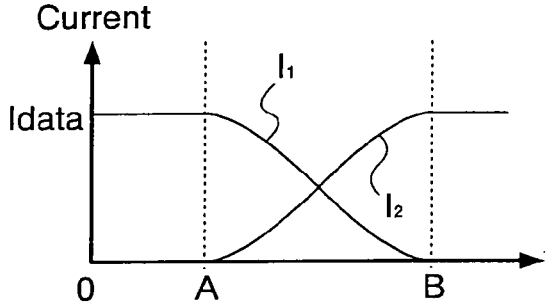
Fig. 17E
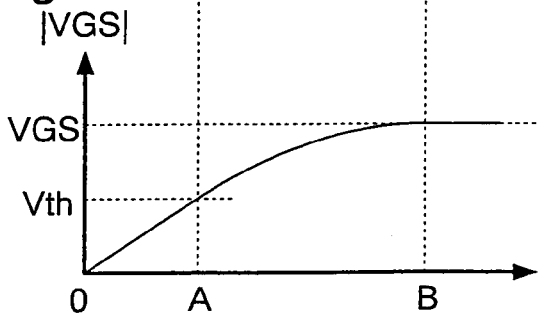

Fig. 20A signal input time
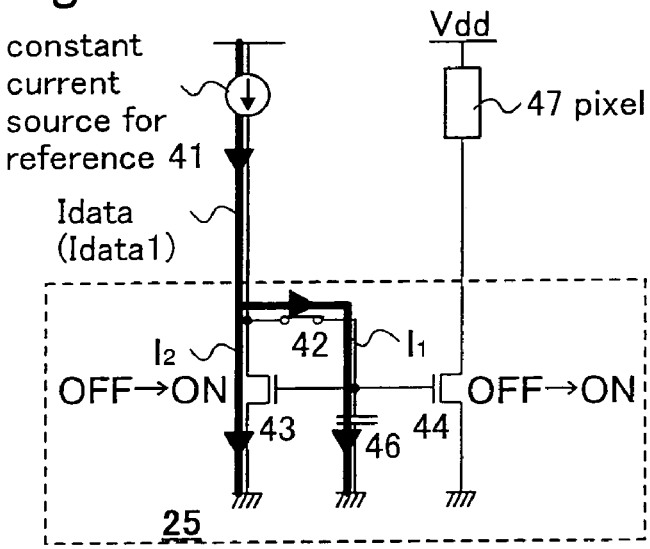
Fig. 20B signal input complete time
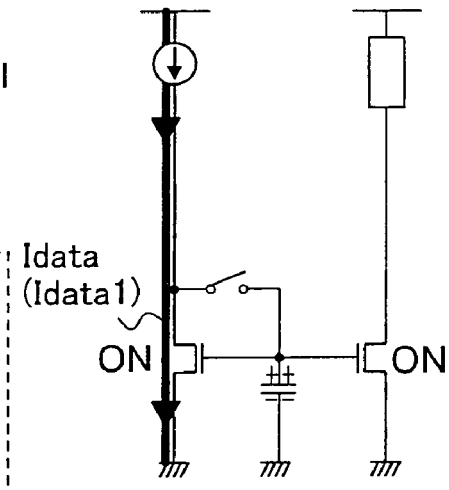
Fig. 20C signal input time to pixel
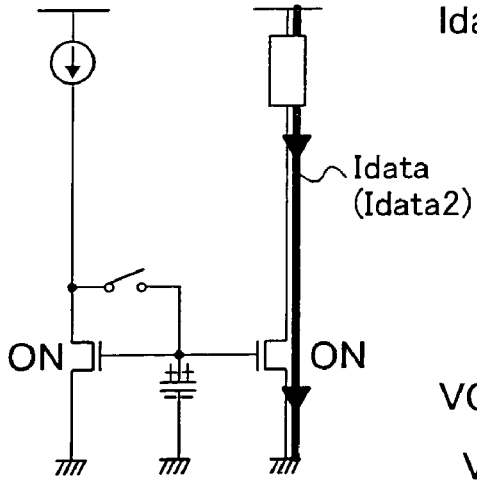
Fig. 20D
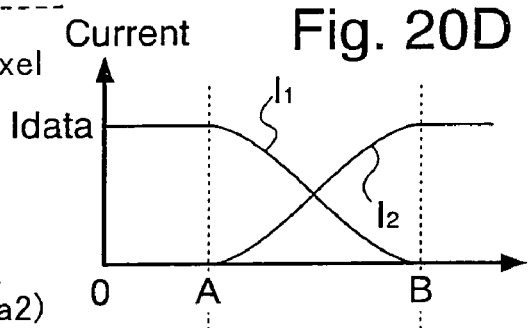
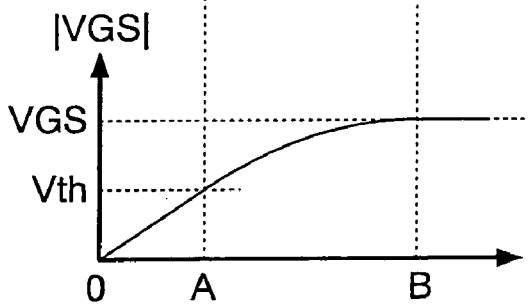
Fig. 20E Fig. 28A1
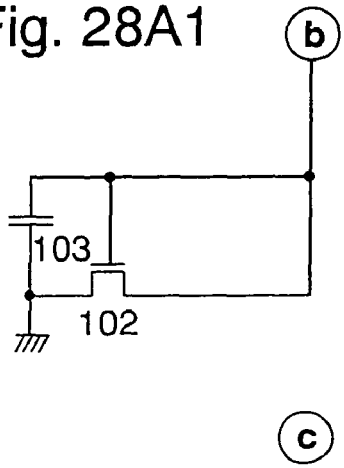
Fig. 28A2
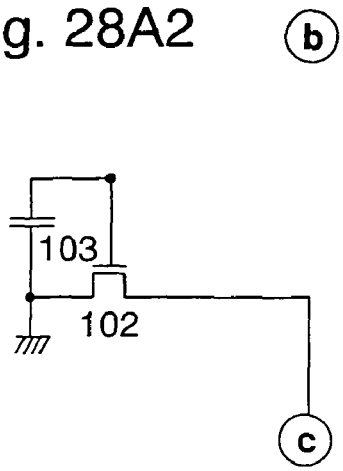
Fig. 28B1
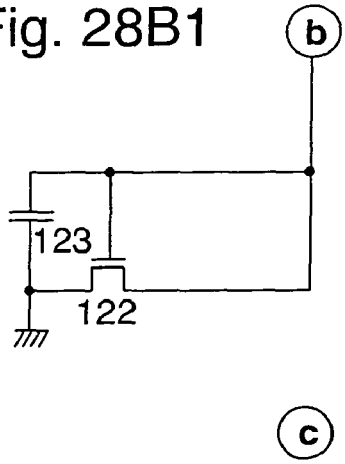
Fig. 28B2
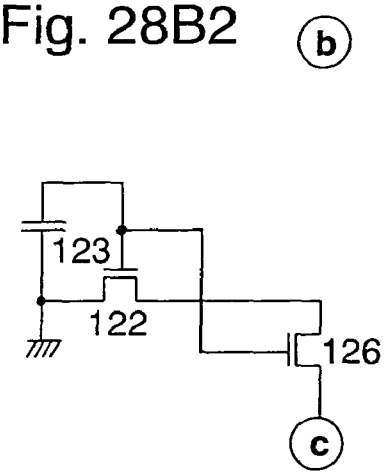
Fig. 28C1
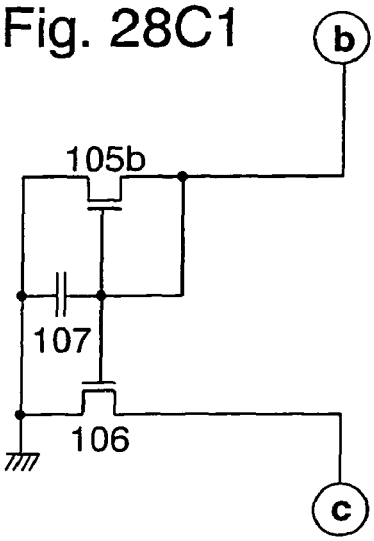
Fig. 28C2
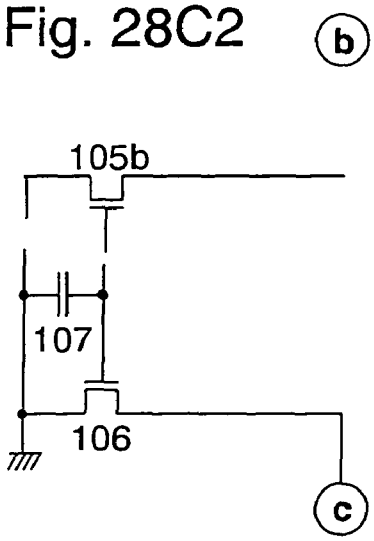

Fig. 29A
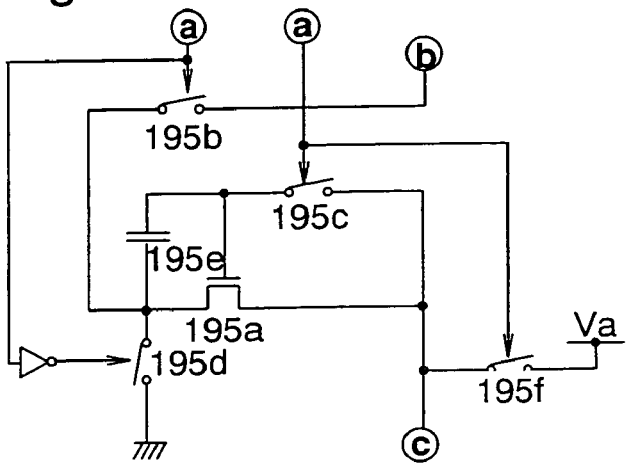
Fig. 29B1
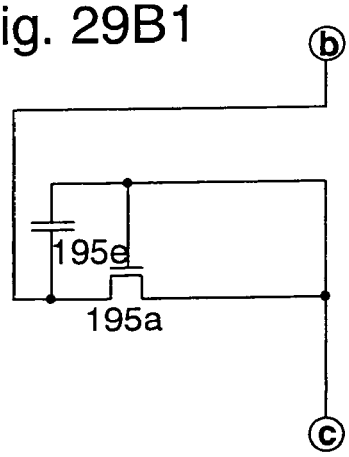
Fig. 29B2
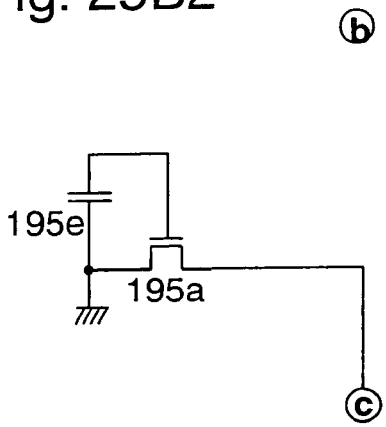
Fig. 29C1
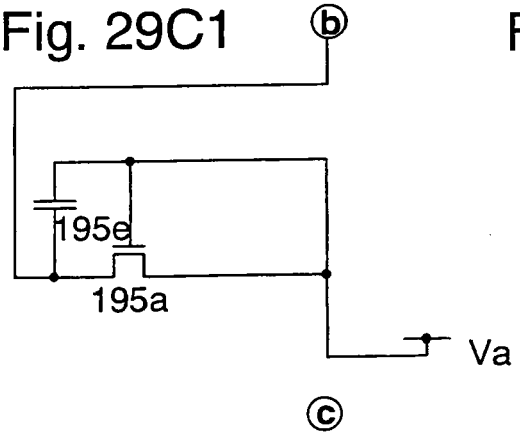
Fig. 29C2
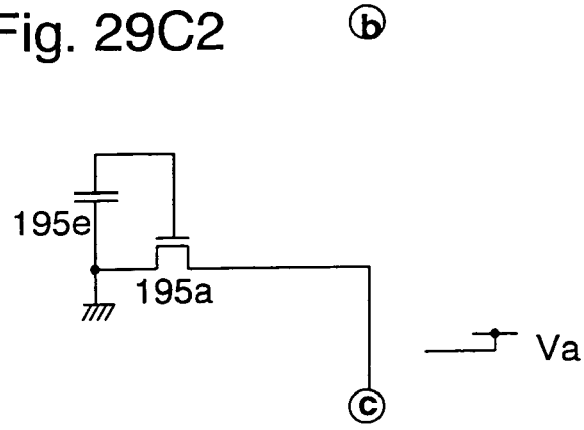

Fig. 31A1
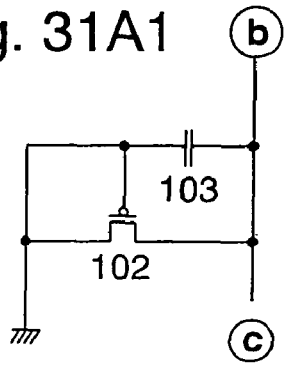
Fig. 31A2
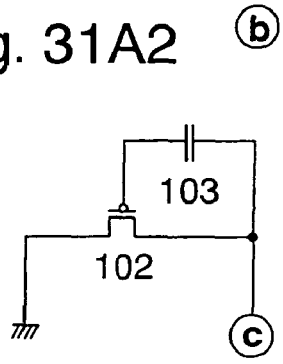
Fig. 31B1
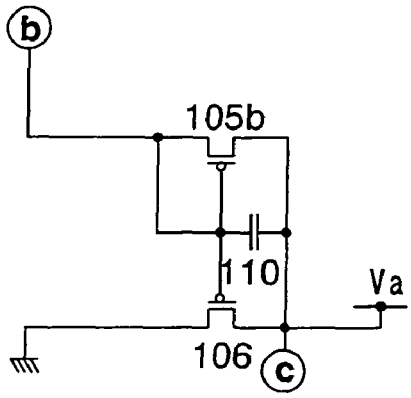
Fig. 31B2
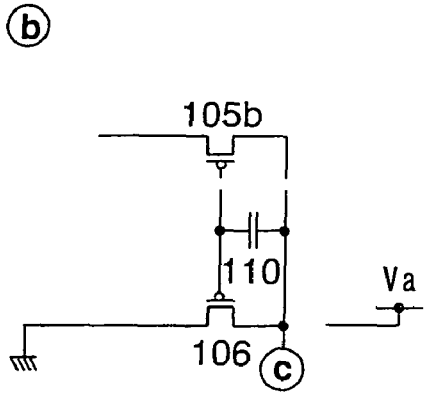
Fig. 31C1
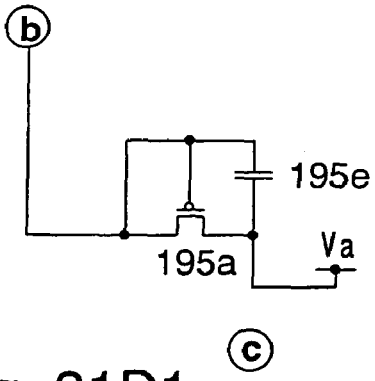
Fig. 31C2
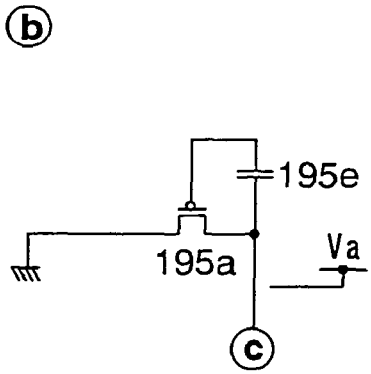
Fig. 31D1
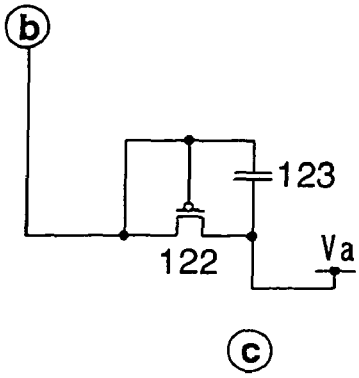
Fig. 31D2
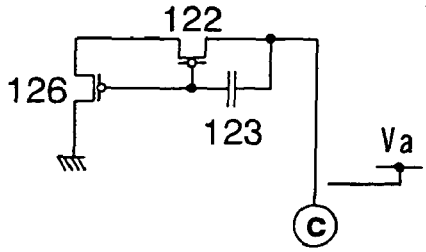

Fig. 32A
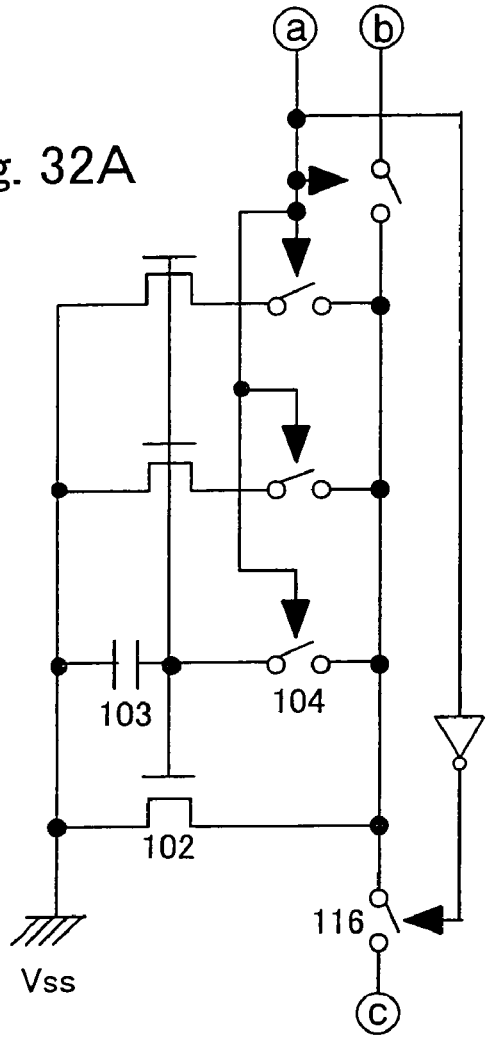
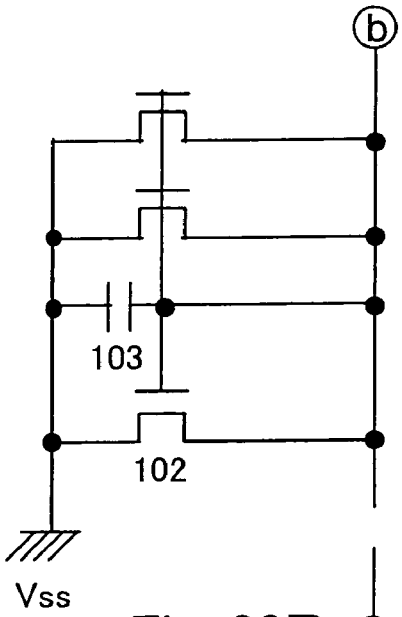
Fig. 32B
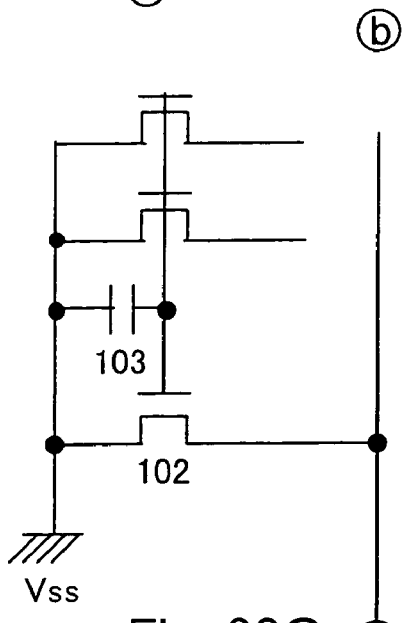
Fig. 32C

SIGNAL LINE DRIVING CIRCUIT AND LIGHT EMITTING DEVICE

TECHNICAL FIELD

The present invention relates to a technique of a signal line driving circuit. Further, the present invention relates to a light emitting device including the signal line driving circuit.

BACKGROUND ART

Recently, display devices for performing image display are being developed. Liquid crystal display devices that perform image display by using a liquid crystal element are widely used as display devices because of advantages of high image quality, thinness, lightweight, and the like.

In addition, light emitting devices using self-light emitting elements as light emitting elements are recently being developed. The light emitting device has characteristics of, for example, a high response speed suitable for motion image display, low voltage, and low power consumption, in addition to advantages of existing liquid crystal display devices, and thus, attracts a great deal of attention as the next generation display device.

As gradation representation methods used in displaying a multi-gradation image on a light emitting device, an analog gradation method and a digital gradation method are given. The former analog gradation method is a method in which the gradation is obtained by analogously controlling the magnitude of a current that flows through a light emitting element. The latter digital gradation method is a method in which the light emitting element is driven only in two states thereof: an ON state (state where the luminance is substantially 100%) and an OFF state (state where the luminance is substantially 0%). In the digital gradation method, since only two gradations can be displayed, a method configured by combining the digital gradation method and a different method to display multi-gradation images has been proposed.

When classification is made based on the type of a signal that is input to pixels, a voltage input method and a current input method are given as pixel-driving methods. The former voltage input method is a method in which: a video signal (voltage) that is input to a pixel is input to a gate electrode of a driving element; and the driving element is used to control the luminance of a light emitting element. The latter current input method is a method in which the set signal current is flown to a light emitting element to control the luminance of the light emitting element.

Hereinafter, referring to FIG. 16A, a brief description will be made of an example of a circuit of a pixel in a light emitting device employing the voltage input method and a driving method thereof. The pixel shown in FIG. 16A includes a signal line 501, a scanning line 502, a switching TFT 503, a driving TFT 504, a capacitor element 505, a light emitting element 506, and power sources 507 and 508.

When the potential of the scanning line 502 varies, and the switching TFT 503 is turned ON, a video signal that has been input to the signal line 501 is input to a gate electrode of the driving TFT 504. According to the potential of the input video signal, a gate-source voltage of the driving TFT 504 is determined, and a current flowing between the source and the drain of the driving TFT 504 is determined. This current is supplied to the light emitting element 506, and the light emitting element 506 emits light. As a semiconductor device for driving the light emitting element, a polysilicon transistor is used. However, the polysilicon transistor is prone to variation in electrical characteristics, such as a threshold value and an ON current, due to defects in a grain boundary. In the pixel shown in FIG. 16A, if characteristics of the driving TFT 504 vary in units of the pixel, even when identical video signals have been input, the magnitudes of the corresponding drain currents of the driving TFTs 504 are different. Thus, the luminance of the light emitting element 506 varies.

To solve the problems described above, a desired current may be input to the light emitting element, regardless of the characteristics of the TFTs for driving the light emitting element. From this viewpoint, the current input method has been proposed which can control the magnitude of a current that is supplied to a light emitting element regardless of the TFT characteristics.

Next, referring to FIGS. 16B and 17, a brief description will be made of a circuit of a pixel in a light emitting device employing the current input method and a driving method thereof. The pixel shown in FIG. 16B includes a signal line 601, first to third scanning lines 602 to 604, a current line 605, TFTs 606 to 609, a capacitor element 610, and a light emitting element 611. A current source circuit 612 is disposed to each signal line (each column).

Operations of from video signal-writing to light emission will be described by using FIG. 17. In FIG. 17, reference numerals denoting respective portions conform to those shown in FIG. 16. FIGS. 17A to 17C schematically show current paths. FIG. 17D shows the relationship between currents flowing through respective paths during a write of a video signal, and FIG. 17E shows a voltage accumulated in the capacitor element 610 also during the write of a video signal, that is, a gate-source voltage of the TFT 608.

First, a pulse is input to the first and second scanning lines 602 and 603 to turn the TFTs 606 and 607 ON. A signal current flowing through the signal line 601 at this time will be referred to as $I_{data}$. As shown in FIG. 17A, since the signal current $I_{data}$ is flowing through the signal line 601, the current separately flows through current paths $I_1$ and $I_2$ in the pixel. FIG. 17D shows the relationship between the currents. Needless to say, the relationship is expressed as $I_{data}=I_1+I_2$.

The moment the TFT 606 is turned ON, no charge is yet accumulated in the capacitor element 610, and thus, the TFT 608 is OFF. Accordingly, $I_2=0$ and $I_{data}=I_1$ are established. In the moment, the current flows between electrodes of the capacitor element 610, and charge accumulation is performed in the capacitor element 610.

Charge is gradually accumulated in the capacitor element 610, and a potential difference begins to develop between both the electrodes (FIG. 17E). When the potential difference of both the electrodes has reached $V_{th}$ (point A in FIG. 17E), the TFT 608 is turned ON, and $I_2$ occurs. As described above, since $I_{data}=I_1+I_2$ is established, while $I_1$ gradually decreases, the current keeps flowing, and charge accumulation is continuously performed in the capacitor element 610.

In the capacitor element 610, charge accumulation continues until the potential difference between both the electrodes, that is, the gate-source voltage of the TFT 608 reaches a desired voltage. That is, charge accumulation continues until the voltage reaches a level at which the TFT 608 can allow the current $I_{data}$ to flow. When charge accumulation terminates (B point in FIG. 17E), the current $I_1$ stops flowing. Further, since the TFT 608 is fully ON, $I_{data}=I_2$ is established (FIG. 17B). According to the operations described above, the operation of writing the signal to the pixel is completed. Finally, selection of the first and second scanning lines 602 and 603 is completed, and the TFTs 606 and 607 are turned OFF.

Subsequently, a pulse is input to the third scanning line 604, and the TFT 609 is turned ON. Since $V_{GS}$ that has been just written is held in the capacitor element 610, the TFT 608 is already turned ON, and a current equal to $I_{data}$ flows thereto from the current line 605. Thus, the light emitting element 611 emits light. At this time, when the TFT 608 is set to operate in a saturation region, even if the source-drain voltage of the TFT 608 varies, a light emitting current $I_{EL}$ flowing to the light emitting element 611 flows without variation.

As described above, the current input method refers to a method in which the drain current of the TFT 609 is set to have the same current value as that of the signal current $I_{data}$ set in the current source circuit 612, and the light emitting element 611 emits light with the luminance corresponding to the drain current. By using the thus structured pixel, influence of variation in characteristics of the TFTs constituting the pixel is suppressed, and a desired current can be supplied to the light emitting element.

Incidentally, in the light emitting device employing the current input method, a signal current corresponding to a video signal needs to be precisely input to a pixel. However, when a signal line driving circuit (corresponding to the current source circuit 612 in FIG. 16) used to input the signal current to the pixel is constituted by polysilicon transistors, variation in characteristics thereof occurs, thereby also causing variation in characteristics of the signal current.

That is, in the light emitting element employing the current input method, influence by variation in characteristics of TFTs constituting the pixel and the signal line driving circuit need to be suppressed. However, while the influence of variation in characteristics of the TFTs constituting the pixel can be suppressed by using the pixel having the structure of FIG. 16B, suppression of the influence of variation in characteristics of the TFTs constituting the signal line driving circuit is difficult. Hereinafter, using FIG. 18, a brief description will be made of the structure and operation of a current source circuit disposed in the signal line driving circuit that drives the pixel employing the current input method.

The current source circuit 612 shown in FIGS. 18A and 18B corresponds to the current source circuit 612 of FIG. 16B. The current source circuit 612 includes constant current sources 555 to 558. The constant current sources 555 to 558 are controlled by signals that are input via respective terminals 551 to 554. The magnitudes of currents supplied from the constant current sources 555 to 558 are different from one another, and the ratio thereof is set to 1:2:4:8.

FIG. 18B shows a circuit structure of the current source circuit 612, in which the constant current sources 555 to 558 shown therein correspond to transistors. The ratio of ON currents of the transistors 555 to 558 is set to 1:2:4:8 according to the ratio (1:2:4:8) of the value of L (gate length)/W (gate width). The current source circuit 612 then can control the current magnitudes at $2^4$=16 levels. Specifically, currents having 16-gradation analog values can be output for 4-bit digital video signals. Note that the current source circuit 612 is constituted by polysilicon transistors, and is integrally formed with the pixel portion on the same substrate.

As described above, conventionally, a signal line driving circuit incorporated with a current source circuit has been proposed (for example, refer to Non-patent Documents 1 and 2).

In addition, digital gradation methods include a method in which a digital gradation method is combined with an area gradation method to represent multi-gradation images (hereinafter, referred to as area gradation method), and a method in which a digital gradation method is combined with a time gradation method to represent multi-gradation images (hereinafter, referred to as time gradation method). The area gradation method is a method in which one pixel is divided into a plurality of sub-pixels, emission or non-emission is selected in each of the sub-pixels, and the gradation is represented according to a difference between a light emitting area and the other area in a single pixel. The time gradation method is a method in which gradation representation is performed by controlling the emission period of a light emitting element. To be more specific, one frame period is divided into a plurality of subframe periods having mutually different lengths, emission or non-emission of a light emitting element is selected in each period, and the gradation is presented according to a difference in length of light emission time in one frame period. In the digital gradation method, the method in which a digital gradation method is combined with a time gradation method (hereinafter, referred to as time gradation method) is proposed. (For example, refer to Patent Document 1).

[Non-Patent Document 1]

Reiji Hattori & three others, "Technical Report of Institute of Electronics, Information and Communication Engineers (IEICE)", ED 2001-8, pp. 7-14, "Circuit Simulation of Current Specification Type Polysilicon TFT Active Matrix-Driven Organic LED Display"

[Non-Patent Document 2]

Reiji H et al.; "AM-LCD'01", OLED-4, pp. 223-226

[Patent Document 1]

JP 2001-5426 A

DISCLOSURE OF THE INVENTION

The above-mentioned current source circuit 612 sets each on-current of the transistors at 1:2:4:8 by designing each L/W value. In the transistors 555 to 558, there occurs dispersion in the threshold value or the mobility, by the combined dispersion factors of the gate length, the gate width, and the thickness of the gate insulation film caused by a difference of the manufacturing process and the substrate being used. Therefore, it is difficult to set each on-current of the transistors 555 to 558 accurately at 1:2:4:8. Namely, each current value supplied to the pixel varies depending on each line.

In order to set each on-current of the transistors 555 to 558 accurately at 1:2:4:8 as being designed, it is necessary to make the same the characteristics of the current source circuits in all lines. Namely, although it is necessary to make the same the characteristics of the current source circuits in all lines, actually this is very difficult.

In consideration of the above problem, the present invention is to provide a signal line driving circuit capable of supplying a desired signal current to the pixel while suppressing the influence of the characteristic dispersion of TFTs. Further, the invention is to provide a light emitting device capable of supplying a desired signal current to a light emitting element while suppressing the influence of the characteristic dispersion of TFTs forming both of the pixel and the driving circuit, by using a pixel of a circuit structure in which the influence of the characteristic dispersion of the TFTs is suppressed.

The invention is to provide a signal line driving circuit of a new structure including an electric circuit (in this specification, referred to as a current source circuit) for flowing a desired constant current in which the influence of the characteristic dispersion of the TFTs is suppressed. Further, the invention is to provide a light emitting device having the above signal line driving circuit.

In the signal line driving circuit of the invention, a signal current is set in the current source circuit disposed in each signal line, by using the constant current source for video signal. The current source circuit with the signal current set has the ability of flowing the current in proportion to the constant current source for video signal. Therefore, the influence of the characteristic dispersion of the TFTs forming the signal line driving circuit can be suppressed by using the current source circuit.

The constant current source for video signal may be formed integrally with the signal line driving circuit on the substrate. As the current for video signal, the current may be inputted from the outside of the substrate by using the IC and the like.

In this case, as the current for video signal, a constant current or a current corresponding to the video signal is supplied from the outside of the substrate to the signal line driving circuit.

The outline of the signal line driving circuit of the invention will be described by using FIG. 1. In FIG. 1, the signal line driving circuit in the vicinity of the three signal lines from the i-th line to the (i+2)-th line is shown.

In FIG. 1, in the signal line driving circuit 403, the current source circuit 420 is disposed in each signal line (each line). The current source circuit 420 has the terminal a, the terminal b, and the terminal c. The setting signal is entered from the terminal a. A current (signal current) is supplied from the constant current source 109 for video signal connected to the current line, to the terminal b. The signal held in the current source circuit 420 is output from the terminal c through the switch 101. Namely, the current source circuit 420 is controlled by the setting signal inputted from the terminal a, the supplied signal current is inputted from the terminal b, and the current in proportion to the signal current is output from the terminal c. The switch 101 is disposed between the current source circuit 420 and the pixel connected to the signal line, or between a plurality of current source circuits 420 disposed in mutually different lines, and the on/off operation of the switch 101 is controlled by a latch pulse.

The operation for finishing writing of the signal current into the current source circuit 420 (the operation for setting the signal current, the operation for setting according to the signal current so as to supply the current in proportion to the signal current, and the operation for setting so that the current source circuit 420 can supply the signal current) is referred to as the setting operation, and the operation for supplying the signal current to the pixel or another current source circuit (the operation of the signal current output by the current source circuit 420) is referred to as the input operation. In FIG. 2, since each control signal entered to the first current source circuit 421 and the second current source circuit 422 is mutually different, of the first current source circuit 421 and the second current source circuit 422, one performs the setting operation, and the other performs the input operation. Thus, in each line, the two operations can be performed at once.

In the invention, the light emitting device includes a panel where the pixel portion having the light emitting elements and the signal line driving circuit are sealed between the substrate and a cover material, a module by mounting IC and the like on the panel, a display, and the like. Namely, the light emitting device corresponds to a generic name of the panel, module, display, and the like.

The invention relates to a signal line driving circuit having a first and a second current source circuits corresponding to each of a plurality of signal lines, a shift register, and a constant current source for video signal, which is characterized in that the first current source circuit is disposed in a first latch and the second current source circuit is disposed in a second latch, the first current source circuit includes capacitive means for converting a current supplied from the constant current source for video signal into a voltage, according to a sampling pulse supplied from the shift register, and supplying means for supplying a current corresponding to the converted voltage, and the second current source circuit includes capacitive means for converting a current supplied from the first latch into a voltage, according to a latch pulse, and supplying means for supplying a current corresponding to the converted voltage.

The invention relates to a signal line driving circuit having a first and a second current source circuits corresponding to each of a plurality of signal lines, a shift register, and n pieces (n is a natural number including 1 and more) of constant current sources for video signal, which is characterized in that the first current source circuit is disposed in a first latch and the second current source circuit is disposed in a second latch, the first current source circuit includes capacitive means for converting a current obtained by adding each current supplied from the n constant current sources for video signal into a voltage, according to a sampling pulse supplied from the shift register, and supplying means for supplying a current corresponding to the converted voltage, the second current source circuit includes capacitive means for converting a current supplied from the first latch into a voltage, according to a latch pulse, and supplying means for supplying a current corresponding to the converted voltage, and the current values supplied from the n constant current sources for video signal are set at $2^0:2^1:\ldots:2^n$.

The invention relates to a signal line driving circuit having 2×n pieces of current source circuits corresponding to each of a plurality of signal lines, a shift register, and n pieces (n is a natural number including 1 and more) of constant current sources for video signal, which is characterized in that, of the 2×n current source circuits, the respective n current source circuits are disposed in respective first and second latches, the n current source circuits disposed in the first latch include capacitive means for converting a current supplied from each of the n constant current sources for video signal into a voltage, according to a sampling pulse supplied from the shift register, and supplying means for supplying a current corresponding to the converted voltage, the n current source circuits disposed in the second latch include capacitive means for converting a current obtained by adding each current supplied from the first latch into a voltage, according to a latch pulse, and supplying means for supplying a current corresponding to the converted voltage, a current obtained by adding each current supplied from each of the n current source circuits disposed in the second latch are supplied to the plurality of signal lines, and the current values supplied from the n constant current sources for video signal are set at $2^0:2^1:\ldots:2^n$.

The invention relates to a signal line driving circuit having (n+m) pieces of current source circuits corresponding to each of a plurality of signal lines, a shift register, and n pieces (n is a natural number including 1 and more, $n \geqq m$) of constant current sources for video signal, which is characterized in that of the (n+m) current source circuits, the n current source circuits are disposed in a first latch and the m current source circuits are disposed in a second latch, the n current source circuits disposed in the first latch include capacitive means for converting a current supplied from each of the n constant current sources for video signal into a voltage, according to a sampling pulse supplied from the shift register, and supplying means for supplying a current corresponding to the converted voltage, the m current source circuits disposed in the second latch include capacitive means for converting a current obtained by adding each current supplied from each of the n current source circuits disposed in the first latch into a voltage, according to a latch pulse, and supplying means for supplying a current corresponding to the converted voltage, and the current values supplied from the n constant current sources for video signal are set at $2^0:2^1:\ldots:2^n$.

In the signal line driving circuit of the invention, the first and the second latches having each current source circuit are disposed. The current source circuit having the supplying means and the capacitive means can supply a current of a predetermined value without having any effect of the characteristic dispersion of the transistors forming the circuit itself. Further, the current source circuit disposed in the first latch is controlled according to the sampling pulse supplied from the shift register and the current source circuit disposed in the second latch is controlled according to the latch pulse supplied from the outside. Namely, since the current source circuits disposed in the first and the second latches are controlled by mutually different signals, it is possible to take a long time for the operation of converting the supplied current to a voltage and performs the above operation accurately.

The signal line driving circuit of the invention can be adopted in both of the analog gradation method and the digital gradation method.

In the invention, the TFT can be used in place of a transistor using a general monocrystal, a transistor using SOI, an organic transistor, and the like.

The invention is to provide a signal line driving circuit having the above current source circuit. Further, the invention is to provide a light emitting device capable of suppressing the influence of the characteristic dispersion of the TFTs forming both of the pixel and the driving circuit and further supplying a desired signal current $I_{data}$ to the light emitting element, by using the pixel having the circuit structure for suppressing the influence of the characteristic dispersion the of the TFTs.

BRIEF DESCRIPTION OF THE DRAWINGS

FIGS. 17A-17E are explanatory views of operations of a pixel of the light emitting device.

FIGS. 20A-20E are explanatory views of operations of a current source circuit.

FIGS. 28A1-28C2 are circuit diagrams of a current source.

FIGS. 29A-29C2 are circuit diagrams of a current source.

FIGS. 31A1-31 D2 are circuit diagrams of a current source.

FIGS. 32A-32C are circuit diagrams of a current source.

BEST FORM FOR CARRYING OUT THE INVENTION

Embodiment Form 1

In this embodiment form, an example of a circuit structure and its operation of a current source circuit 420 which is provided in a signal line driving circuit of the present invention will be described.

Figure 1:
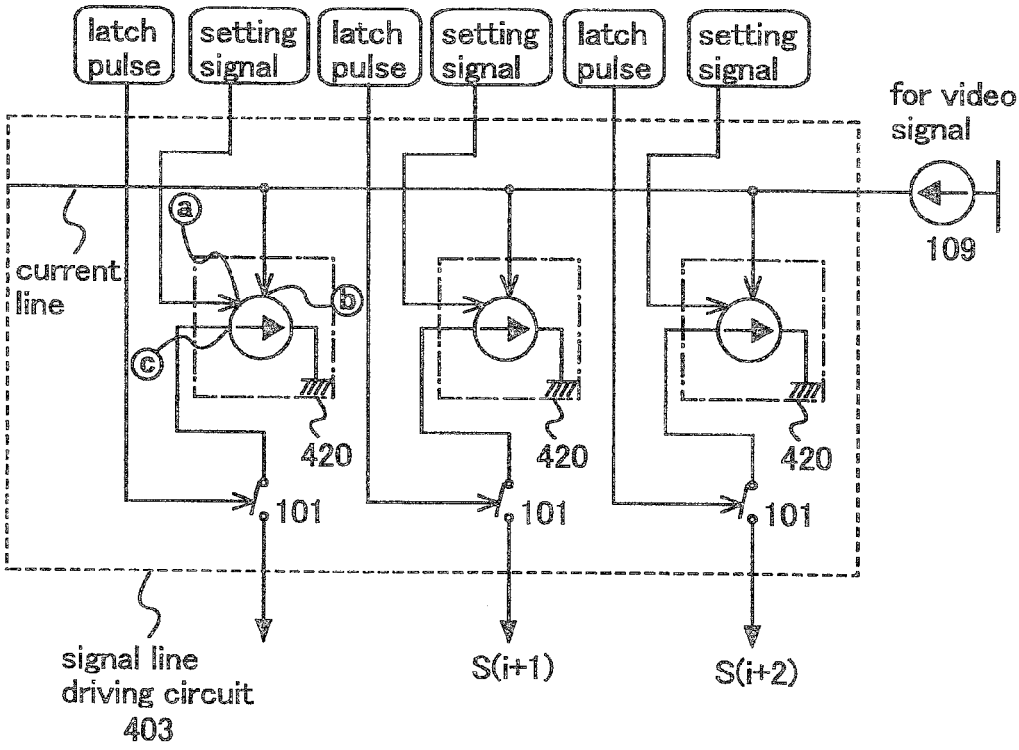
FIG. 1 is a view of a signal line driving circuit.

In the invention, a setting signal input from a terminal a represents a sampling pulse or a latch pulse output from a shift register. In other words, a setting signal input from the terminal a in FIG. 1 corresponds to the sampling pulse or the latch pulse. In the present invention, the setting operation of the current source circuit 420 is performed in accordance with the sampling pulse or the latch pulse output from the shift register.

The signal line driving circuit of the invention has a shift register, a first latch circuit and a second latch circuit. The first and the second latch circuits have current source circuits, respectively. That is, as a setting signal, a sampling pulse output from a shift register is input to the terminal a in the current source circuit of the first latch circuit. And, as a setting signal, a latch pulse is input to the terminal a in the current source circuit of the second latch circuit.

In the first latch circuit, a current (a signal current) from a video data line is supplied to perform the setting operation in the current source circuit of the first latch circuit in concurrence with the sampling pulse output from the shift register. Subsequently, the signal current stored in the first latch circuit is output to the second latch circuit in concurrence with the latch pulse. At this time, in the second latch circuit, the current (a signal current) output from the first latch circuit is supplied to perform the setting operation in the current source circuit of the second latch circuit. Subsequently, the signal current stored in the second latch circuit is output to a pixel via the signal line.

Briefly, when the current source circuit of the first latch circuit performs the setting operation, at the same time, the current source circuit of the second latch circuit outputs the signal current to the pixel, that is, performs input operation. Then, the current source circuit of the first latch circuit performs input operation in concurrence with the latch pulse, in other words, when the first latch outputs a current to the second latch, at the same time, the current source circuit of the second latch uses the current output from the first latch to perform the setting operation. As described above, since it is possible to perform the setting operation and the input operation in each latch simultaneously, more time can be spent on the setting operation, and the setting operation can be done accurately. In addition, the signal current provided from the video date line has a magnitude depending on the video signal. Therefore, since the current provided to the pixel has a magnitude in proportion to the signal current, it becomes possible to display image (gray scale).

Note that a shift register has a structure including, for example, flip-flop circuits (FFs) in a plurality of columns. A clock signal (S-CLK), a start pulse (S-SP), and an inverted clock signal (S-CLKb) are input to the shift register, and signals serially output according to the timing of the input signals are called sampling pulses.

Figure 6A:
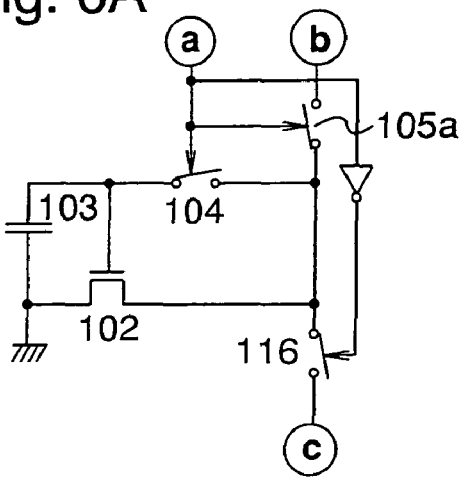
FIGS. 6A-6E are circuit diagrams of current source circuits.

In FIG. 6A, a circuit including switches 104, 105*a*, and 116, a transistor 102 (n-channel type), and a capacitor element 103 for holding a gate-source voltage $V_{GS}$ of the transistor 102 corresponds to the current source circuit 420.

In the current source circuit 420, the switch 104 and the switch 105*a* are turned ON by a signal input via the terminal a. A current is supplied to the current source circuit of the first latch circuit via a terminal b from a constant current source for video signal 109 (hereafter referred to as constant current source 109) connected to a current line (video line), and a charge is retained in the capacitor element 103. The charge is retained in the capacitor element 103 until the current supplied from the constant current source 109 becomes identical with a drain current of the transistor 102.

Further, a current is supplied to the current source circuit of the second latch circuit via the terminal b from the current source circuit of the first latch circuit, and a charge is retained in the capacitor element 103. The charge is retained in the capacitor element 103 until the current supplied from the current source circuit of the first latch circuit becomes identical with a drain current of the transistor 102.

Then, the switch 104 and the switch 105*a* are turned OFF by a signal input via the terminal a. As a result, since the predetermined charge is retained in the capacitor element 103, the transistor 102 is imparted with a capability of flowing a current having a magnitude corresponding to that of the signal current $I_{data}$. If the switch 101 and the switch 116 are turned into a conductive state, in the current source circuit of the first latch circuit, a current via a terminal c flows to the current source circuit of the second latch circuit. At this time, since the gate voltage of the transistor 102 is maintained at a predetermined gate voltage by the capacitor element 103, a drain current corresponding to the signal current $I_{data}$ flows through the drain region of the transistor 102.

Further, in the current source circuit of the second latch circuit, a current flows to the pixel connected to the signal line via the terminal c. At this time, since the gate voltage of the transistor 102 is maintained at a predetermined gate voltage in the capacitor element 103, a drain current corresponding to the current (signal current $I_{data}$) output from the first latch circuit flows through the drain region of the transistor 102. Thus, influence of the variation in characteristics of the transistors constituting the signal line driving circuit is suppressed, and the magnitude of the current input to the pixel can be controlled.

The connection structure of the switch 104 and the switch 105*a* is not limited to the structures shown in FIG. 6A. For example, the structure may be such that one side of the switch 104 is connected to the terminal b, and the other side thereof is connected the gate electrode of the transistor 102; and one side of the switch 105*a* is connected to the terminal b via the switch 104, and the other side thereof is connected to the switch 116. Then, the switch 104 and the switch 105*a* are controlled by a signal input from the terminal a.

Alternatively, the switch 104 may be disposed between the terminal b and the gate electrode of the transistor 104, and the switch 105*a* may be disposed between the terminal b and the switch 116. Specifically, referring to FIG. 28A, lines, switches, and the like may be disposed such that the connection is structured as shown in FIG. 28(A1) in the setting operation, and the connection is structured as shown in FIG. 28(A2) in the input operation. The number of lines, the number of switches, and the structure are not particularly limited.

In the current source circuit 420 of FIG. 6A, the signal setting operation (setting operation) and the signal inputting operation (input operation) to the pixel or the current source circuit, that is, the current outputting operation from the current source circuit cannot be performed simultaneously.

Figure 6B:
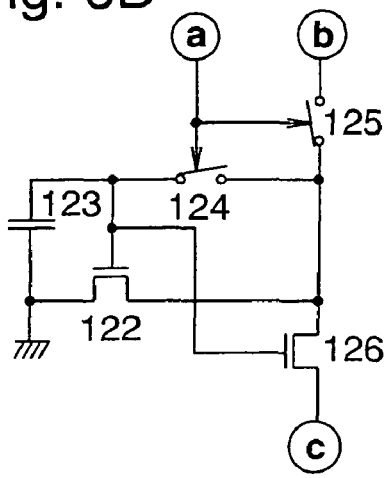

Referring to FIG. 6B, a circuit including a switch 124, a switch 125, a transistor 122 (n-channel type), a capacitor element 123 for retaining a gate-source voltage $V_{GS}$ of the transistor 122, and a transistor 126 (n-channel type) corresponds to the current source circuit 420.

The transistor 126 functions as either a switch or a part of a current source transistor.

In the current source circuit 420, the switch 124 and the switch 125 are turned ON by a signal input via the terminal a. Then, in the current source circuit of the first latch circuit, a current is supplied via the terminal b from the constant current source 109 connected to the current line, and a charge is retained in the capacitor element 123. The charge is retained therein until the signal current $I_{data}$ flown from the constant current source 109 becomes identical with a drain current of the transistor 122. Note that, when the switch 124 is turned ON, since a gate-source voltage $V_{GS}$ of the transistor 126 is set to 0 V, the transistor 126 is turned OFF.

Further, in the current source circuit of the second latch circuit, a signal current $I_{data}$ is supplied via the terminal b from the first latch circuit, and a charge is retained in the capacitor element 123. The charge is retained therein until the current flown from the first latch circuit becomes identical with a drain current of the transistor 122. Note that, when the switch 124 is turned ON, since a gate-source voltage $V_{GS}$ of the transistor 126 is set to 0 V, the transistor 126 is turned OFF.

Subsequently, the switch 124 and the switch 125 are turned OFF. As a result, since the predetermined charge is retained in the capacitor element 123, the transistor 122 in the current source circuit of the first latch circuit is imparted with a capability of flowing a current having a magnitude corresponding to that of the signal current $I_{data}$. If the switch 101 (signal current control switch) is turned into the conductive state, a current flows to the current source circuit of the second latch circuit via the terminal c. At this time, since the gate voltage of the transistor 122 is maintained by the capacitor element 123 at a predetermined gate voltage, a drain current corresponding to the signal current $I_{data}$ flows through the drain region of the transistor 122.

Further, the transistor 122 in the current source circuit of the second latch circuit is imparted with a capability of flowing a current having a magnitude corresponding to that of the current (the signal current $I_{data}$) output from the current source circuit of the first latch circuit. If the switch 101 (signal current control switch) is turned into the conductive state, a current flows to a pixel connected to the signal line via the terminal c. At this time, since the gate voltage of the transistor 122 is maintained by the capacitor element 123 at a predetermined gate voltage, a drain current corresponding to the signal current $I_{data}$ flows through the drain region of the transistor 122.

When the switches 124 and 125 have been turned OFF, gate and source potentials of the transistor 126 are varied not to be the same. As a result, since the charge retained in the capacitor element 123 is distributed also to the transistor 126, and the transistor 126 is automatically turned ON. Here, the transistors 122 and 126 are connected in series, and the gates thereof are connected. Accordingly, the transistors 122 and 126 serve respectively as a multi-gate transistor. That is, a gate length L of the transistor varies between the setting operation and the input operation. Therefore, the value of the current supplied from the terminal b at the time of the setting operation can be made larger than the value of the current supplied from the terminal c at the time of the input operation. Thus, various loads (such as wiring resistances and cross capacitances) disposed between the terminal b and the constant current source 109 can be charged even faster. Consequently, the setting operation can be completed quickly.

The number of switches, the number of lines, and the connections thereamong are not particularly limited. Specifically, referring to FIG. 28B, lines and switches may be disposed such that the connection is structured as shown in FIG. 28(B1) in the setting operation, and the connection is structured as shown in FIG. 28(B2) in the input operation. In particular, in FIG. 28(B2), it is sufficient that the charge accumulated in a capacitor element 123 does not leak.

Note that, in the current source circuit 420 of FIG. 6B, the signal setting operation (setting operation) and the signal inputting operation (input operation) to the pixel or the current source circuit, that is, the current outputting operation from the current source circuit cannot be performed simultaneously.

Figure 6C:
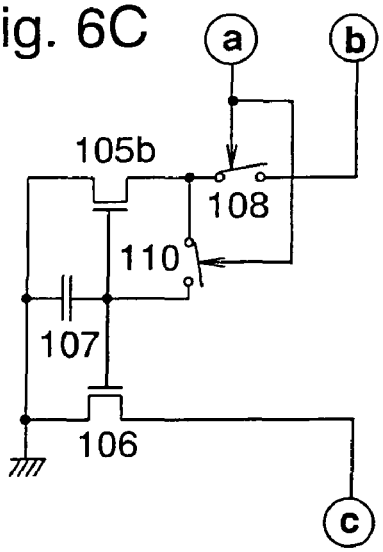

Referring to FIG. 6C, a circuit including a switch 108, a switch 110, transistors 105*b*, 106 (n-channel type), and a capacitor element 107 for retaining gate-source voltage $V_{GS}$ of the transistors 150*b* and 106 corresponds to the current source circuit 420.

In the current source circuit 420, the switch 108 and the switch 110 are turned ON by a signal input via the terminal a. Then, in the current source circuit of the first latch circuit, a current is supplied via the terminal b from the constant current source 109 connected to the current line, and a charge is retained in the capacitor element 107. The charge is retained therein until the signal current $I_{data}$ flown from the constant current source 109 becomes identical with a drain current of the transistor 105*b*. At this time, since the gate electrodes of the transistor 105*b* and of the transistor 106 are connected to each other, the gate voltages of the transistor 105*b* and the transistor 106 are retained by the capacitor element 107.

Further, in the current source circuit of the second latch circuit, a current is supplied via the terminal b from the current source circuit of the first latch circuit, and a charge is retained in the capacitor element 107. The charge is retained therein until the current (the signal current $I_{data}$) flown from the current source circuit of the first latch circuit becomes identical with a drain current of the transistor 105*b*. At this time, since the gate electrodes of the transistor 105*b* and of the transistor 106 are connected to each other, the gate voltages of the transistor 105*b* and the transistor 106 are retained by the capacitor element 107.

Then, the switch 108 and the switch 110 are turned OFF. As a result, in the current source circuit of the first latch circuit, since the predetermined charge is retained in the capacitor element 107, the transistor 106 is imparted with a capability of flowing a current having a magnitude corresponding to that of the signal current $I_{data}$. If the switch 101 is turned to the conductive state, a current flows to the current source circuit of the second latch circuit via the terminal c. At this time, since the gate voltage of the transistor 106 is maintained by the capacitor element 107 at a predetermined gate voltage, a drain current corresponding to the current (the signal current $I_{data}$) flows through the drain region of the transistor 106.

Further, in the current source circuit of the second latch circuit, the current (the signal current $I_{data}$) output from the first latch circuit is retained in the capacitor element 107, the transistor 106 is imparted with a capability of flowing a current having a magnitude corresponding to that of the current (the signal current $I_{data}$). If the switch 101 is turned into the conductive state, a current flows to the pixel connected to the signal line via the terminal c. At this time, since the gate voltage of the transistor 106 is maintained by the capacitor element 107 at a predetermined gate voltage, a drain current corresponding to the current (the signal current $I_{data}$) flows through the drain region of the transistor 106. Thus, influence of the variation in characteristics of the transistors constituting the signal line driving circuit is suppressed, and magnitude of the current input to the pixel can be controlled.

At this time, characteristics of the transistor 105*b* and the transistor 106 need to be the same to cause the drain current corresponding to the signal current $I_{data}$ to flow precisely through the drain region of the transistor 106. To be more specific, values such as mobility and thresholds of the transistor 105*b* and the transistor 106 need to be the same. In addition, in FIG. 6C, the value of W (gate width)/L (gate length) of each of the transistor 105*b* and the transistor 106 may be arbitrarily set, and a current proportional to the signal current $I_{data}$ supplied from the constant current source 109 and the like may be supplied to the pixel.

Further, the values of W/L of the transistor 105*b* and the transistor 106, which is connected to the constant current source 109 is set high, whereby the write speed can be increased by supplying a large current from the constant current source 109.

With the current source circuit 420 shown in FIG. 6B, the signal setting operation (setting operation) can be performed simultaneously with the signal inputting operation (input operation) to the pixel.

Figure 6D:
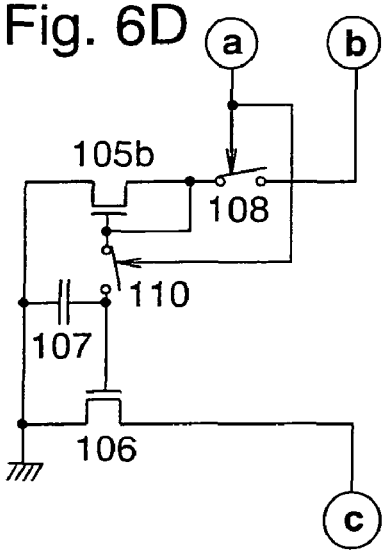
Figure 6E:
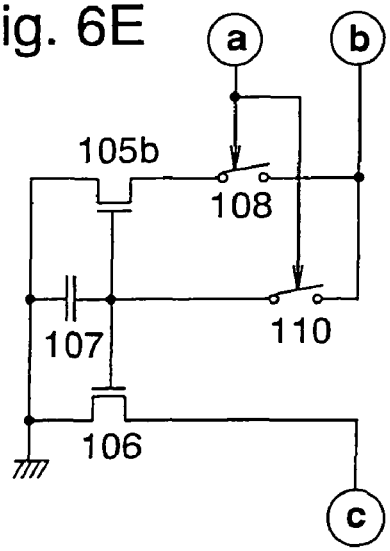

Each of the current source circuits 420 of FIGS. 6D and 6E has the same circuit element connection structures as that of the current source circuit 420 of FIG. 6C, except for the connection structure of the switch 110. In addition, since the operation of the current source circuit 420 of each of FIGS. 6D and 6E conforms to the operation of the current source circuit 420 of FIG. 6C, a description thereof will be omitted in the present embodiment form.

Note that, the number of switches, the number of lines, and the structures thereof are not particularly limited. Specifically, referring to FIG. 28C, lines and switches may be disposed such that the connection is structured as shown in FIG. 28(C1) in the setting operation, and the connection is structured as shown in FIG. 28(C2) in the input operation. In particular, in FIG. 28(C2), it is sufficient that the charge accumulated in the capacitor element 107 does not leak.

Referring to FIG. 29A, a circuit including switches 195*b*, 195*c*, 195*d*, and 195*f*, a transistor 195*a*, and a capacitor element 195*e* corresponds to the current source circuit. In the current source circuit shown in FIG. 29A, the switches 195*b*, 195*c*, 195*d*, and 195*f* are turned ON by a signal input via the terminal a. Then, a current is supplied via the terminal b from the constant current source 109 connected to the current line. A predetermined charge is retained in the capacitor element 195*e* until the signal current supplied from the constant current source 109 becomes identical to a drain current of the transistor 195*a*.

Then, the switches 195*b*, 195*c*, 195*d*, and 195*f* are turned OFF by a signal input via the terminal a. At this time, since the predetermined charge is retained in the capacitor element 195*e*, the transistor 195*a* is imparted with a capability of flowing a current having a magnitude corresponding to that of the signal current. This is because the gate voltage of the transistor 195*a* is set by the capacitor element 195*a* to a predetermined gate voltage, and a drain current corresponding to a current (reference current) flows through the drain region of the transistor 195*a*. In this state, a current is supplied to the outside via the terminal c. Note that, in the current source circuit shown in FIG. 29A, the setting operation for setting the current source circuit to have a capability of flowing a signal current cannot be performed simultaneously with the input operation for inputting the signal current to the pixel. In addition, when a switch controlled by the signal input via the terminal a is ON, and also, when a current is controlled not to flow from the terminal c, the terminal c needs to be connected to another line of the other potential. Here, the line potential is represented by Va. Va may be a potential sufficient to flow a current flowing from the terminal b as it is, and may be a power supply voltage Vdd as an example.

Note that, the number of switches, the number of lines, and the structures thereof are not particularly limited. Specifically, referring to FIGS. 29B and 29C, lines and switches may be disposed such that the connection is structured as shown in either FIG. 29(B1) or 29(C1) in the setting operation, and the connection is structured as shown in either FIG. 29(B2) or 29(C2) in the input operation.

Further, in the current source circuits of FIGS. 6A and 6C to 6E, the current-flow directions (directions from the pixel to the signal line driving circuit) are the same. The polarity (conductivity type) of each of the transistor 102, the transistor 105*b*, and the transistor 106 can be of p-channel type.

Figure 7A:
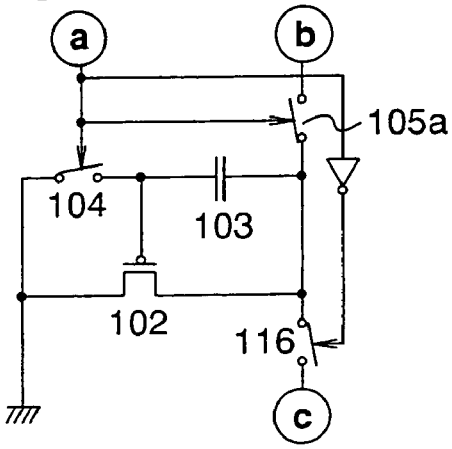
FIGS. 7A-7D are circuit diagrams of current source circuits.
Figure 7B:
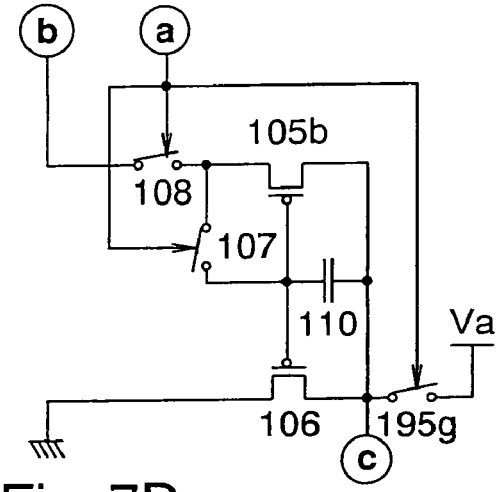
Figure 7C:
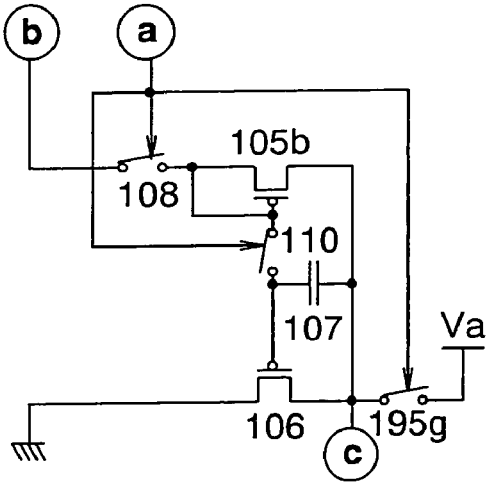
Figure 7D:
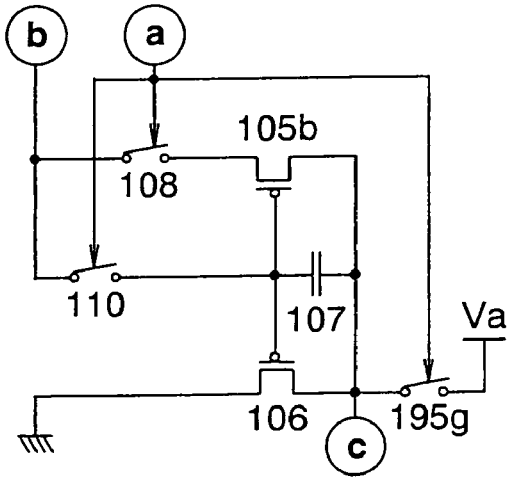

FIG. 7A shows a circuit structure in which the current-flow direction (direction from the pixel to the signal line driving circuit) is the same, and the transistor 102 shown in FIG. 6A is set to be of p-channel type. In FIG. 7A, with the capacitor element disposed between the gate and the source, even when the source potential varies, the gate-source voltage can be maintained. Further, FIGS. 7B to 7D show circuit diagrams in which the current-flow directions (directions from the pixel to the signal line driving circuit) are the same, and the transistor 105*b* and the transistor 106 shown in FIGS. 6C to 6E are set to be of p-channel type.

Figure 30A:
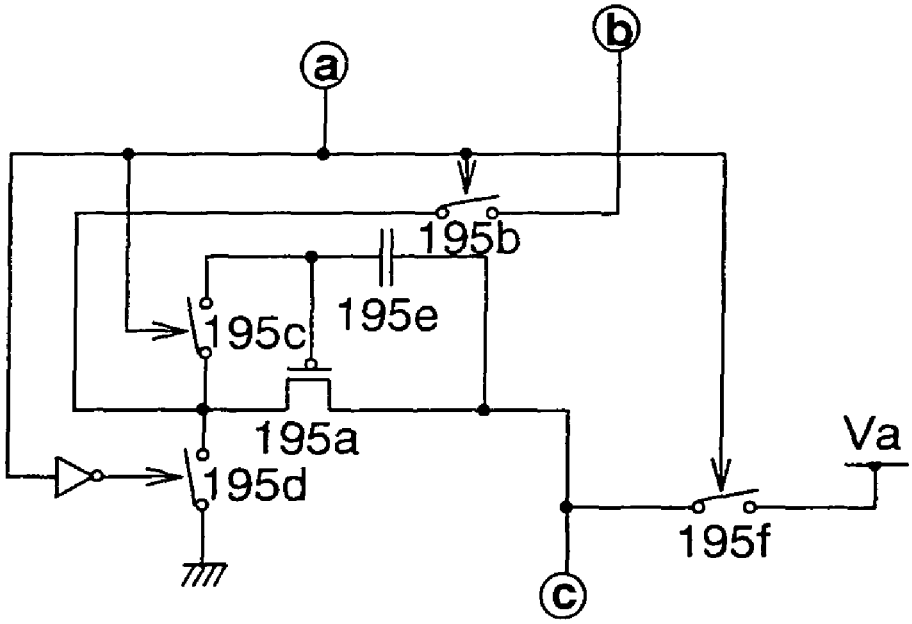
FIGS. 30A-30B are circuit diagrams of a current source.
Figure 30B:
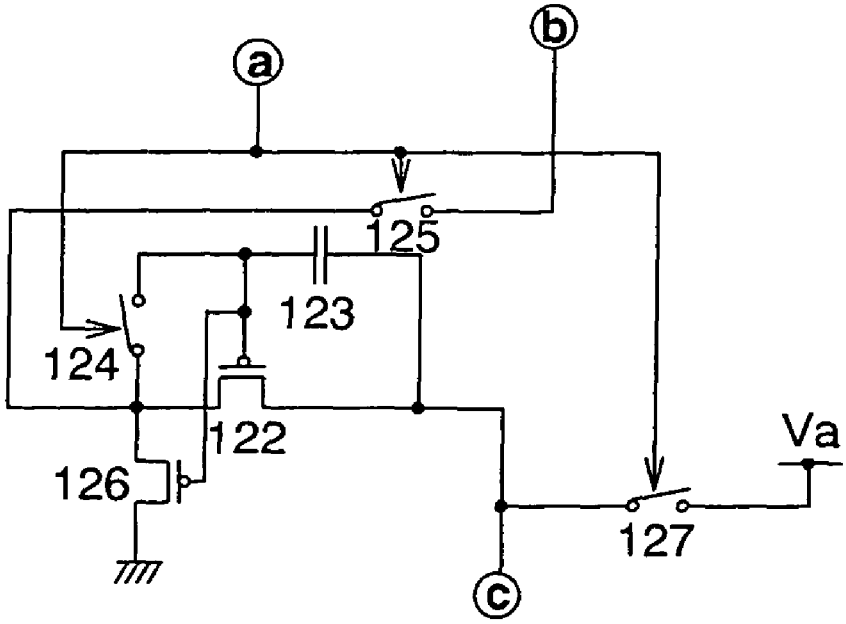

Further, FIG. 30A shows a case where the transistor 195*a* is set to be of p-channel type in the structure of FIG. 29. FIG. 30B shows a case where the transistors 122 and 126 are set to be of p-channel type in the structure of FIG. 6B.

Referring to FIG. 32, a circuit including switches 104 and 116, a transistor 102, a capacitor element 103, and the like corresponds to the current source circuit.

FIG. 32A corresponds to the circuit of FIG. 6A that is partly modified. In the current source circuit of FIG. 32A, the transistor gate width W varies between the setting operation of the current source and the input operation. Specifically, in the setting operation, the connection is structured as shown in FIG. 32B, in which the gate width W is large. In the input operation, the connection is structured as shown in FIG. 32C, in which the gate width W is small. Therefore, the value of the current supplied from the terminal b at the time of the setting operation can be made larger than the value of the current supplied from the terminal c at the time of the input operation. Thus, various loads (such as wiring resistances and cross capacitances) disposed between the terminal b and the constant current source for the video signal can be charged even faster. Consequently, the setting operation can be completed quickly.

Note that, FIG. 32 shows the circuit of FIG. 6A that is partly modified. In addition, the circuit can be easily applied to, for example, other circuits shown in FIG. 6 and to the circuits shown in FIG. 7, FIG. 29, FIG. 31, and FIG. 30.

Note that, in the above mentioned current source circuits, a current flows from the pixel to the signal line driving circuit. However, the current not only flows from the pixel to the signal line driving circuit, but also may flow from the signal line driving circuit to the pixel. It depends on the structure of the pixel circuit that the current flows in a direction from the pixel to the signal line driving circuit or in a direction from the signal line driving circuit to the pixel. In the case where the current flows from the signal line driving circuit to the pixel, Vss (low potential power source) may be set to Vdd (high potential power source), and the transistors 102, 105*b*, 106, 122, and 126 may be set to be of p-channel type in FIG. 6. Also in the circuit diagram shown in FIG. 7, Vss may be set to Vdd, and the transistors 102, 105*b*, and 106 may be of n-channel type.

Note that lines and switches may be disposed such that the connection is structured as shown in FIGS. 31(A1) to 41(D1) in the setting operation, and the connection is structured as shown in FIGS. 31(A2) to 41(D2) in the input operation. The number of switches, the number of lines and the connection structures thereof are not particularly limited.

Note that, in all the current source circuits described above, the disposed capacitor element may not be disposed by being substituted by, for example, a gate capacitance of a transistor.

Hereinafter, a description will be made in detail regarding the operations of the current source circuits of FIGS. 6A, 7A, 6C to 6E, and 7B to 7D among those described above by using FIGS. 6 and 7. To begin with, the operations of the current source circuits of FIGS. 6A and 7A will be described with reference to FIG. 19.

Figure 19A:
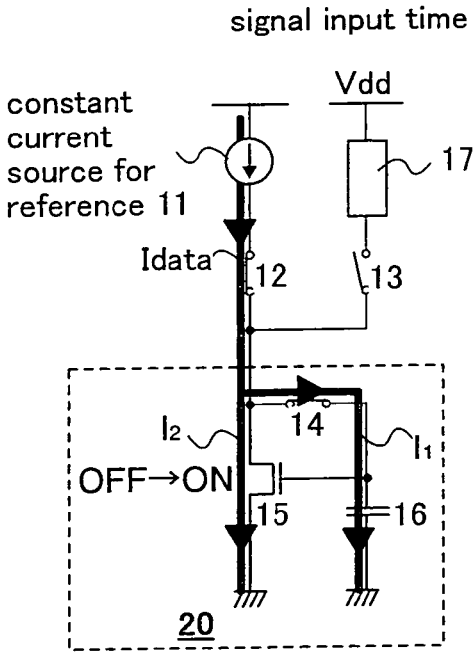
FIGS. 19A-19F are explanatory views of operations of a current source circuit.
Figure 19B:
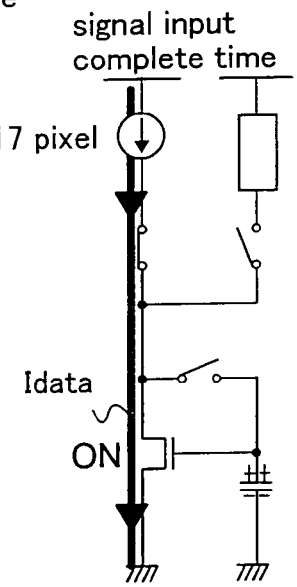
Figure 19C:
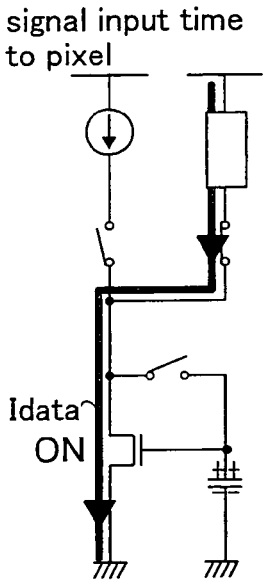
Figure 19D:
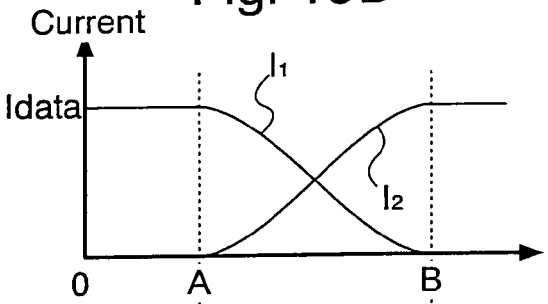
Figure 19E:
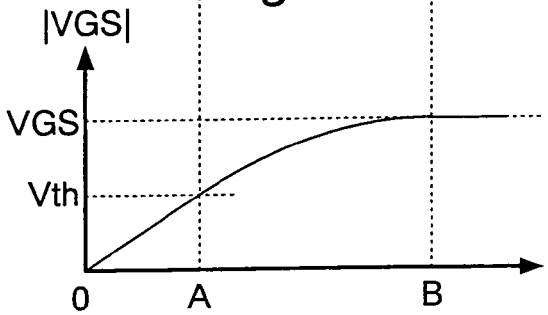

FIGS. 19A to 19C schematically show paths of a current flowing among circuit elements. FIG. 19D shows the relationship between the current flowing through each path and the time in writing the signal current $I_{data}$ to the current source circuit. FIG. 19E shows the relationship between the voltage accumulated in a capacitor element 16, that is, the gate-source voltage of a transistor 15, and the time in writing the signal current $I_{data}$ to the current source circuit. In the circuit diagrams of FIGS. 19A to 19C, numeral 11 denotes a constant current source for video signal, switches 12 to 14 each are a semiconductor device having a switching function, numeral 15 denotes a transistor (n-channel type), numeral 16 denotes a capacitor element, and numeral 17 denotes a pixel. In this embodiment form, the switch 14, the transistor 15, and the capacitor element 16 form an electric circuit corresponding to a current source circuit 20. Drawing lines and reference symbols are shown in FIG. 19A. Since drawing lines and reference symbols shown in FIGS. 19B and 19C are similar to those shown in FIG. 19A, they are omitted here. Note that in this specification, a current is supplied form a constant current source 11 for video signal in the current source circuit of the first latch circuit, the current source circuit of the second latch circuit flows a current to the pixel connected to the signal line. However, here, in order to simplify the description, a current source circuit in which a current is supplied from a constant current source for video signal to a pixel connected to a signal line is described.

A source region of the n-channel transistor 15 is connected to Vss, and a drain region thereof is connected to the constant current source 11 for video signal. One of electrodes of the capacitor element 16 is connected to Vss (the source of the transistor 15), and the other electrode is connected to the switch 14 (the gate of the transistor 15). The capacitor element 16 plays a role of holding the gate-source voltage of the transistor 15.

The pixel 17 is formed of a light emitting element, a transistor, or the like. The light emitting element includes an anode, a cathode, and a light emitting layer sandwiched between the anode and the cathode. In this specification, when the anode is used as a pixel electrode, the cathode is referred to as an opposing electrode; in contrast, when the cathode is used as a pixel electrode, the anode is referred to as an opposing electrode. The light emitting layer can be formed of a known light emitting material. The light emitting layer has two structures: a single layer structure and a laminate structure, and the present invention may use any one of known structures. Luminescence in the light emitting layer includes light emission (fluorescence) in returning from a singlet excited state to a normal state and light emission (phosphorescence) in returning from a triplet excited state to a normal state. The present invention may be applied to a light emitting device using either one or both of the two types of light emission. Further, the light emitting layer is formed of a known material such as an organic material or an inorganic material.

Note that, in practice, the current source circuit 20 is provided in the signal line driving circuit. A current corresponding to the signal current $I_{data}$ flows via, for example, a circuit element included in the signal line or the pixel from the current source circuit 20 provided in the signal line driving circuit. However, since FIG. 19 is a diagram for briefly explaining the outline of the relationship among the constant current source 11 for video signal, the current source circuit 20, and the pixel 17, a detailed illustration of the structure is omitted.

First, an operation (setting operation) of the current source circuit 20 for retaining the signal current $I_{data}$ will be described by using FIGS. 19A and 19B. Referring to FIG. 19A, the switch 12 and the switch 14 are turned ON, and the switch 13 is turned OFF. In this state, the signal current $I_{data}$ is output from the constant current source 11 for video signal, and flows to the current source circuit 20 from the constant current source 11 for video signal. At this time, since the signal current $I_{data}$ is flowing from the constant current source 11 for video signal, the current flows separately through current paths $I_1$ and $I_2$ in the current source circuit 20, as shown in FIG. 19A. FIG. 19D shows the relationship at this time. Needless to say, the relationship is expressed as $I_{data}=I_1+I_2$.

The moment the current starts to flow from the constant current source 11 for video signal, since no charge is accumulated in the capacitor element 16, the transistor 15 is OFF. Accordingly, $I_2=0$ and $I_{data}=I_1$ are established.

Charge is gradually accumulated into the capacitor element 16, and a potential difference begins to occur between both electrodes of the capacitor element 16 (FIG. 19E). When the potential difference of both the electrodes has reached $V_{th}$ (point A in FIG. 19E), the transistor 15 is turned ON, and $I_2>0$ is established. As described above, since $I_{data}=I_1+I_2$, while $I_1$ gradually decreases, the current keeps flowing. Charge accumulation is continuously performed in the capacitor element 16.

The potential difference between both the electrodes of the capacitor element 16 serves as the gate-source voltage of the transistor 15. Thus, charge accumulation in the capacitor element 16 continues until the gate-source voltage of the transistor 15 reaches a desired voltage, that is, a voltage (VGS) that allows the transistor is to be flown with the current $I_{data}$. When charge accumulation terminates (B point in FIG. 19E), the current $I_1$ stops flowing. Further, since the TFT 15 is ON, $I_{data}=I_2$ is established (FIG. 19B).

Next, an operation (input operation) for inputting the signal current $I_{data}$ to the pixel will be described by using FIG. 19C. When the signal current $I_{data}$ is input to the pixel, the switch 13 is turned ON, and the switch 12 and the switch 14 are turned OFF. Since VGS written in the above-described operation is held in the capacitor element 16, the transistor 15 is ON. A current identical with the signal current $I_{data}$ flows to Vss via the switch 13 and transistor 15, and the input of the signal current $I_{data}$ to the pixel is then completed. At this time, when the transistor 15 is set to operate in a saturation region, even if the source-drain voltage of the transistor 15 varies, a current flowing into the pixel can flows constantly.

In the current source circuit 20 shown in FIG. 19, as shown in FIGS. 19A to 19C, the operation is divided into an operation (setting operation; corresponding to FIGS. 19A and 19B) for completing a write of the signal current $I_{data}$ to the current source circuit 20, and an operation (input operation; corresponding to FIG. 19C) for inputting the signal current $I_{data}$ to the pixel). Then, in the pixel, a current is supplied to the light emitting element in accordance with the input signal current $I_{data}$.

The current source circuit 20 of FIG. 19 is not capable of performing the setting operation and the input operation simultaneously. In the case where the setting operation and the input operation need to be performed simultaneously, at least two current source circuits are preferably provided to each of a plurality of signal lines each of which is connected with a plurality of pixels and which are provided in a pixel portion. However, if the setting operation can be performed within a period during which the signal current $I_{data}$ is not input to the pixel, only one current source circuit may be provided for each signal line (each column).

Figure 19F:
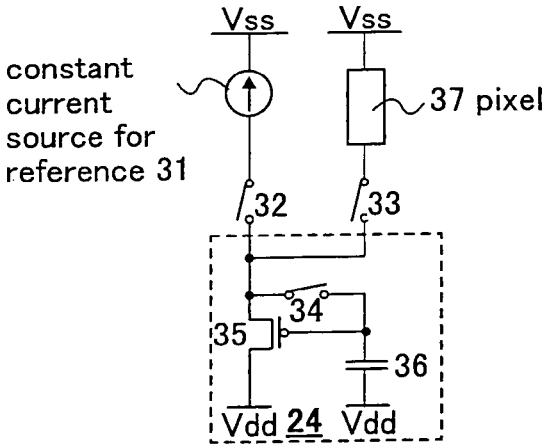

Although the transistor 15 of the current source circuit 20 shown in each of FIGS. 19A to 19C is of n-channel type, the transistor 15 of the current source circuit 20 may be of p-channel type, of course. Here, a circuit diagram for the case where the transistor 15 is of p-channel type is shown in FIG. 19. Referring to FIG. 19F, numeral 31 denotes a constant current source for video signal, switches 32 to 34 each are a semiconductor device (transistor) having a switching function, numeral 35 denotes a transistor (p-channel type), numeral 36 denotes a capacitor element, and numeral 37 denotes a pixel. In this embodiment form, the switch 34, the transistor 35, and the capacitor element 36 form an electric circuit corresponding to a current source circuit 24.

The transistor 35 is of p-channel type. One of a source region and a drain region of the transistor 35 is connected to Vdd, and the other is connected to the constant current source 31. One of electrodes of the capacitor element 36 is connected to Vdd, and the other electrode is connected to the switch 36. The capacitor element 36 plays a role of holding the gate-source voltage of the transistor 35.

Operation of the current source circuit 24 of FIG. 19F is similar to the operation of the current source circuit 20 described above, except for the current-flow direction, and thus, a description thereof will be omitted here. In the case of designing the current source circuit in which the polarity of the transistor 15 is changed without changing the current-flow direction, the circuit diagram of FIG. 7A may be referenced.

Figure 33:
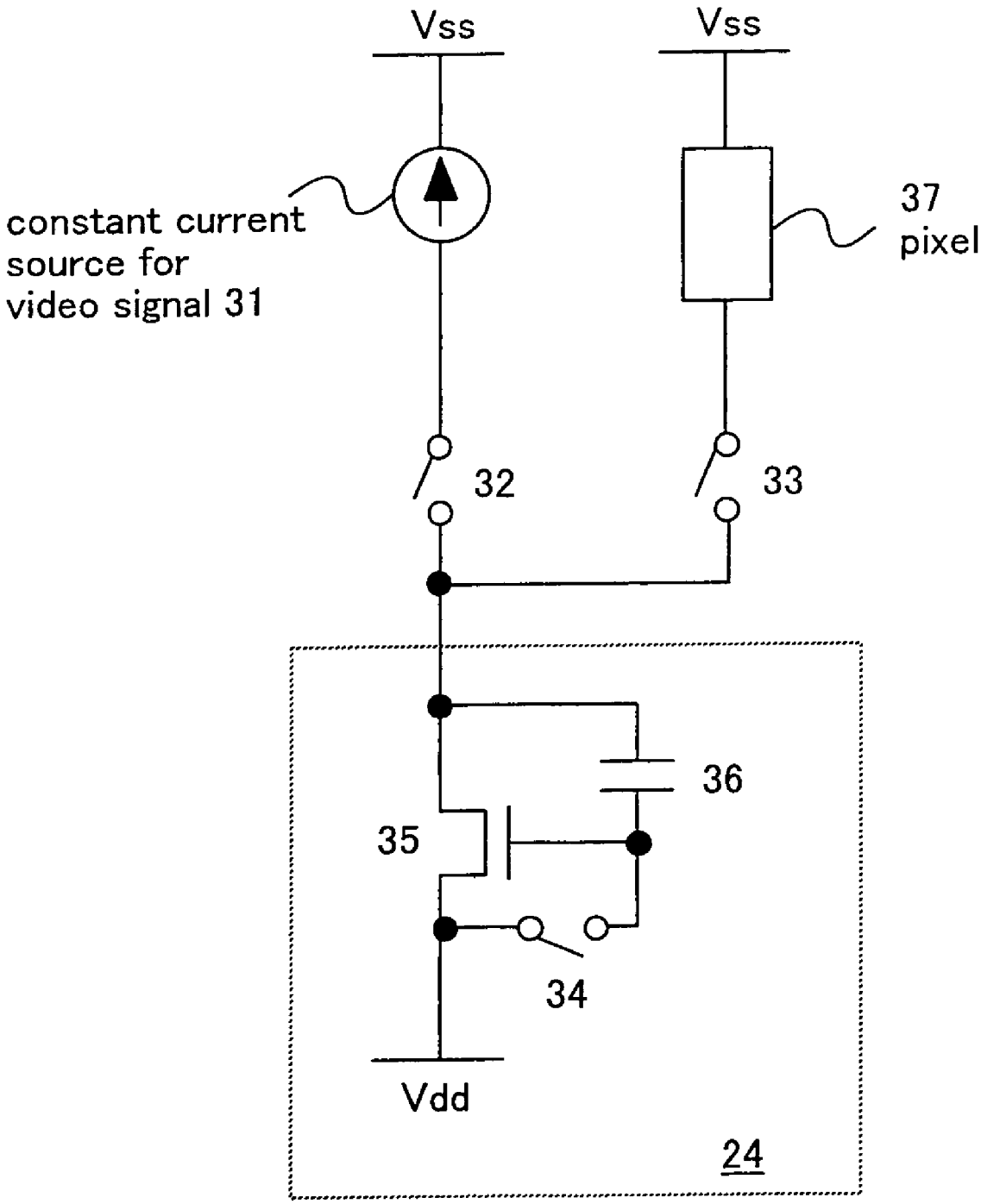
FIG. 33 is a circuit diagram of a current source.

Note that in FIG. 33, the current-flow direction is the same as in FIG. 19F, in which the transistor 35 is of n-channel type. The capacitor element 36 is connected between the gate and the source of the transistor 35. The source potential of the transistor 35 varies between the setting operation and the input operation. However, even when the source potential varies, since the gate-source voltage is retained, a normal operation is implemented.

Next, operations of the current source circuits shown in FIGS. 6C to 6E and FIGS. 7B to 7D will be described by using FIGS. 20 and 21. FIGS. 20A to 20C schematically show paths through which a current flows among circuit elements. FIG. 20D shows the relationship between the current flowing through each path and the time in writing the signal current $I_{data}$ to the current source circuit. FIG. 20E shows the relationship between the voltage accumulated in a capacitor element 46, that is, the gate-source voltages of transistor 43, 44, and the time in writing the signal current $I_{data}$ to the current source circuit. Further, in the circuit diagrams of FIGS. 20A to 20C, numeral 41 denotes a constant current source for video signal, a switch 42 is a semiconductor device having a switching function, numerals 43 and 44 denote transistors (n-channel type), numeral 46 denotes a capacitor element, and numeral 47 denotes a pixel. In this embodiment form, the switch 42, the transistors 43 and 44, and the capacitor element 46 compose an electric circuit corresponding to a current source circuit 25. Note that drawing lines and reference symbols are shown in FIG. 20A, and since drawing lines and reference symbols shown in FIGS. 20B and 20C conform to those shown in FIG. 20A, they are omitted. Note that in this specification, a current is supplied form a constant current source 11 for video signal in the current source circuit of the first latch circuit, the current source circuit of the second latch circuit flows a current to the pixel connected to the signal line. However, here, in order to simplify the description, a current source circuit in which a current is supplied from a constant current source for video signal to a pixel connected to a signal line is described.

A source region of the n-channel transistor 43 is connected to Vss, and a drain region thereof is connected to the video signal current source 41. A source region of the n-channel transistor 44 is connected to Vss, and a drain region thereof is connected to a terminal 48 of the light emitting element 47. One of electrodes of the capacitor element 46 is connected to Vss (the sources of the transistors 43 and 44), and the other electrode thereof is connected to the gate electrodes of the transistors 43 and 44. The capacitor element 46 plays a role of holding gate-source voltages of the transistors 43 and 44.

Note that, in practice, the current source circuit 25 is provided in the signal line driving circuit. A current corresponding to the signal current $I_{data}$ flows via, for example, a circuit element included in the signal line or the pixel, from the current source circuit 25 provided in the signal line driving circuit. However, since FIG. 20 is a diagram for briefly explaining the outline of the relationship among the constant current source for video signal 41, the current source circuit 25, and the pixel 47, a detailed illustration of the structure is omitted.

In the current source circuit 25 of FIG. 20, the sizes of the transistors 43 and 44 are important. Hereinafter, using different reference symbols, a case where the sizes of the transistors 43 and 44 are identical and a case the sizes are mutually different will be described. Referring to FIGS. 20A to 20C, the case where the sizes of the transistors 43 and 44 are mutually identical will be described by using the signal current $I_{data}$. The case where the sizes of the transistors 43 and 44 are mutually different will be described by using a signal current $I_{data1}$ and a signal current $I_{data2}$. Note that the sizes of the transistors 43 and 44 are determined using the value of W (gate width)/L (gate length) of each transistor.

First, the case where the sizes of the transistors 43 and 44 are mutually identical will be described. To begin with, operation for retaining the signal current $I_{data}$ in the current source circuit 20 will be described by using FIGS. 20A and 20B. Referring to FIG. 20A, when the switch 42 is turned ON, the signal current $I_{data}$ is set in the video signal current source 41, and flows from the constant current source for video signal 41 to the current source circuit 25. At this time, since the signal current $I_{data}$ is flowing from the constant current source for video signal 41, the current flows separately through current paths $I_1$ and $I_2$ in the current source circuit 20, as shown in FIG. 20A. FIG. 20D shows the relationship at this time. Needless to say, the relationship is expressed as $I_{data}=I_1+I_2$.

The moment the current starts to flow from the video signal current source 41, since no charge is yet accumulated in the capacitor element 46, the transistors 43 and 44 are OFF. Accordingly, $I_2=0$ and $I_{data}=I_1$ are established.

Then, charge is gradually accumulated into the capacitor element 46, and a potential difference begins to occur between both electrodes of the capacitor element 46 (FIG. 20E). When the potential difference of both the electrodes has reached $V_{th}$ (point A in FIG. 20)), the transistors 43 and 44 are turned ON, and $I_2>0$ is established. As described above, since $I_{data}=I_1+I_2$, while $I_1$ gradually decreases, the current keeps flowing. Charge accumulation is continuously performed in the capacitor element 46.

The potential difference between both the electrodes of the capacitor element 46 serves as the gate-source voltage of each of the transistors 43 and 44. Thus, charge accumulation in the capacitor element 46 continues until the gate-source voltages of the transistors 43 and 44 each reach a desired voltage, that is, a voltage (VGS) that allows the transistor 44 to be flown with the current $I_{data}$. When charge accumulation terminates (B point in FIG. 20E), the current $I_1$ stops flowing. Further, since the transistors 43 and 44 are ON, $I_{data}=I_2$ is established (FIG. 20B).

Next, operation for inputting the signal current $I_{data}$ to the pixel will be described by using FIG. 20C. First, the switch 42 is turned OFF. Since VGS written at the above-described operation is retained in the capacitor element 46, the transistors 43 and 44 are ON. A current identical with the signal current $I_{data}$ flows from the pixel 47. Thus, the signal current $I_{data}$ is input to the pixel. At this time, when the transistor 44 is set to operate in a saturation region, even if the source-drain voltage of the transistor 44 varies, the current flowing in the pixel can be flown without variation.

In the case of a current mirror circuit shown in FIG. 6C, even when the switch 42 is not turned OFF, a current can be flown to the pixel 47 by using the current supplied from the video signal current source 41. That is, the setting operation for setting a signal for the current source circuit 20 can be implemented simultaneously with the operation (input operation) for inputting a signal to the pixel.

Next, a case where the sizes of the transistors 43 and 44 are mutually different will be described. An operation of the current source circuit 25 is similar to the above-described operation; therefore, a description thereof will be omitted here. When the sizes of the transistors 43 and 44 are mutually different, the signal current $I_{data1}$ set in the video signal current source 41 is inevitably different from the signal current $I_{data2}$ that flows to the pixel 47. The difference therebetween depends on the difference between the values of W (gate width)/L (gate length) of the transistors 43 and 44.

In general, the W/L value of the transistor 43 is preferably set larger than the W/L value of the transistor 44. This is because the signal current $I_{data1}$ can be increased when the W/L value of the transistor 43 is set large. In this case, when the current source circuit is set with the signal current $I_{data1}$, Loads (cross capacitances, wiring resistances) can be charged. Thus, the setting operation can be completed quickly.

The transistors 43 and 44 of the current source circuit 25 in each of FIGS. 20A to 20C are of n-channel type, but the transistors 43 and 44 of the current source circuit 25 may be of p-channel type. Here, FIG. 21 shows a circuit diagram in which the transistors 43 and 44 are of p-channel type.

Figure 21:
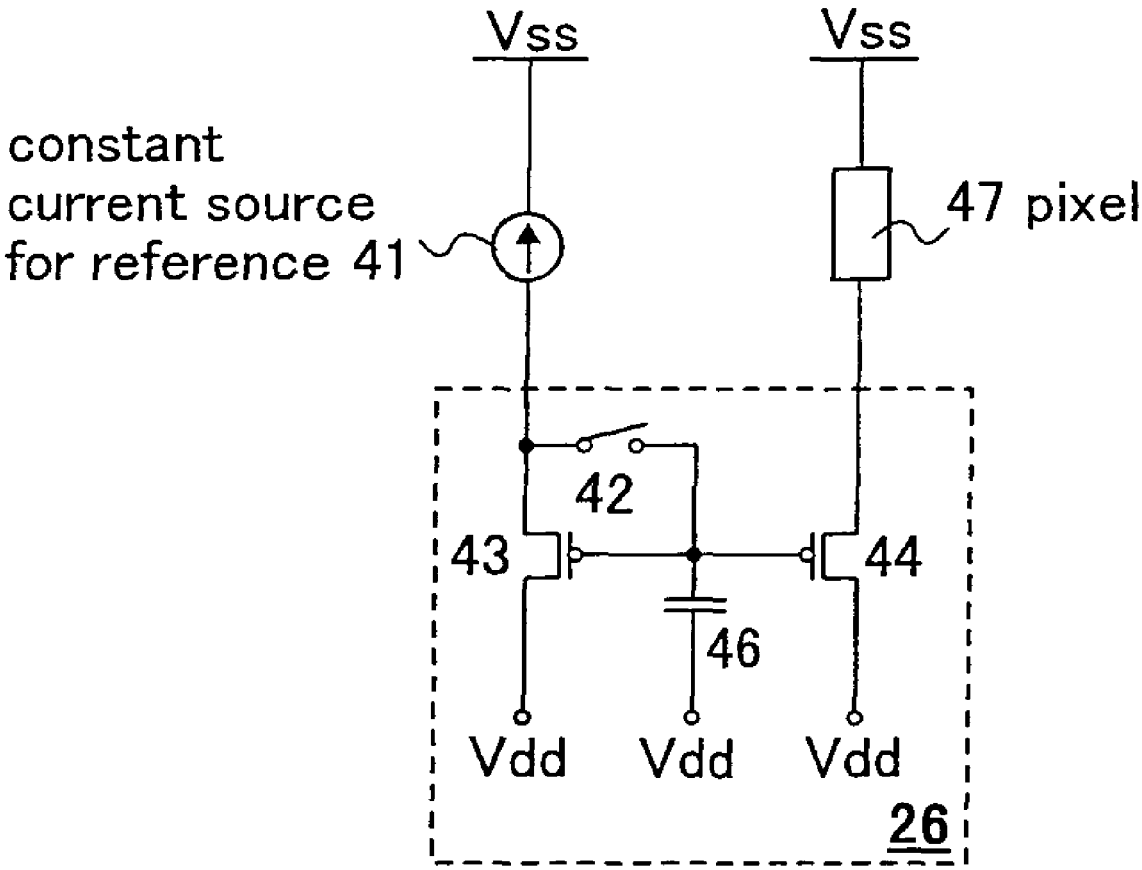
FIG. 21 is an explanatory view of operations of a current source circuit.

Referring to FIG. 21, numeral 41 denotes a constant current source, a switch 42 is a semiconductor device having a switching function, numerals 43 and 44 denote transistors (p-channel type), numeral 46 denotes a capacitor element, and numeral 47 denotes a pixel. In this embodiment form, the switch 42, the transistors 43 and 44, and the capacitor element 46 form an electric circuit corresponding to a current source circuit 26.

A source region of the p-channel transistor 43 is connected to Vdd, and a drain region thereof is connected to the constant current source 41. A source region of the p-channel transistor 44 is connected to Vdd, and a drain region thereof is connected to a terminal 48 of the light emitting element 47. One of electrodes of the capacitor element 46 is connected to (source), and the other electrode is connected to the gate electrodes of the transistors 43 and 44. The capacitor element 46 plays a role of holding gate-source voltages of the transistors 43 and 44.

Operation of the current source circuit 24 of FIG. 21 is similar to that shown in each of Figs. FIGS. 20A to 20C except for the current-flow direction, and thus, a description thereof will be omitted here. In the case of designing the current source circuit in which the polarities of the transistors 43 and 44 are changed without changing the current-flow direction, FIG. 7B and FIG. 33 may be referenced.

In summary, in the current source circuit of FIG. 19, the current having the same magnitude as that of the signal current $I_{data}$ set in the current source flows to the pixel. In other words, the signal current $I_{data}$ set in the constant current source is identical in value with the current flowing to the pixel. The current is not influenced by variation in characteristics of the transistors provided in the current source circuit.

In each of the current source circuits of FIG. 19 and FIG. 6B, the signal current $I_{data}$ cannot be output to the pixel from the current source circuit in a period during which the setting operation is performed. Thus, two current source circuits are preferably provided for each signal line, in which an operation (setting operation) for setting a signal is performed to one of the current source circuits, and an operation (input operation) for inputting $I_{data}$ to the pixel is performed using the other current source circuit.

However, in the case where the setting operation and the input operation are not performed at the same time, only one current source circuit may be provided for each column. The current source circuit of each of FIGS. 29A and 30A is similar to the current source circuit of FIG. 19, except for the connection and current-flow paths. The current source circuit of FIG. 32A is similar, except for the difference in magnitude between the current supplied from the constant current source and the current flowing from the current source circuit. The current source circuits of FIGS. 6B and 30B are similar, except for the difference in magnitude between the current supplied from the constant current source and the current flowing from the current source circuit. Specifically, in FIG. 32A, only the gate width W of the transistor is different between the setting operation and the input operation; in FIGS. 6B and 30B, only the gate length L is different between the setting operation and the input operation; and others are similar to those of the structure of the current source circuit in FIG. 19.

In each of the current source circuits of FIGS. 20 and 21, the signal current $I_{data}$ set in the constant current source and the value of the current flowing to the pixel are dependent on the sizes of the two transistors provided in the current source circuit. In other words, the signal current $I_{data}$ set in the constant current source and the current flowing to the pixel can be arbitrarily changed by arbitrarily designing the sizes (W (gate width)/L (gate length)) of the two transistors provided in the current source circuit. However, output of precise signal current $I_{data}$ to the pixel is difficult in the case where variation is caused in the characteristics of the two transistors, such as threshold values and mobility.

Further, in each of the current source circuits of FIGS. 20 and 21, the signal can be input to the pixel during the setting operation. That is, the setting operation for setting the signal can be performed simultaneously with the operation (input operation) for inputting the signal to the pixel. Thus, unlike the current source circuit of FIG. 19, two current source circuits do not need to be provided in a single signal line.

The present invention with the above structure can suppress the influence of variation in the TFT characteristics and supply a desired current to the outside.

Embodiment Form 2

In this embodiment form, the structure of a light emitting device including a signal line driving circuit of the present invention will be described by using FIG. 15.

Figure 15A:
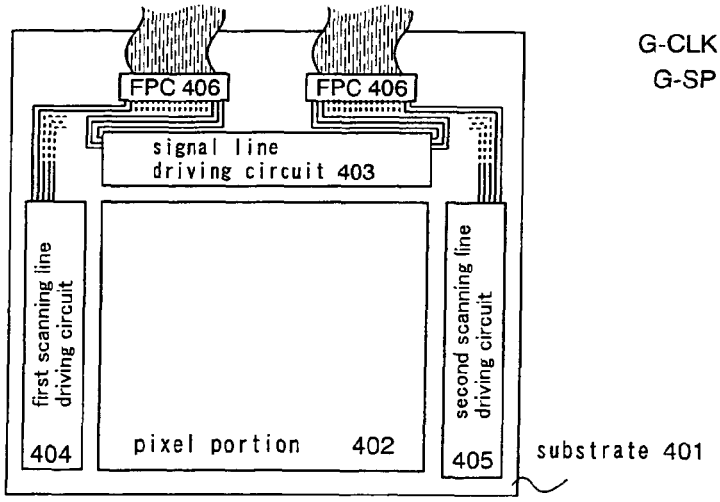
FIGS. 15A-15B are views of a light emitting device of the present invention.

The light emitting device of the invention comprises a pixel portion 402 with a plurality of pixels arranged in a matrix shape, on a substrate 401, and a signal line driving circuit 403, a first scanning line driving circuit 404, and a second scanning line driving circuit 405 arranged around the pixel portion 402. In FIG. 15A, although it has the signal line driving circuit 403 and two sets of scanning line driving circuits 404 and 405, the invention is not restricted to this. The number of the driving circuits can be determined depending on the structure of the pixels. A signal is supplied from the outside to the signal line driving circuit 403, the first scanning line driving circuit 404, and the second scanning line driving circuit 405, through the FPC 406.

Figure 15B:
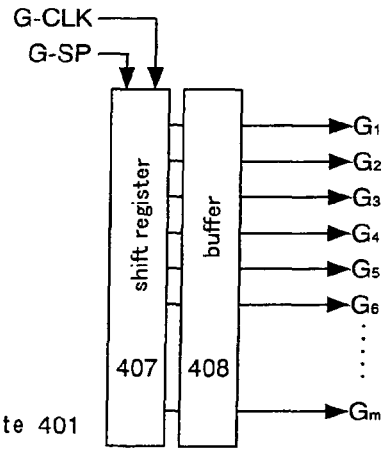

The structure of the first scanning line driving circuit 404 and the second scanning line driving circuit 405 will be described by using FIG. 15B. Each of the first scanning line driving circuit 404 and the second scanning line driving circuit 405 has a shift register 407 and a buffer 408. For an easy description of the operation, the shift register 407 supplies sampling pulses sequentially, according to a clock signal (G-CLK), a start pulse (S-SP), and a clock inverse signal (G-CLKb). Thereafter, the sampling pulses amplified by the buffer 408 are supplied to the scanning lines to make each one line into a selection state. Then, a signal current $I_{data}$ is sequentially written into the controlled pixel from the signal line, according to the selected scanning line.

Between the shift register 407 and the buffer 408, a level shifter circuit may be arranged. The voltage amplitude can be increased by placing the level shifter circuit.

The structure of the signal line driving circuit 403 will be described below. The form of this embodiment may be freely combined with the embodiment form 1.

Embodiment Form 3

In this embodiment form, the structure of the signal line driving circuit 403 shown in FIG. 15A and the operation thereof will be described. In this embodiment form, the signal line driving circuit 403 used for performing an analog gradation display or a digital gradation display of one bit will be described.

Figure 3A:
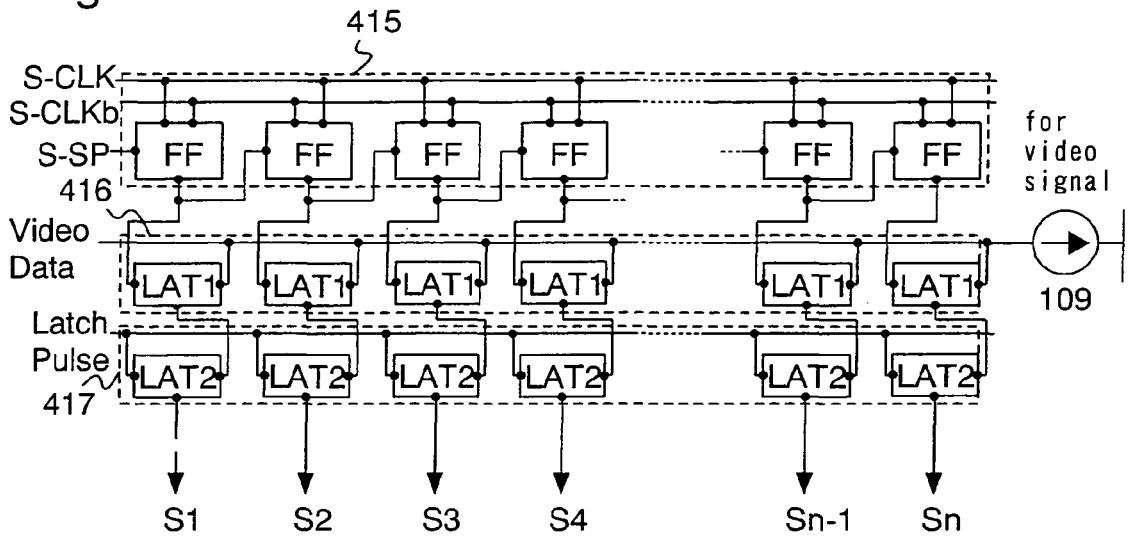
FIGS. 3A-3B are views of a signal line driving circuit (1-bit, 2-bit).

FIG. 3A shows a schematic view of the signal line driving circuit 403 in the case of performing the analog gradation display or the digital gradation display of one bit. The signal line driving circuit 403 has a shift register 415, a first latch circuit 416, and a second latch circuit 417.

For an easy description of the operation, the shift register 415 is formed by a plurality of lines of flip-flop circuits (FF) and the like, to which the clock signal (S-CLK), the start pulse (S-SP), and the clock inverse signal (S-CLKb) are supplied. According to the timing of these signals, sampling pulses are sequentially supplied therefrom.

The sampling pulses supplied from the shift register 415 are supplied to a first latch circuit 416. A video signal (digital video signals or analog video signals) is entered in the first latch circuit 416, and the video signal is kept in each line according to the timing of entering the sampling pulses.

In the first latch circuit 416, when the video signal has been kept in every line including the final line, a latch pulse is entered into a second latch circuit 417 in the horizontal retrace time, and the video signal kept in the first latch circuit 416 is all transferred to the second latch circuit 417. Then, it is found that the video signal kept in the second latch circuit 417 has been supplied at once for every one line to each pixel connected to each signal line.

While the video signal kept in the second latch circuit 417 is being supplied to the pixels, the sampling pulses are supplied from the shift register 411 again. Thereafter, the operation will be repeated, thereby performing the processing of the video signal for one frame.

The signal line driving circuit of the invention includes the first latch circuit 416 and the second latch circuit 417 having each current source circuit.

Figure 4:
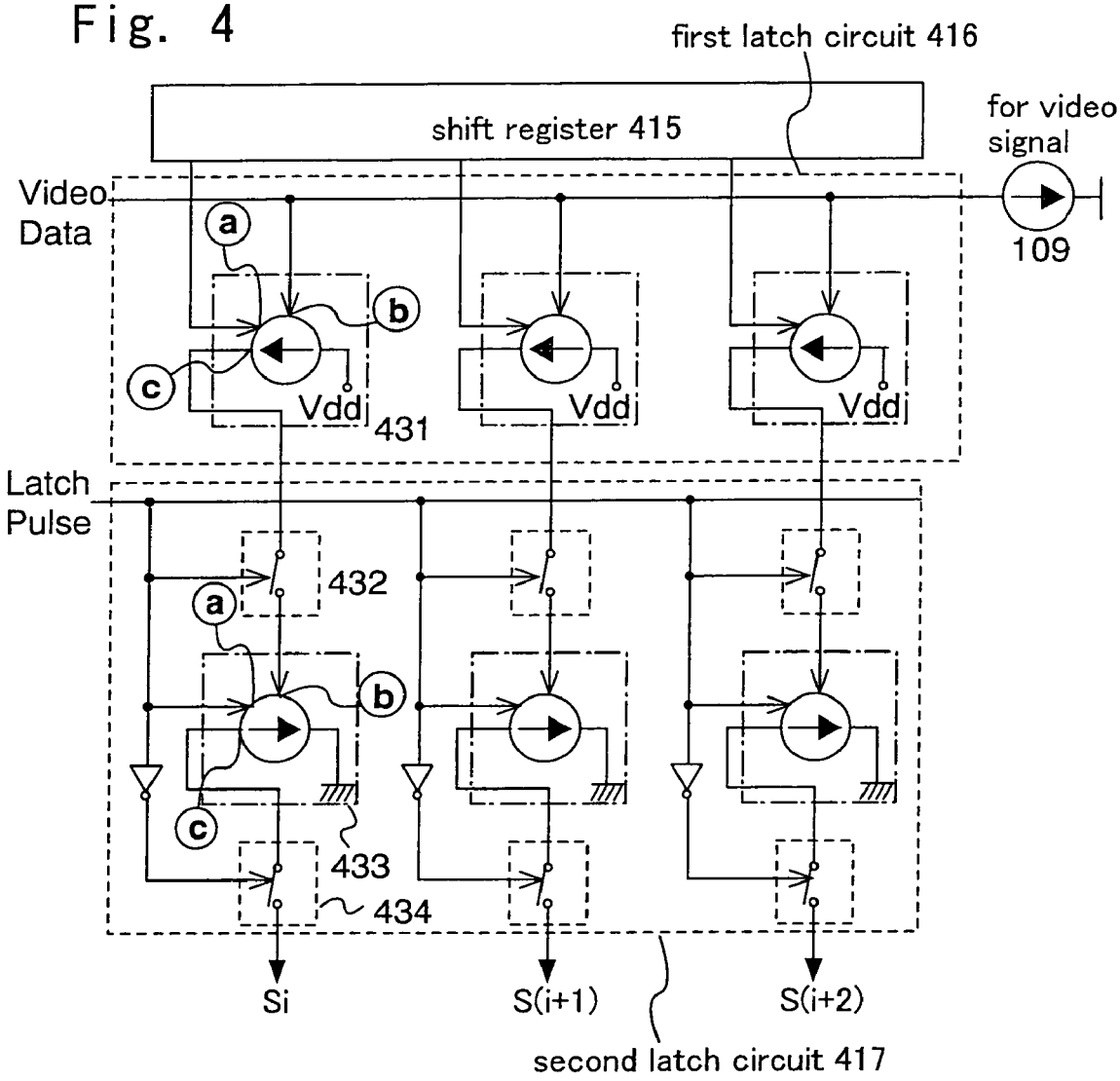
FIG. 4 is a view of a signal line driving circuit (1-bit).

The structure of the first latch circuit 416 and the second latch circuit 417 will be described by using FIG. 4, this time. FIG. 4 shows the outline of the signal line driving circuit 403 in the vicinity of the three signal lines from the i-th line to the (i+2)-th line.

The signal line driving circuit 403 includes a current source circuit 431, a switch 432, a current source circuit 433, and a switch 434 in each line. The switch 432 and the switch 434 are controlled by the latch pulse. The mutually inverted signals are entered respectively into the switch 432 and the switch 434. Therefore, the current source circuit 433 performs one of the setting operation and the input operation.

The current source circuit 431 and the current source circuit 433 are controlled by a signal entered through a terminal a. A current (signal current $I_{data}$) set by using a constant current source 109 for video signal connected to a video line (current line) through a terminal b is held in the current source circuit 431 belonging to the first latch circuit 416. The switch 432 is provided between the current source circuit 431 and the current source circuit 433, and the on/off operation of the switch 432 is controlled by the latch pulse.

A current supplied from the current source circuit 431 (the first latch circuit 416) is held in the current source circuit 433 belonging to the second latch circuit 417. The switch 434 is provided between the current source circuit 433 and the pixel connected to the signal line and the on/off operation of the switch 434 is controlled by the latch pulse.

The switch 434 provided between the current source circuit 433 and the pixel connected to the signal line can be omitted when a switch is set in the current source circuit 433. Depending on the structure of the current source circuit, there is a case in which the switch 434 is not required between the current source circuit 433 and the pixel connected to the signal line.

Similarly to the switch 434 provided between the current source circuit 433 and the pixel connected to the signal line, the switch 432 provided between the current source circuit 431 and the current source circuit 433 can be also omitted in some cases.

In the case of performing the digital gradation display of one bit, the signal current $I_{data}$ is supplied from the current source circuit 433 to the pixel when the video signal is a bright signal. On the contrary, when the video signal is a dark signal, since the current source circuit 433 doesn't have an ability of supplying a current, no current flows to the pixel. In the case of performing the analog gradation display, the signal current $I_{data}$ is supplied from the current source circuit 433 to the pixel, according to the video signal. Namely, in the current source circuit 433, the ability ($V_{GS}$) of supplying a current is controlled by the video signal and the brightness is controlled, according to the amount of the current supplied to the pixels.

In the invention, a setting signal supplied from the terminal a means the sampling pulse or the latch pulse supplied from the shift register. Namely, the setting signal in FIG. 1 corresponds to the sampling pulse or the latch pulse supplied from the shift register. In the invention, the current source circuit is set, according to the sampling pulse or the latch pulse supplied from the shift register.

The sampling pulse supplied from the shift register 415 is entered into the terminal a of the current source circuit 431 belonging to the first latch circuit 416. The latch pulse is entered into the terminal a of the current source circuit 433 belonging to the second latch circuit 417.

The circuitry of the current source circuit as shown in FIG. 6, FIG. 7, FIG. 29, FIG. 30, and FIG. 32, etc. can be freely used in the current source circuit 431 and the current source circuit 433. The respective current source circuits may adopt not only one method but also a plurality of methods.

Figure 34:
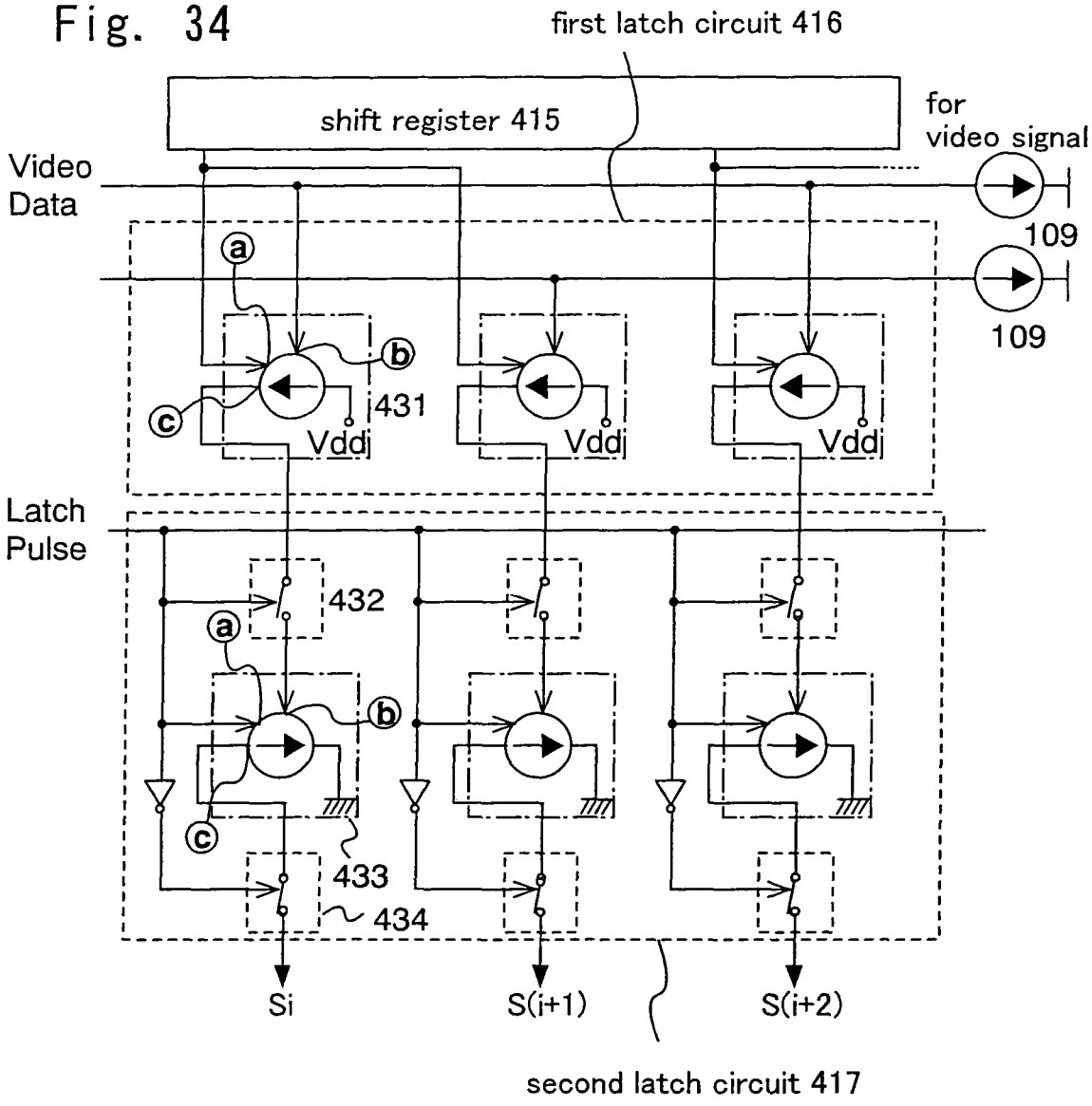
FIG. 34 is a view showing a signal line driving circuit.

Although the setting operation is performed on the first latch circuit for every one line by the constant current source 109 for video signal in FIG. 4, it is not restricted to this. As illustrated in FIG. 34, the setting operation can be performed at once in a plurality of lines and in other words, in a multiphasic way. Although two constant current sources 109 for video signal are arranged in FIG. 34, the setting operation may be performed on the two constant current sources 109 for video signal by another constant current source for video signal separately arranged.

In the below, an example of the combination of the methods for use in the current source circuit 431 and the current source circuit 433 in FIG. 4 and its merit will be described.

In the current source circuit 431 belonging to the first latch circuit 416 and the current source circuit 433 belonging to the second latch circuit 417, a description will be made in the case where one is a circuit as shown in FIG. 6A and the other is a current mirror circuit as shown in FIG. 6C.

The current source circuit of the current mirror circuit as shown in FIG. 6C has at least two transistors and the gate electrodes of the two transistors are commonly or electrically connected, as mentioned above. Of the two transistors, one of the source region and the drain region of one transistor and one of the source region and the drain region of the other transistor are respectively connected to different circuit elements. For example, in the current source circuit shown in FIG. 20, of the two transistors, one transistor (one of the source region and the drain region of it) is connected to the constant current source and the other transistor (one of the source region and the drain region of it) is connected to the pixel.

At first, a description will be made in the case where the current source circuit 431 belonging to the first latch circuit 416 is the circuit as shown in FIG. 6A and the current source circuit 433 belonging to the second latch circuit 417 is the current mirror circuit as shown in FIG. 6C. In this case, of the two transistors belonging to the current source circuit 433 that is the current mirror circuit as shown in FIG. 6C, one is connected to the current source circuit 431 belonging to the first latch circuit 416 and the other is connected to the pixel through the switch 434.

In the case of the above structure, the switch 434 is not necessarily required. This is why the current supplied from the current source circuit 431 belonging to the first latch circuit 416 never flows to the pixel and the setting operation and the input operation can be performed at once in the case where the current source circuit 433 belonging to the second latch circuit 417 is the current mirror circuit as shown in FIG. 6C.

Namely, in the case of the current mirror circuit as shown in FIG. 6C, the transistor for performing the setting operation and the transistor for performing the input operation are different. The current flowing between the source/drain of the transistor for performing the setting operation never flows into between the source/drain of the transistor for performing the input operation. Further, it is true in the other way around. Therefore, the current supplied from the current source circuit 431 belonging to the first latch circuit 416 flows into the transistor for performing the setting operation, but does not flow into the transistor for performing the input operation, and the current does not flow to the pixel. Accordingly, without setting of the switch 434, the setting operation and the input operation are not badly affected with each other, thereby causing no problem.

In the two transistors of the current mirror circuit as shown in FIG. 6C, when the W(gate width)/L(gate length) ratio of the transistor connected to the pixel is set smaller than that of the transistor connected to the current source circuit 431 belonging to the first latch circuit 416, the constant current amount supplied from the current generator 109 for video signal can be increased.

For example, assume that the amount of the current given to the pixel is P. Then, assuming that the W/L ratio of the transistor connected to the pixel is Wa and that the W/L ratio of the transistor connected to the current source circuit 431 is (2×Wa), the current of (2×P) will be supplied from the constant current source 109 for video signal. Thus, by setting the W/L ratio of the transistor at a proper value, the current supplied from the constant current source 109 for video signal can be increased, thereby performing the setting operation of the current source circuit 431 quickly and accurately.

Figure 35:
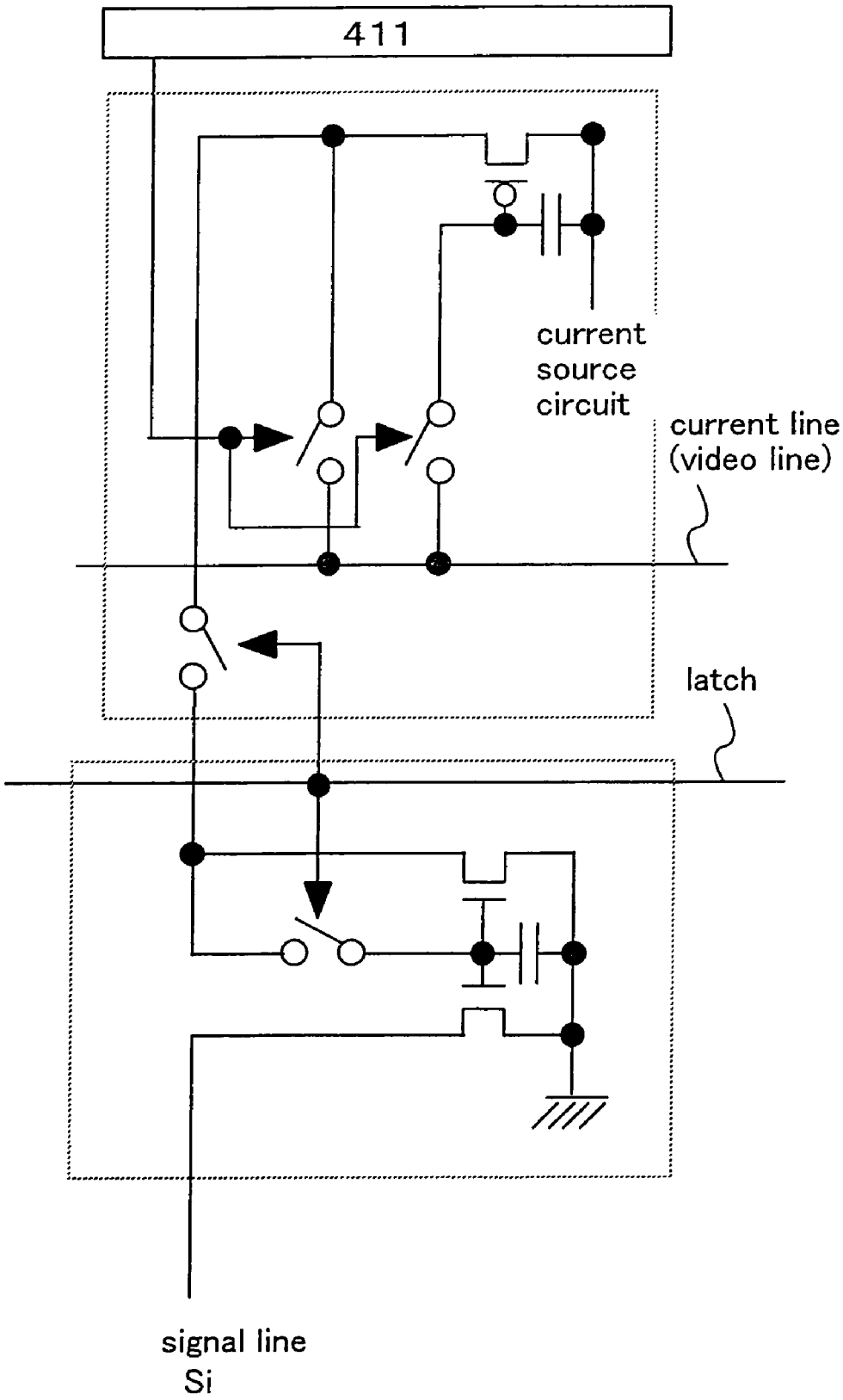
FIG. 35 is a view showing a signal line driving circuit.

The circuit diagram in this case is shown in FIG. 35.

Next, a description will be made in the case where the current source circuit 431 belonging to the first latch circuit 416 is the current mirror circuit as shown in FIG. 6C and the current source circuit 433 belonging to the second latch circuit 417 is the circuit as shown in FIG. 6A. In this case, in the two transistors of the current source circuit 431 that is the current mirror circuit as shown in FIG. 6C, one is connected to the constant current source 109 for video signal and the other is connected to the current source circuit 433 belonging to the second latch circuit 417.

In the two transistors of the current mirror circuit as shown in FIG. 6C, when the W(gate width)/L(gate length) ratio of the transistor connected to the current source circuit 433 belonging to the second latch circuit 417 is set smaller than that of the transistor connected to the constant current source 109 for video signal, the current amount supplied from the constant current source 109 for video signal can be increased.

For example, assume that the current amount given to the pixel is P. Assuming that the W/L ratio of the transistor connected to the current source circuit 433 belonging to the second latch circuit 417 is Wa and that the W/L ratio of the transistor connected to the constant current source 109 for video signal is (2×Wa), the current of (2×P) will be supplied from the constant current source 109 for video signal. Thus, by setting the W/L ratio of the transistor at a proper value, the current amount supplied form the constant current source 109 for video signal can be increased, thereby performing the setting operation of the current source circuit 431 quickly and accurately.

Figure 36:
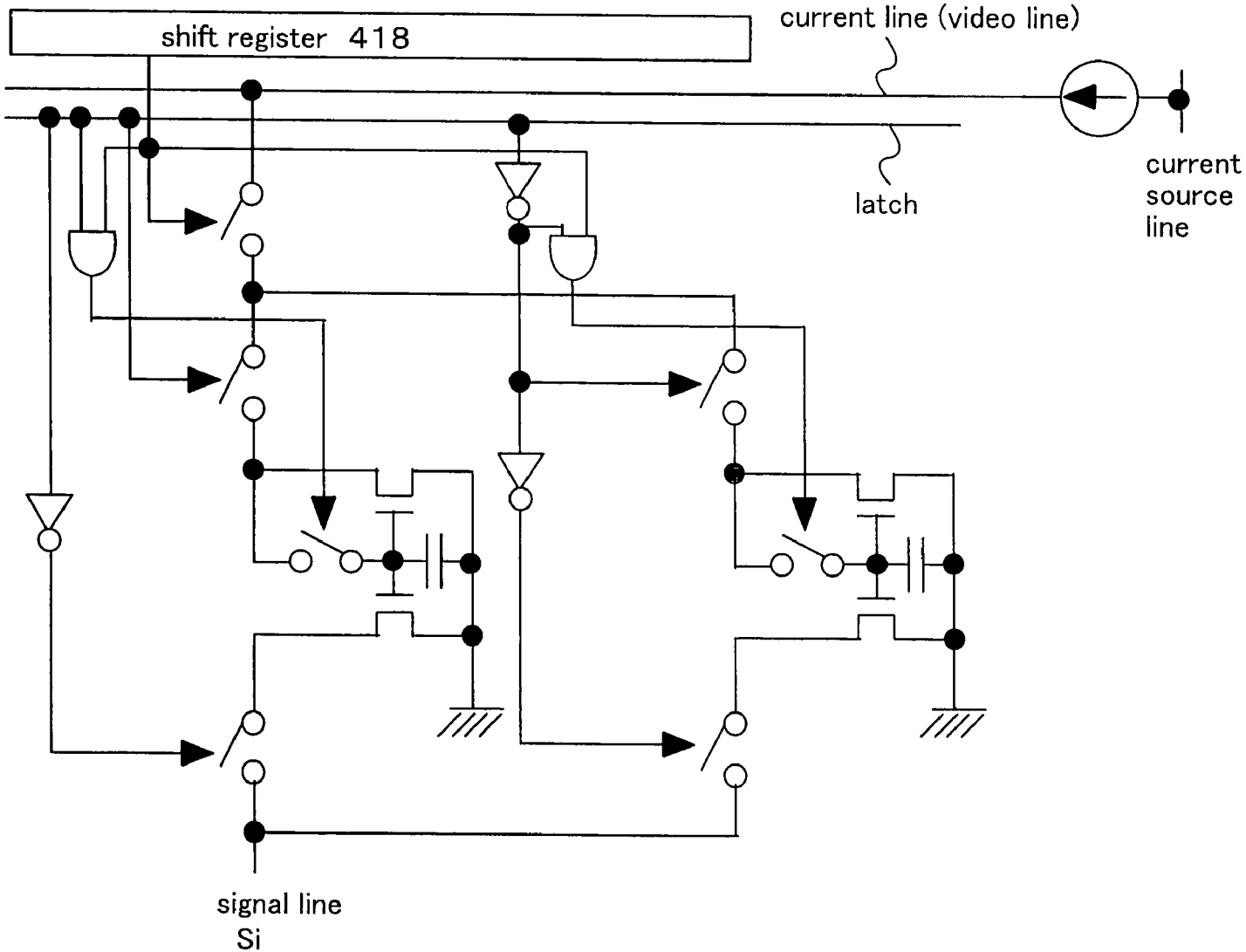
FIG. 36 is a view showing a signal line driving circuit.

The circuit diagram in this case is shown in FIG. 36.

This time, a description will be made in the case where the both of the current source circuit 431 belonging to the first latch circuit 416 and the current source circuit 432 belonging to the second latch circuit 417 are the current mirror circuits as shown in FIG. 6C.

For example, assume that the current amount given to the pixel is P. Assuming that, in the current source circuit 433 belonging to the second latch circuit 417, in the two transistors of the current mirror circuit as shown in FIG. 6C, the W/L ratio of the transistor connected to the pixel is Wa, the W/L ratio of the transistor connected to the current source circuit belonging to the first latch circuit 416 is (2×Wa). Then, the current amount becomes twice in the current source circuit 433 belonging to the second latch circuit 417.

Similarly, in the two transistors of the current mirror circuit as shown in FIG. 6C, assume that the W/L ratio of the transistor connected to the constant current source 109 for video signal is (2×Wb) and that the W/L ratio of the transistor connected to the second latch circuit 417 is Wb. Then, the current amount becomes twice in the current source circuit 431 belonging to the first latch circuit 416. Then, the current of (4×P) will be supplied from the constant current source 109 for video signal. Thus, by setting the W/L ratio of the transistor at a proper value, the current supplied from the constant current source 109 for video signal can be increased, thereby performing the setting operation of the current source circuit 431 quickly and accurately.

Figure 37:
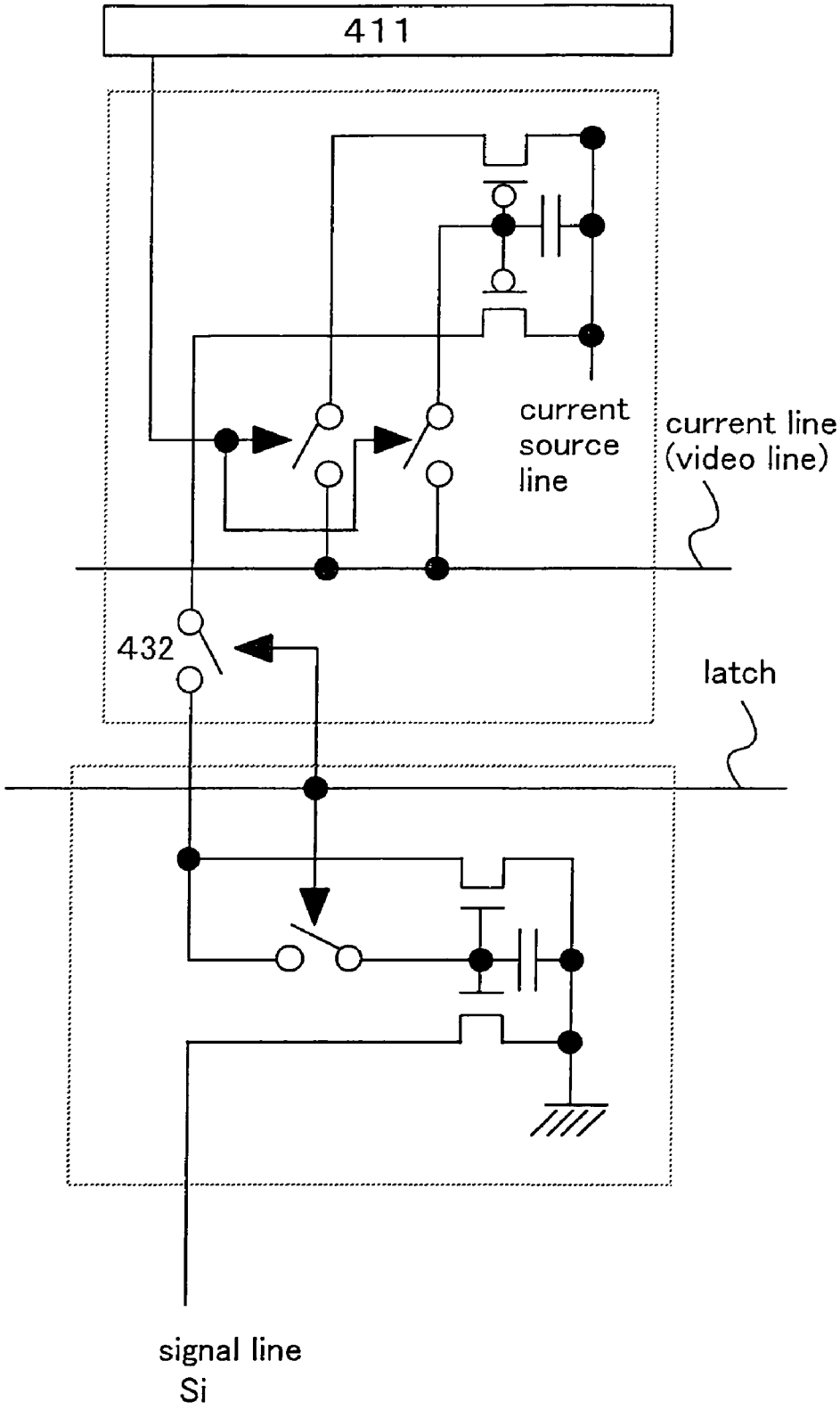
FIG. 37 is a view showing a signal line driving circuit.
Figure 38:
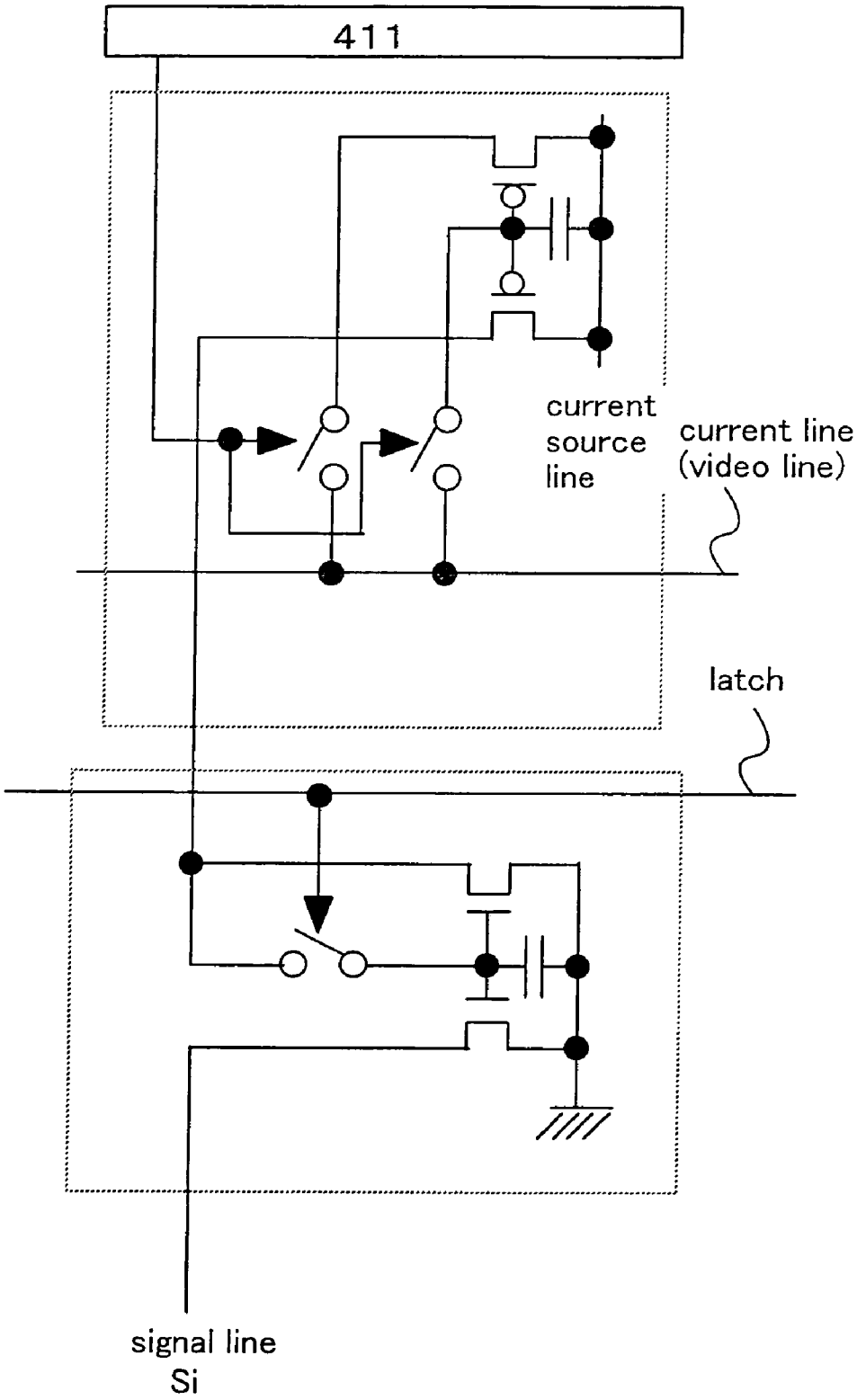
FIG. 38 is a view showing a signal line driving circuit.

The circuit diagram in this case is shown in FIG. 37. In this case, as illustrated in FIG. 38, the switch 432 does not have to be provided between the current source circuit belonging to the first latch circuit and the current source circuit belonging to the second latch circuit. In this case, however, the current continues flowing between the current source circuit belonging to the first latch circuit and the current source circuit belonging to the second latch circuit, which is not preferable.

At last, a description will be made in the case where the both of the current source circuit 431 belonging to the first latch circuit 416 and the current source circuit 433 belonging to the second latch circuit 417 are the circuits as shown in FIG. 6A. By use of the current source circuit of the type as shown in FIG. 6A, ill effect caused by the characteristic dispersion of the transistor can be further restrained. Namely, since the transistor for performing the setting operation and the transistor for performing the input operation are the same, there is no ill effect caused by the dispersion between the transistors. However, since the current amount supplied from the constant current source 109 for video signal cannot be increased, the setting operation cannot be performed quickly.

Figure 39:
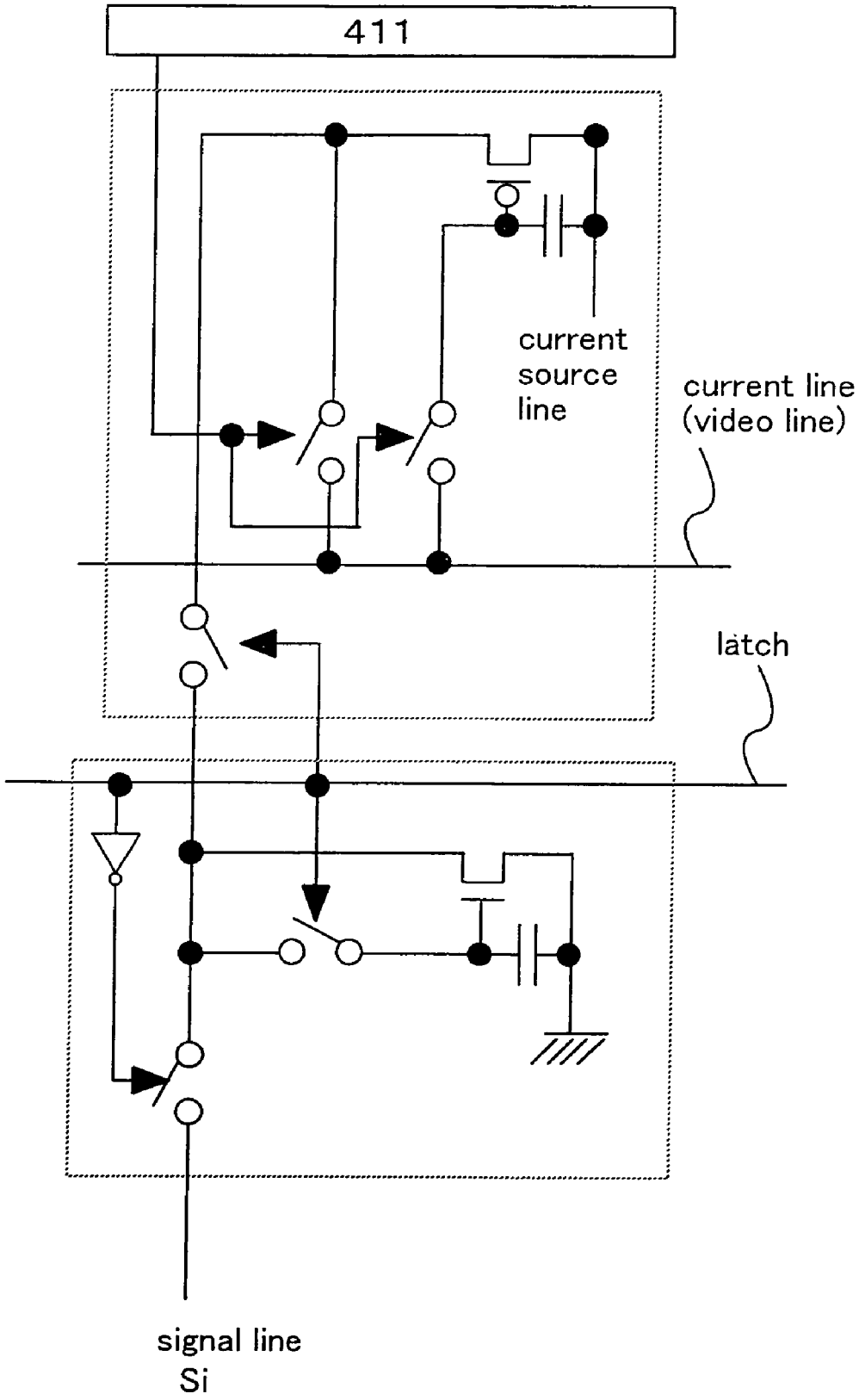
FIG. 39 is a view showing a signal line driving circuit.

The circuit diagram in this case is shown in FIG. 39.

In the current source circuit belonging to the first latch circuit 416, the current source circuits of only one structure are not used but a combination of the current source circuits of various structures may be also used, such as using the circuit as shown in FIG. 6A or the current mirror circuit as shown in FIG. 6C. Similarly, the current source circuits of various structures may be mixed, also in those belonging to the second latch circuit 417.

Figure 40:
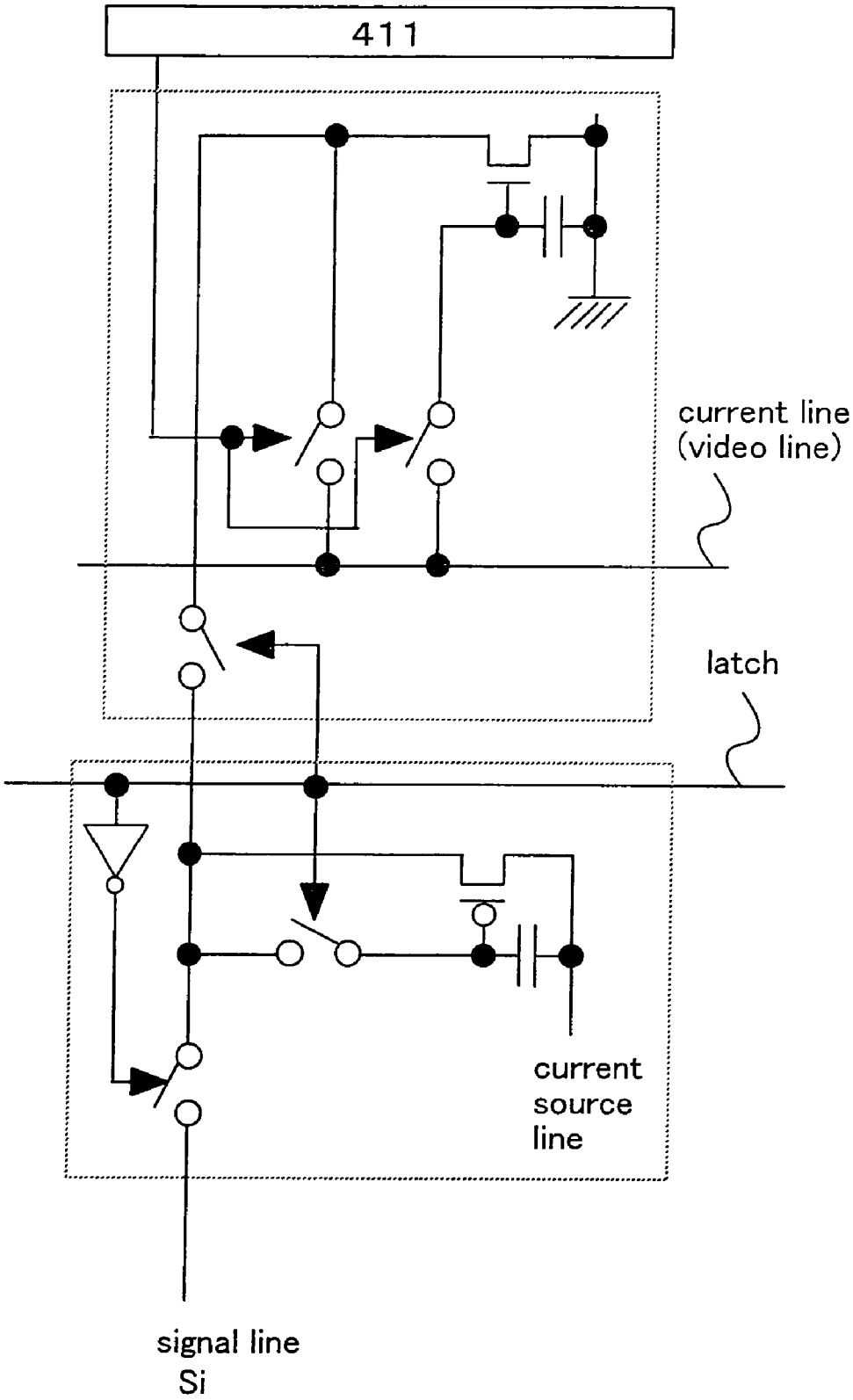
FIG. 40 is a view showing a signal line driving circuit.

In the structure of FIG. 39, the current flows from the pixel through the signal line toward the current source circuit. The direction of the current, however, varies depending on the structure of the pixel. Then, the circuit diagram in the case where the current flows from the current source circuit to the pixel is shown in FIG. 40.

The above may be summarized as follows: by adopting the current mirror circuit as shown in FIG. 6C as the current source circuits (the current source circuit 431 and the current source circuit 433) and further setting the W/L ratio at a proper value, the current supplied from the constant current source 109 for video signal can be increased. As a result, the setting operation of the current source circuits (the current source circuit 431 and the current source circuit 433) can be performed accurately.

In the current mirror circuit as shown in FIG. 6C, however, there are at least two transistors having the gate electrodes in common, and if the characteristics of the two transistors are dispersed, the currents supplied therefrom are dispersed. However, by setting the W/L ratio of the channel width W and the channel length L in the two transistors, at a different value, the current amount can be changed. Generally, the current is increased at the setting operation time. As a result, the setting operation can be performed quickly.

The current at the setting operation time corresponds to the current supplied from the constant current source 109 for video signal in the case of the current source circuit of the first latch circuit, and it corresponds to the current supplied form the current source of the first latch circuit in the case of the current source circuit of the second latch circuit.

On the other hand, in the case of using the circuit as shown in FIG. 6A, the current flowing at the setting operation time is substantially equal to the current flowing at the input operation time. Therefore, the current for performing the setting operation cannot be increased. However, the transistor of supplying the current at the setting operation time and the transistor of supplying the current at the input operation time are the same. Accordingly, there is no ill effect caused by the dispersion between the transistors. Therefore, it is preferable to use the current source circuits in a proper combination, for example, using the current mirror circuit as shown in FIG. 6C in the portion where a large amount of the current is desired at the setting operation time and using the circuit as shown in FIG. 6A in the portion where the more accurate output of the current is desired.

In the current mirror circuit as shown in FIG. 6C, there are at least two transistors having the gate electrodes in common, and if the characteristics of the two transistors are dispersed, the current supplied therefrom are dispersed. However, if the characteristics of the two transistors are uniform, the currents supplied therefrom will not be dispersed. Conversely, in order not to disperse the output currents, it is necessary to make the characteristics of the two transistors uniform. Namely, it is necessary to make the characteristics uniform between the two transistors having the gate electrodes in common, in the current mirror circuit as shown in FIG. 6C. It is not necessary to make the characteristics uniform between the transistors having no common gate electrode. This is because the setting operation is performed on the respective current source circuits. Namely, the transistor that becomes the object of the setting operation and the transistor used at the input operation time need to have the same characteristics. When the characteristics are not uniform between the transistors having no common gate electrode, since the respective current source circuits are set according to the setting operation, the characteristic dispersion can be corrected.

Generally, in the current mirror circuit as shown in FIG. 6C, since the two transistors having the gate electrodes in common can restrain the dispersion of the characteristics thereof, they are positioned adjacently.

Here, in a transistor operated as a simple switch, any polarity (conductivity type) will do.

Figure 45:
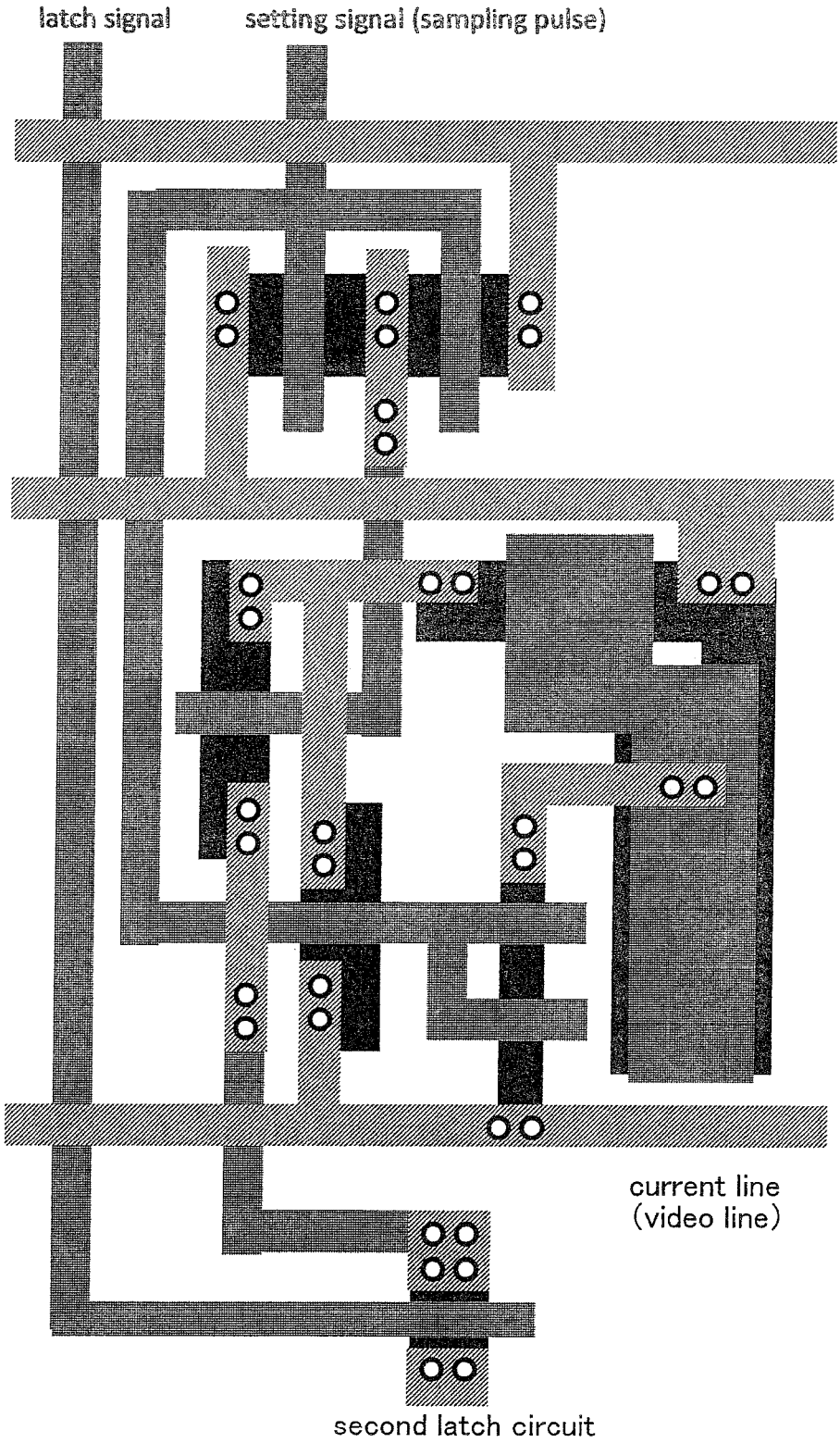
FIG. 45 is a layout view of a current source circuit.
Figure 46:
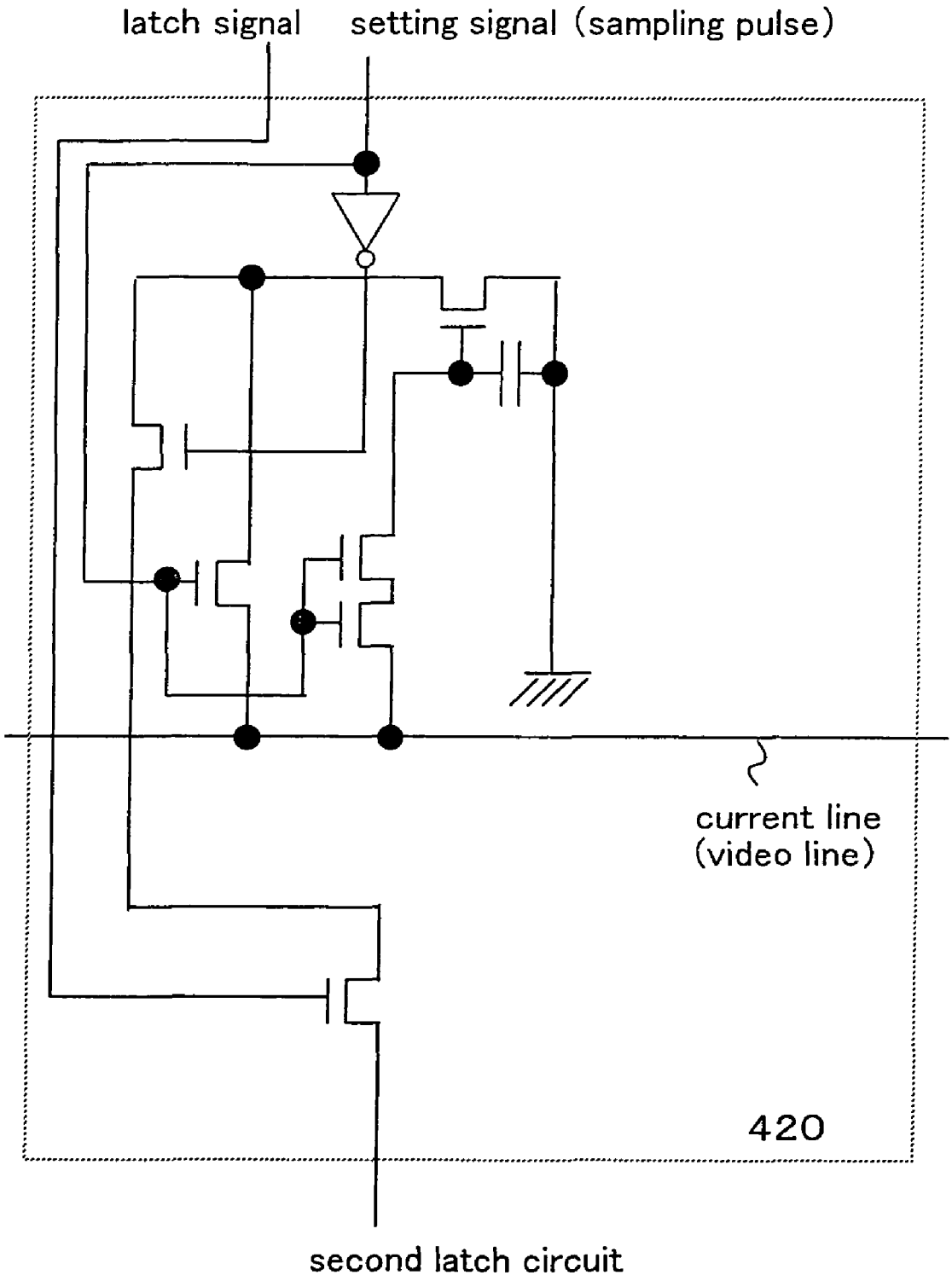
FIG. 46 is a circuit diagram of a current source circuit.

Further, in the signal line driving circuit of the invention, the layout view about the current source circuit disposed in the first latch is shown in FIG. 45 and the corresponding circuit view is shown in FIG. 46.

This embodiment form can be freely combined with any of the embodiment forms 1 and 2.

Embodiment Form 4

The detailed structure and its operation of the signal line driving circuit 403 as shown in FIG. 15A will be described in this embodiment form, and the signal line driving circuit 403 for use in the case of performing the digital gradation display of two bits will be described in this embodiment form.

Figure 3B:
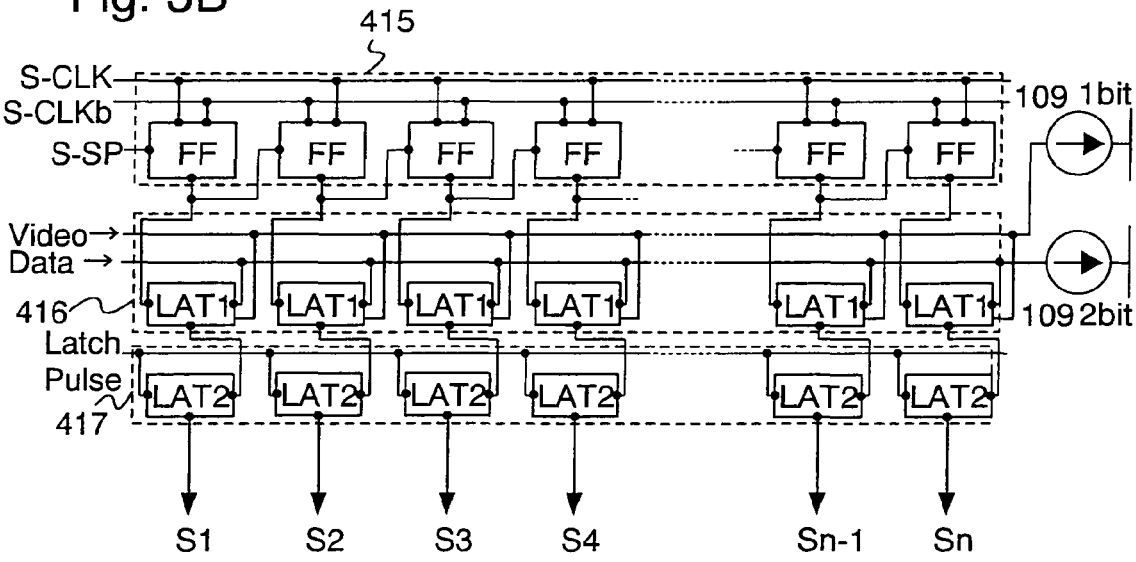

FIG. 3B shows the schematic view of the signal line driving circuit 403 in the case of performing the digital gradation display of two bits. The signal line driving circuit 403 has the shift register 415, the first latch circuit 416, and the second latch circuit 417.

In brief description of the operation, the shift register 415 is formed by a plurality of lines of the flip-flop circuits (FF) and the like, where the clock signal (S-CLK), the start pulse (S-SP), and the clock inverse signal (S-CLKb) are entered. According to the timing of these signals, the sampling pulses are sequentially supplied therefrom.

The sampling pulses supplied from the shift register 415 are entered to the first latch circuit 416. In the first latch circuit 416, a video signal (Digital Data 1, Digital Data 2) is being entered and according to the timing of entering the sampling pulses, the video signal is kept in each line.

When the video signal has been kept in every line including the final line in the first latch circuit 416, the latch pulse is entered into the second latch circuit 417 in the horizontal retrace time, and the video signal held in the first latch circuit 416 is all transferred to the second latch circuit 417. Then, it is found that one line of the video signal kept in the second latch circuit 417 has been supplied at once to the pixel connected to the signal line.

While the video signal kept in the second latch circuit 417 is being supplied to the pixels, the sampling pulses are again supplied from the shift register 411. Thereafter, the operation will be repeated, thereby performing the processing of the video signal for one frame.

The digital video signal of one bit is entered from a current line connected to the constant current source 109 for video signal of one bit. The digital video signal of two bits is entered from a current line connected to the constant current source 109 for video signal of two bits. The signal currents (corresponding to the video signal) set by the constant current sources 109 for one-bit video signal and two-bit video signal are held in the current source circuits.

The structure of the first latch circuit 415 and the second latch circuit 416 will be described by using FIGS. 5, 26 and 27.

At first, the structure of the first latch circuit 415 and the second latch circuit 416 shown in FIG. 5 will be described. FIG. 5 shows the outline of the signal line driving circuit 403 in the vicinity of the three signal lines from the i-th line to the (i+2)-th line.

Figure 5:
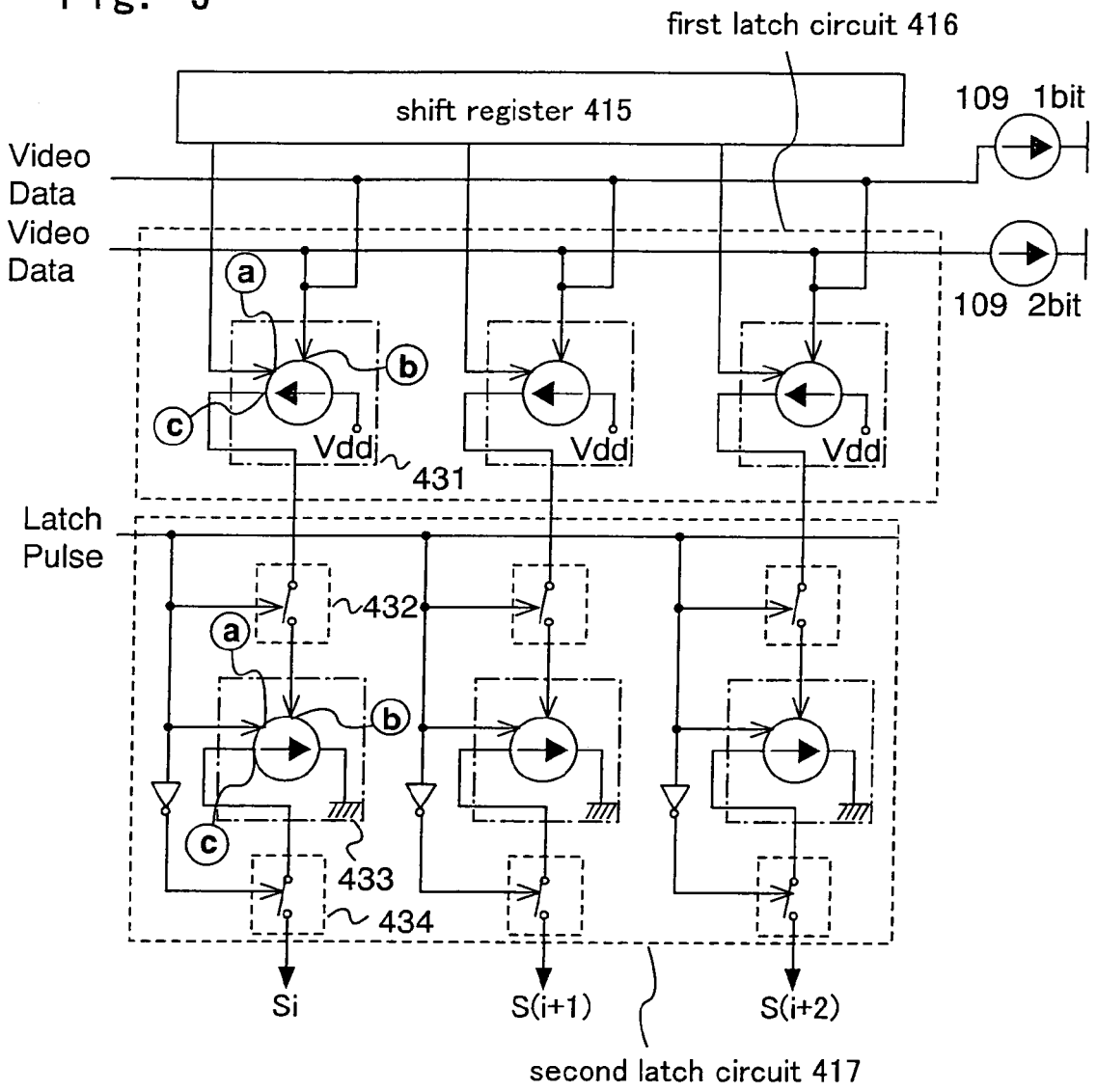
FIG. 5 is a view of a signal line driving circuit (2-bit).

In the signal line driving circuit 403 shown in FIG. 5, the constant current source 109 for one-bit video signal and the constant current source 109 for two-bit video signal are connected to the current source circuit 431 belonging to the first latch circuit 416.

Accordingly, the current of the total sum of the current of the one-bit video signal and the current of the two-bit video signal flows in the current source circuit 431 belonging to the first latch circuit 416.

Next, the structure of the first latch circuit 416 and the second latch circuit 417 shown in FIG. 26 will be described. FIG. 26 shows the outline of the signal line driving circuit 403 in the vicinity of the three signal lines from the i-th line to the (i+2)-th line.

The signal line driving circuit 403 includes the current source circuit 431*a* and the switch 432*a*, the current source circuit 433*a* and the switch 434*a*, the current source circuit 431*b* and the switch 432*b*, and the current source circuit 433*b* and the switch 434*b* in each line. The switches 432*a*, 434*a*, 432*b*, and 434*b* are controlled according to the latch pulse.

Mutually inverted signals are respectively entered to the switches 432*a* and 432*b* and the switches 434*a* and 434*b*. Therefore, one of the setting operation and the input operation is performed on the current source circuit 433.

When the current source circuit 433 is the current mirror circuit as shown in FIG. 6C and the setting operation and the input operation can be performed at once, and when a switch is arranged in the current source circuit 433, the switch 434 provided between the current source circuit 433 and the pixel connected to the signal line can be omitted. Or, the switch 434 provided between the current source circuit 433 and the pixel connected to the signal line is not necessary. Similarly to the switch 434 provided between the current source circuit 433 and the pixel connected to the signal line, the switch 432 provided between the current source circuit 431 and the current source circuit 433 also can be omitted.

Each of the current source circuits 431*a*, 433*a*, 431*b*, and 433*b* has the terminal a, the terminal b, and the terminal c. Each of the current source circuits 431*a*, 433*a*, 431*b*, and 433*b* are controlled by a signal supplied through the terminal a. The current (signal current $I_{data}$) set by using the constant current source 109 for video signal connected to the video line (current line) through the terminal b is held in the current source circuit 431*a* and the current source circuit 431*b*. The current (signal current $I_{data}$) supplied from the current source circuit 431*a* and the current source circuit 431*b* belonging to the first latch circuit 416 through the terminal b is held in the current source circuit 433*a* and the current source circuit 433*b*. The current set in the constant current source 109 for one bit is held in the current source circuit 431*a* and the current source circuit 433*a*. The current set in the current generator 109 for two bits is held in the current source circuit 431*b* or the current source circuit 433*b*. The respective switches 434*a* and 434*b* are provided between the pixels and the respective current source circuits 433*a* and 433*b*, and the on/off operation of the switches 434*a* and 434*b* is controlled by the latch pulse.

Accordingly, the total sum of the current of the one-bit video signal flowing from the current source circuit 433*a* and the current of the two-bit video signal flowing from the current source circuit 433*b*, flows into the pixel. In other words, the currents of the respective-bit video signals are added in a portion where the current flows from the current source circuit 433*a* and the current source circuit 433*b* toward the pixel, and the D/A conversion is performed. Accordingly, when the current is supplied from the current source circuit to the pixel, the current amount has to be the current value corresponding to the respective bits.

Next, the structure of the first latch circuit 416 and the second latch circuit 417 shown in FIG. 27 will be described. FIG. 27 shows the outline of the signal line driving circuit 403 in the vicinity of the three signal lines from the i-th line to the (i+2)-th line.

Figure 26:
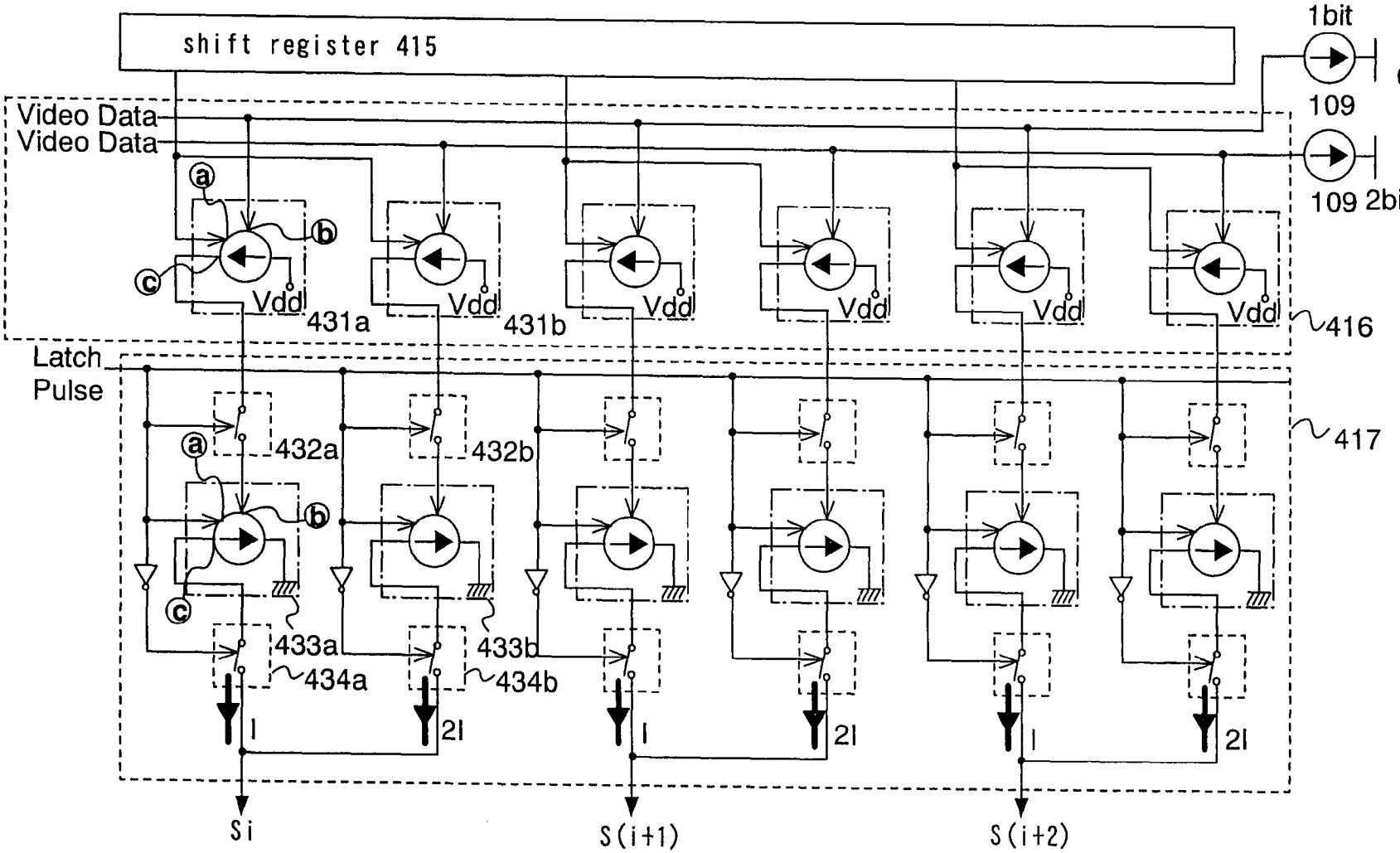
FIG. 26 is a circuit diagram of a constant current source for video signal.
Figure 27:
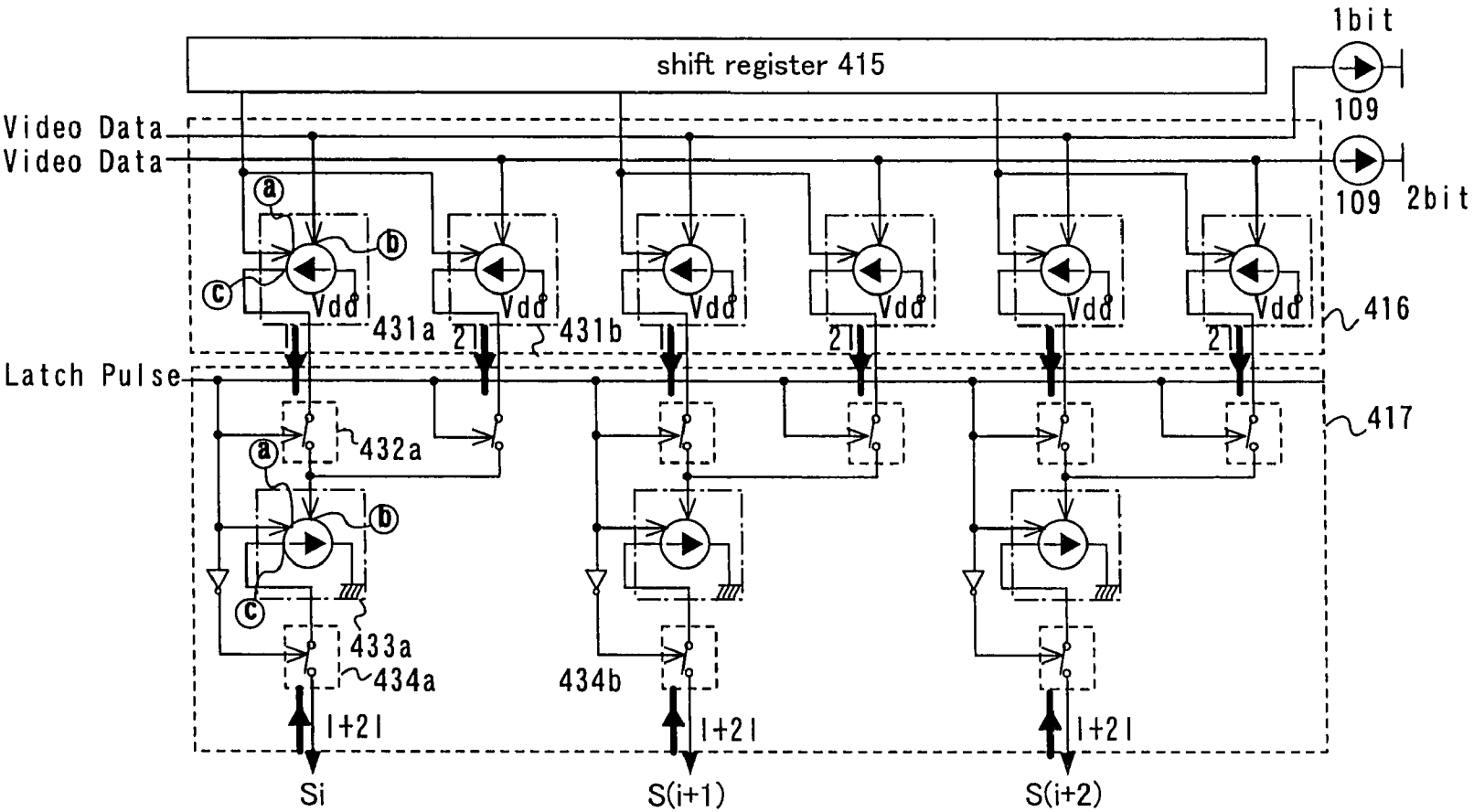
FIG. 27 is a circuit diagram of a constant current source for video signal.

The signal line driving circuit 403 shown in FIG. 27 is the same as the signal line driving circuit 403 shown in FIG. 26, except that the current source circuit 433*b* and the switch 434*b* are removed and that the current held in the current source circuit 431*b* is supplied not to the current source circuit 433*b* but to the current source circuit 433*a*, and the description thereof is omitted. Since the signal line driving circuit 403 shown in FIG. 27 can lessen the number of the circuit elements compared with the signal line driving circuit 403 shown in FIG. 26, the occupied area of the signal line driving circuit 403 can be reduced.

In FIG. 27, the total sum of the current of the one-bit video signal flowing from the current source circuit 431*a* and the current of the two-bit video signal flowing from the current source circuit 431*b*, comes to flow in the current source circuit 433*a*. In other words, the currents of the respective-bit video signals are added in a portion where the current flows from the current source circuit 431*a* and the current source circuit 431*b* toward the current source circuit 433*a*, and the D/A conversion is performed. Accordingly, when the current is supplied from the pixel to the current source circuit, the current amount has to be the current value corresponding to the respective bits.

In the signal line driving circuit 403 shown in FIGS. 5, 26, and 27, when the digital video signal is a bright signal, the signal current is supplied from the respective current source circuits to the pixel. On the contrary, when the video signal is a dark signal, the latch pulse between the respective current source circuits and the pixel is controlled, so as not to supply the current to the pixel. Namely, in the respective current source circuits 433*a* and 433*b*, the ability of running a constant current ($V_{GS}$) is controlled by the video signal and brightness is controlled by using the amount of the current to be supplied to the pixel.

Further, the sampling pulse supplied from the shift register 415 is entered into the terminal a of the current source circuit belonging to the first latch circuit 416. Then, the latch pulse is entered into the terminal a of the current source circuit belonging to the second latch circuit 417.

In the embodiment form, since the two-bit digital gradation display is performed, four current source circuits 431*a*, 433*a*, 431*b*, and 433*b* are provided in every one signal line (the current source circuit 433*b* is not provided in the structure of FIG. 27). Assuming that the respective signal currents $I_{data}$ flowing respectively between the current source circuit 431*a* and the current source circuit 433*a* and between the current source circuit 431*b* and the current source circuit 433*b* are set at 1:2, the current amount can be controlled in $2^2=4$ steps.

The respective current source circuits 431*a*, 433*a*, 431*b*, and 433*b* can be formed freely by using the circuit structures of the current source circuits shown in FIG. 6, FIG. 7, FIG. 29, FIG. 30, FIG. 32, and the like. All the current source circuits 420 can adopt not only one method but also they may adopt a plurality of methods.

Hereafter, an example of the combination of the methods used in the current source circuits (the current source circuits 431*a*, 431*b*, 433*a*, and 433*b*) in FIG. 26 and its merit will be described. Then, an example of the combination of the methods used in the current source circuits (the current source circuits 431*a*, 431*b*, and 433*a*) in FIG. 27 and its merit will be described.

In FIG. 26, as the example of the combination of the methods used in the current source circuits (the current source circuits 431*a*, 431*b*, 433*a*, and 433*b*), in the current source circuit (the current source circuits 431*a* and 431*b*) belonging to the first latch circuit 416 and the current source circuits (the current source circuits 433*a* and 433*b*) belonging to the second latch circuit 417, the case where one is the circuit as shown in FIG. 6A and the other is the current mirror circuit shown in FIG. 6C will be described.

The current source circuit of the current mirror circuit as shown in FIG. 6C has at least two transistors and the gate electrodes of the two transistors are common or electrically connected as mentioned above. Of the two transistors, one of the source region and the drain region of one transistor and one of the source region and the drain region of the other transistor are respectively connected to different circuit elements. For example, in the current source circuit shown in FIG. 20, of the two transistors, one transistor (one of the source region and the drain region of it) is connected to the constant current source and the other transistor (one of the source region and the drain region of it) is connected to the pixel.

At first, a description will be made in the case where in FIG. 26, the current source circuits (the current source circuits 431*a* and 431*b*) belonging to the first latch circuit 416 are the circuits as shown in FIG. 6A and the current source circuits (the current source circuits 433*a* and 433*b*) belonging to the second latch circuit 417 are the current mirror circuits as shown in FIG. 6C. In this case, of the two transistors belonging to the respective current source circuits (the current source circuits 433*a* and 433*b*) that are the current mirror circuits as shown FIG. 6C, one is respectively connected to the current source circuits 431*a* and 431*b* belonging to the first latch circuit 416 and the other is respectively connected to the pixel through the switches 434*a* and 434*b*.

In the two transistors of the current mirror circuit as shown in FIG. 6C, when the W(gate width)/L(gate length) ratio of the transistor connected to the pixel is set smaller than that of the transistor connected to each current source circuit (the current source circuits 431*a* and 431*b*) belonging to the first latch circuit 416, the current amount supplied from the constant current source 109 for video signal can be made greater.

For example, assume that the amount of the current given to the pixel is P. Then, assuming that the W/L ratio of the transistor connected to the pixel is Wa and that the W/L ratio of the transistor connected to each current source circuit (the current source circuits 431*a* and 431*b*) is (2×Wa), the current of (2×P) will be supplied from the constant current source 109 for video signal. Thus, the current supplied from the constant current source 109 for video signal can be increased, thereby performing the setting operation of each current source circuit (the current source circuits 431*a* and 431*b*) quickly and accurately.

When the current source circuits (the current source circuits 433*a* and 433*b*) belonging to the second latch circuit 417 are the current mirror circuits as shown in FIG. 6C, the W(gate width)/L(gate length) ratio of each transistor may be changed depending on each bit. As a result, the current flowing from the constant current source 109 for video signal of the lower bit and the current flowing from the first latch circuit to the second latch circuit can be increased. Namely, the current flowing at the setting operation time can be increased. When the current source circuits (the current source circuits 433*a* and 433*b*) belonging to the second latch circuit 417 are the current mirror circuits as shown in FIG. 6C, the magnification of a current varies in the above current mirror currents. More specifically, at a time of supplying the current from the second latch circuit, the current amount becomes smaller. Namely, the current is decreased at an input operation time and the current flowing to the pixel becomes smaller. Therefore, in the case of supplying the current from the first latch circuit to the second latch circuit and performing the setting operation on the current source circuits of the second latch circuit, the current flowing to the current source circuits of the second latch circuit does not become smaller but it is large, and therefore, the setting operation can be performed quickly.

Next, a description will be made in the case where the current source circuits (the current source circuits 431*a* and 431*b*) belonging to the first latch circuit 416 are the current mirror circuit as shown in FIG. 6C and the current source circuits (the current source circuits 433*a* and 433*b*) belonging to the second latch circuit 417 are the circuits as shown in FIG. 6A. In this case, of the two transistors of each current source circuit (the current source circuits 433*a* and 433*b*) that is the current mirror circuit as shown in FIG. 6C, one is connected to the constant current source 109 for video signal (for one bit and two bits) and the other is connected to each current source circuit (the current source circuits 433*a* and 433*b*) belonging to the second latch circuit 417.

In the two transistors of the current mirror circuit as shown in FIG. 6C, when the W(gate width)/L(gate length) ratio of the transistor connected to each current source circuit (the current source circuits 433*a* and 433*b*) belonging to the second latch circuit 417 is set smaller than that of the transistor connected to the constant current source 109 for video signal, the current amount supplied from the constant current source 109 for video signal can be increased.

For example, assume that the amount of the current given to the pixel is P. Then, assuming that the W/L ratio of the transistor connected to each current source circuit (the current source circuits 433*a* and 433*b*) belonging to the second latch circuit 417 is Wa and that the W/L ratio of the transistor connected to the constant current source 109 for video signal is (2×Wa), the current of (2×P) will be supplied from the constant current source 109 for video signal. Thus, the current supplied from the constant current source 109 for video signal can be increased, thereby performing the setting operation of the current source circuits (the current source circuits 431*a* and 431*b*) quickly and accurately.

When the current source circuits (the current source circuits 431*a* and 431*b*) belonging to the first latch circuit 416 are the current mirror circuits as shown in FIG. 6C, the W(gate width)/L(gate length) ratio of each transistor may be changed depending on each bit. As a result, the current flowing from the constant current source 109 for video signal of the lower bit can be much more increased.

Namely, the W/L ratio of the transistor connected to the constant current source 109 for video signal is set larger than the W/L ratio of the transistor connected to the second latch circuit. In a short, the W/L ratio of the transistor of performing the setting operation is set larger than the W/L ratio of the transistor of performing the input operation. Then, the current for performing the setting operation, in other words, the current flowing from the constant current source 109 for video signal can be much more increased.

Then, a description will be made in the case where the both of the current source circuits (the current source circuits 431*a* and 431*b*) belonging to the first latch circuit 416 and the current source circuits (the current source circuits 433*a* and 433*b*) belonging to the second latch circuit 417 are the current mirror circuits as shown in FIG. 6C.

For example, assume that the current amount given to the pixel is P. Assuming that, in each current source circuit (the current source circuits 433*a* and 433*b*) belonging to the second latch circuit 417, of the two transistors of each current mirror circuit as shown in FIG. 6C, the W/L ratio of the transistor connected to the pixel is Wa and the W/L ratio of the transistor connected to each current source circuit belonging to the first latch circuit 416 is (2×Wa). Then, the current amount becomes twice in the second latch circuit 417.

Similarly, assuming that the W/L ratio of the transistor connected to the constant current source 109 for video signal is (2×Wb), the W/L ratio of the transistor connected to the second latch circuit 417 becomes Wb. Then, the current amount becomes twice in the first latch circuit 416. Then, the current of (4×P) will be supplied from the constant current source 109 for video signal (for one bit and two bits). Thus, the current supplied from the constant current source 109 for video signal can be increased, thereby performing the setting operation of the current source circuit quickly and accurately.

When the current source circuit is the current mirror circuit as shown in FIG. 6C, the W(gate width)/L(gate length) ratio of each transistor may be changed depending on each bit. As a result, the current flowing from the constant current source 109 for video signal of the lower bit can be much more increased.

Namely, the W/L ratio of the transistor of performing the setting operation is made larger than the W/L ratio of the transistor of performing the input operation. Then, the current for performing the setting operation, in other words, the current flowing from the constant current source 109 for video signal can be much more increased.

When the current source circuit of the first latch circuit is the current mirror circuit as shown in FIG. 6C, the W/L ratio of the transistor connected to the constant current source 109 for video signal is set larger than the W/L ratio of the transistor connected to the second latch circuit. When the current source circuit of the second latch circuit is the current mirror circuit as shown in FIG. 6C, the W/L ratio of the transistor connected to the first latch circuit is set larger than the W/L ratio of the transistor connected to the pixel or the signal line.

At last, a description will be made in the case where the both of the current source circuits (the current source circuits 431*a* and 431*b*) belonging to the first latch circuit 416 and the current source circuits (the current source circuits 433*a* and 433*b*) belonging to the second latch circuit 417 are the circuits as shown in FIG. 6A. In the case of using the circuit as shown in FIG. 6A for the both, since the number of the transistors arranged in the current source circuit can be decreased, ill effect caused by the characteristic dispersion in the transistors can be restrained. Namely, since the transistor for performing the setting operation and the transistor for performing the input operation are the same, there is no ill effect caused by the dispersion between the transistors.

In the current source circuits belonging to the first latch circuit 416, the type of the circuit as shown in FIG. 6A may be used or the type of the current mirror circuit as shown in FIG. 6C may be used, in a mixed way. Similarly, also in the current source circuits belonging to the second latch circuit 417, the above types may be used in a mixed way.

Especially, in the current source circuit for lower bit where the current flowing from the constant current source 109 for video signal becomes smaller, it is effective to increase the current value by using the current mirror circuit as shown in FIG. 6C.

Namely, since in the current source circuit for lower bit, the current value flowing from the same current source circuit is small, the setting operation takes a long time. Then, if the current value is increased by using the current mirror circuit as shown in FIG. 6C, the time taken for the setting operation can be shortened.

In the current mirror circuit as shown in FIG. 6C, there are at least two transistors having the gate electrodes in common or electrically connected, and if the characteristics of the two transistors are dispersed, the currents supplied therefrom are dispersed. In the case of the current source circuit for lower bit, however, the current value supplied to the pixel or the signal line is small. Therefore, even if the characteristics of the two transistors are dispersed, its influence is a little. Owing to this, in the current source circuit for lower bit, it is effective to use the current mirror circuit as shown in FIG. 6C.

In summary, by adopting the current mirror circuit as shown in FIG. 6C and further setting the W/L ratio at a proper value, the current supplied from the constant current source 109 for video signal can be increased. As a result, the setting operation of the current source circuit can be performed accurately.

In the current mirror circuit as shown in FIG. 6C, there are at least two transistors having the gate electrodes in common, and if the characteristics of the two transistors are dispersed, the currents supplied therefrom are dispersed. By setting each W/L ratio of the channel width W and the channel length L of the two transistors at each different value, the current amount can be changed. Generally, the current at the setting operation time is made larger. As a result, the setting operation can be performed quickly.

The current at the setting operation time corresponds to the current supplied from the constant current source 109 for video signal in the case of the current source circuit of the first latch circuit, and it corresponds to the current supplied from the current source of the first latch circuit in the case of the current source circuit of the second latch circuit.

On the other hand, in the case of using the circuit as shown in FIG. 6A, the current flowing at the setting operation time is substantially equal to the current flowing at the input operation time. Therefore, the current for performing the setting operation cannot be increased. However, the transistor for supplying the current at the setting operation time is the same as the transistor for supplying the current at the input operation time.

Accordingly, there is no influence of dispersion among the transistors. Therefore, it is preferable to use the circuits in a proper combination, in the respective latch circuits, or in the respective bit-circuits, such as to use the current mirror circuit as shown in FIG. 6C in the portion where a larger current at the setting operation time is desired, and use the circuit as shown in FIG. 6A in the portion where the more accurate current is desired.

An example of the combination of the methods for use in the current source circuits (current source circuits 431*a*, 431*b*, and 433*a*) in FIG. 27 and its merit will be described.

In FIG. 27, a description will be made in the case where the current source circuits (the current source circuits 431*a* and 431*b*) belonging to the first latch circuit 416 are the current mirror circuits as shown in FIG. 6C and the current source circuit (the current source circuit 433*a*) belonging to the second latch circuit 417 is the circuit as shown in FIG. 6A. In this case, in the two transistors of each current source circuit (the current source circuits 433*a* and 433*b*) that is the current mirror circuit as shown in FIG. 6C, one is connected to the constant current source 109 for video signal (for one bit and two bits) and the other is connected to the current source circuit (the current source circuit 433*a*) belonging to the second latch circuit 417.

When the W(gate width)/L(gate length) ratio of the transistor connected to the current source circuit (the current source circuit 433*a*) belonging to the second latch circuit 417 is set smaller than that of the transistor connected to the constant current source 109 for video signal, the current amount supplied from the constant current source 109 for video signal can be increased.

For example, assume that the current amount given to the pixel is P. Assuming that the W/L ratio of the transistor connected to the current source circuit (the current source circuit 433*a*) belonging to the second latch circuit 417 is Wa and that the W/L ratio of the transistor connected to the constant current source 109 for video signal is (2×Wa), the current of (2×P) will be supplied from the constant current source 109 for video signal. Thus, the current amount supplied form the constant current source 109 for video signal can be increased, thereby performing the setting operation of the current source circuits (the current source circuits 431*a* and 431*b*) accurately.

When the current source circuits (the current source circuit 431*a* and 431*b*) belonging to the first latch circuit 416 are the current mirror circuits as shown in FIG. 6C, the W(gate width)/L(gate length) ratio of each transistor may be changed depending on each bit. As a result, the current flowing from the constant current source 109 for video signal of the lower bit can be much more increased.

Namely, the W/L of the transistor connected to the constant current source 109 for video signal is made larger than the W/L of the transistor connected to the second latch circuit. In a short, the W/L of the transistor of performing the setting operation is set larger than the W/L ratio of the transistor of performing the input operation. Then, the current for performing the setting operation, in other words, the current flowing from the constant current source 109 for video signal can be much more increased.

Next, a description will be made in the case where the current source circuits (the current source circuits 431*a* and 431*b*) belonging to the first latch circuit 416 are the circuits as shown in FIG. 6A and the current source circuit (the current source circuit 433*a*) belonging to the second latch circuit 417 is the current mirror circuit as shown in FIG. 6C. In this case, of the two transistors of each current source circuit (the current source circuits 433*a* and 433*b*) that is the current mirror circuit as shown FIG. 6C, one is connected to the current source circuit (the current source circuit 433*a*) belonging to the first latch circuit 416 and the other is connected to the pixel.

When the W(gate width)/L(gate length) ratio of the transistor connected to the pixel is set smaller than that of the transistor connected to the current source circuit belonging to the first latch circuit 416, the current amount supplied from the constant current source 109 for video signal or the first latch circuit can be made larger.

For example, assume that the amount of the current given to the pixel is P. Then, assuming that the W/L ratio of the transistor connected to the pixel is Wa and that the W/L ratio of the transistor connected to the current source circuit belonging to the first latch circuit 417 is (2×Wa), the current of (2×P) will be supplied from the first latch circuit. Thus, the current supplied from the first latch circuit can be increased, thereby performing the setting operation of each current source circuit (the current source circuits 431*a* and 431*b*) accurately.

Next, a description will be made in the case where the both of the current source circuits (the current source circuits 431*a* and 431*b*) belonging to the first latch circuit 416 and the current source circuit (the current source circuit 433*a*) belonging to the second latch circuit 417 are the current mirror circuits as shown in FIG. 6C.

For example, assume that the current amount given to the pixel is P. Assuming that, in each current source circuit (the current source circuit 433*a*) belonging to the second latch circuit 417, in each of the two transistors of the current mirror circuit as shown in FIG. 6C, the W/L ratio of the transistor connected to the pixel is Wa, and the W/L ratio of the transistor connected to each current source circuit belonging to the first latch circuit 416 is (2×Wa). Then, the current amount becomes twice in the second latch circuit 417.

Similarly, assuming that the W/L ratio of the transistor connected to the constant current source 109 for video signal is (2×Wb), the W/L ratio of the transistor connected to the second latch circuit 417 becomes Wb. Then, the current amount becomes twice in the first latch circuit 416. Then, the current of (4×P) will be supplied from the constant current source 109 for video signal (for one bit and two bits). Thus, the current supplied from the constant current source 109 for video signal can be increased, thereby performing the setting operation of the current source circuit quickly and accurately.

When the current source circuits (the current source circuits 431*a* and 431*b*) belonging to the first latch circuit 416 are the current mirror circuits as shown in FIG. 6C, the W(gate width)/L(gate length) ratio of each transistor may be changed depending on each bit. As a result, the current flowing from the constant current source 109 for video signal of the lower bit can be much more increased.

Namely, the W/L ratio of the transistor connected to the constant current source 109 for video signal is made larger than the W/L ratio of the transistor connected to the second latch circuit. In a short, the W/L ratio of performing the setting operation is made larger than the W/L ratio of the transistor of performing the input operation. Then, the current for performing the setting operation, in other words, the current flowing from the constant current source 109 for video signal can be much more increased.

At last, a description will be made in the case where the both of the current source circuits (the current source circuits 431*a* and 431*b*) belonging to the first latch circuit 416 and the current source circuit (the current source circuit 433*a*) belonging to the second latch circuit 417 are the circuits as shown in FIG. 6A. In the case of both using the circuit as shown in FIG. 6A, since the number of the transistors arranged in the current source circuit can be lessened, ill effect caused by the characteristic dispersion can be restrained. Namely, since the transistor for performing the setting operation and the transistor for performing the input operation are the same, there is no ill effect caused by the dispersion between the transistors.

In FIG. 26 and FIG. 27, the constant current source 109 for one-bit video signal is connected to a video line (Video data line) and the constant current source 109 for two-bit video signal is connected to a video line (Video data line) for two bits. Assuming that the current supplied from the constant current source 109 for one-bit video signal is I, the current supplied from the constant current source 109 for two-bit video signal is 2I. The invention, however, is not restricted to this, but the current amounts respectively supplied from the constant current source 109 for one-bit video signal and the constant current source 109 for two-bit video signal can be the same. When the current amounts respectively supplied from the constant current source 109 for one-bit video signal and the constant current source 109 for two-bit video signal are the same, the operation condition and the load can be the same and further the time of writing signals into the respective current source circuits can be the same.

At that time, the current mirror circuit as shown in FIG. 6C is adopted to the current source circuits (the current source circuits 431*a* and 431*b*) belonging to the first latch circuit 416. Further, it is necessary to set the W/L ratio of the transistor belonging to the current source circuit 431*a* and the transistor belonging to the current source circuit 431*b* at 2:1. Then, the ratio of the current amount supplied from the current source circuit 431*a* and the current amount supplied from the current source circuit 431*b* can be set at 2:1.

The current mirror circuit as shown in FIG. 6C is adopted to not only the current source circuits for all bits but also the current source circuits for some bit. It is preferable that the current mirror circuit as shown in FIG. 6C is used for the current source circuit for lower bit and the circuit as shown in FIG. 6A is used for the current source circuit for upper bit.

Because the current source circuit for upper bit has a great effect on the current value even if the characteristics of the transistors of the current source circuit are a little dispersed. This is why the absolute value of a difference of the currents caused by dispersion is also great, as for the current supplied from the current source circuit for upper bit, since the current value itself is great, even if the characteristics of the transistors are dispersed to the same degree. For example, assume that the characteristics of the transistors are dispersed by 10%. Assuming that the current amount for one bit is I, the dispersion amount is 0.1I. Since the current amount for three bits becomes 8I, the dispersion amount becomes 0.8I. Thus, the current source circuit for upper bit is much influenced even by a little dispersion of the characteristic of the transistor.

Therefore, a method of having the least effect from the dispersion is preferable. Further, since the current value in the current for upper bit is great, it is easy to do the setting operation. While, since the current value itself is small in the current for lower bit even if some dispersion, its influence is small. Since the current value is small in the current for lower bit, it is not easy to do the setting operation.

In order to solve the situation, it is preferable that the current mirror circuit as shown in FIG. 6C is used for the current source circuit for lower bit and the circuit as shown in FIG. 6A is used for the current source circuit for upper bit.

In the case of FIG. 26, it is not the first latch circuit 416 but the second latch circuit 417 that may adopt the current mirror circuit as shown in FIG. 6C. Alternatively, both of the first latch circuit 416 and the second latch circuit 417 may adopt the current mirror circuit as shown in FIG. 6C.

In this embodiment form, the structure of the signal line driving circuit and its operation in the case of performing the digital gradation display of two bits have been described. The invention, however, is not restricted to the above two bits, but the signal line driving circuit corresponding to any number of bits can be designed by reference to this embodiment form, so to do the display of any number of bits. This embodiment form can be freely combined with the embodiment form 1, 2, or 3.

Embodiment Form 5

As mentioned above, it is preferable that, in the circuit as shown in FIG. 6A, two current source circuits are provided in every one signal line (each line); one current source circuit performs the operation for setting a signal (setting operation) and use of the other current source circuit performs the operation for entering the $I_{data}$ to the pixel (input operation). This is why the setting operation and the input operation can be performed at the same time. Then, in this embodiment form, an example of the circuit structure of the current source circuit 420 shown in FIG. 2 provided in the signal line driving circuit of the invention will be described by using FIG. 8.

The outline of the signal line driving circuit of the invention will be described by using FIG. 2. FIG. 2 shows the signal line driving circuit in the vicinity of the three signal lines from the i-th line to the (i+2)-th line.

Figure 2:
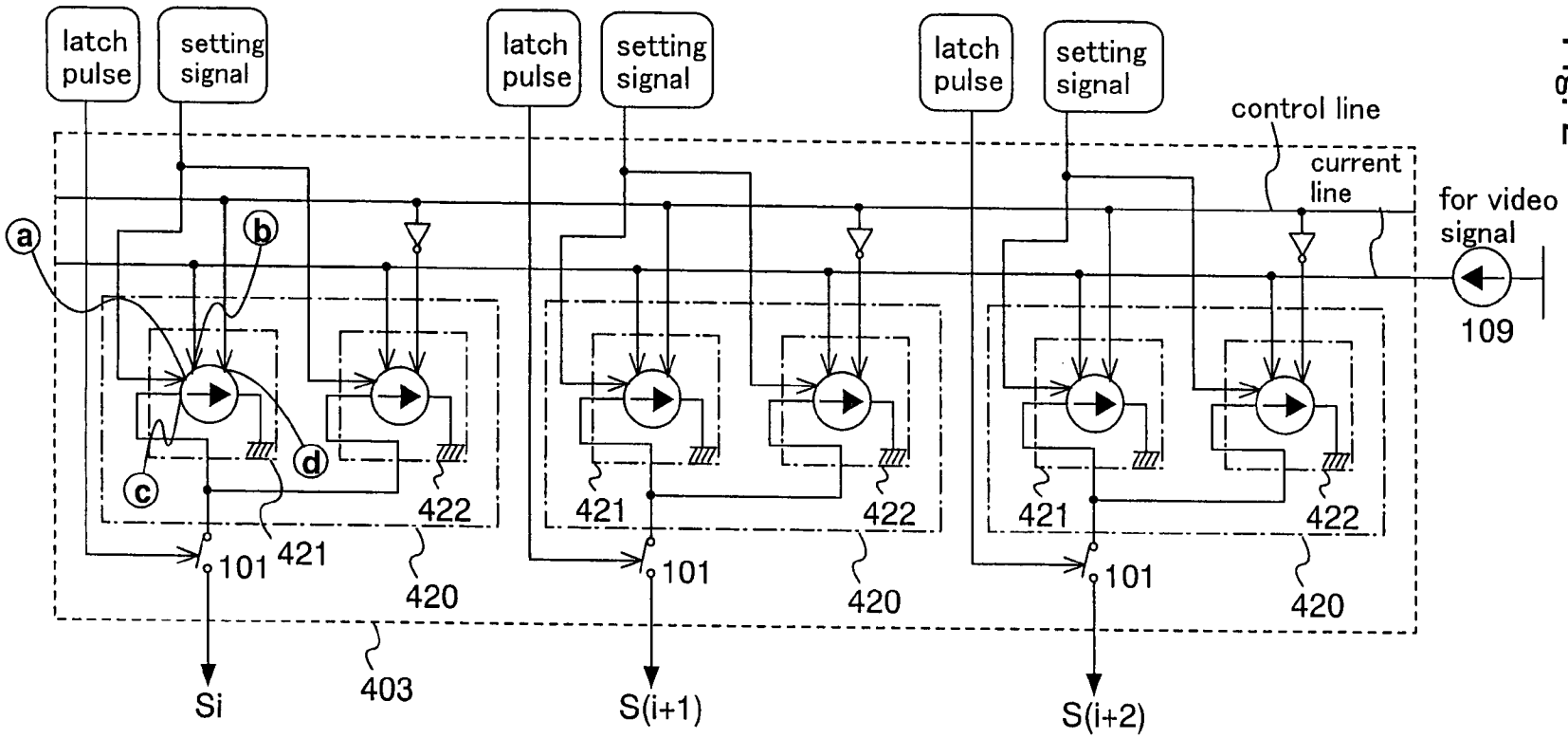
FIG. 2 is a view of a signal line driving circuit.

In FIG. 2, the signal line driving circuit 403 is provided with the current source circuits 420 for every signal line. The current source circuit 420 includes a plurality of current source circuits. Assuming that it includes two current source circuits here, the current source circuit 420 is defined as that one including a first current source circuit 421 and a second current source circuit 422. The first current source circuit 421 and the second current source circuit 422 each have the terminal a, the terminal b, the terminal c, and the terminal d. A setting signal is entered from the terminal a. The current from the constant current source 109 for video signal connected to a current line is supplied from the terminal b. A signal held in each of the first current source circuit 421 and the second current source circuit 422 is supplied from the terminal c. Namely, the current source circuit 420 is controlled according to the setting signal entered from the terminal a and the control signal entered from the terminal d, the supplied signal current is entered from the terminal b, and the current in proportion to the signal current is supplied from the terminal c. A switch 101 is provided between the current source circuit 420 and the pixel connected to the signal line or between the current source circuit 420 and the current source circuit 420, and the on/off operation of the switch is controlled by a latch pulse. From the terminal d, the control signal is entered.

In the specification, the operation for finishing the writing of the signal current $I_{data}$ in the current source circuit 420 (operation for setting the signal) is referred to as the setting operation and the operation for entering the signal current $I_{data}$ into the pixel is referred to as the input operation. Since the control signals to be entered to the first current source circuit 421 and the second current source circuit 422 are mutually different, of the first current source circuit 421 and the second current source circuit 422, one performs the setting operation and the other performs the input operation.

In the invention, the setting signal to be entered from the terminal a indicates the sampling pulse or the latch pulse supplied from the shift register. The setting signal in FIG. 1 corresponds to the sampling pulse or the latch pulse supplied from the shift register. In the invention, the setting of the current source circuit 420 is performed in accordance with the sampling pulse or the latch pulse supplied from the shift register.

The signal line driving circuit of the invention includes the shift register, the first latch circuit, and the second latch circuit. The first latch circuit and the second latch circuit respectively have the current source circuits. Namely, the sampling pulse supplied from the shift register is entered into the terminal a of the current source circuit belonging to the first latch circuit. The latch pulse is entered into the terminal a of the current source circuit belonging to the second latch circuit.

The current source circuit 420 is controlled according to the setting signal entered from the terminal a, the supplied signal current is entered from the terminal b, and the current in proportion to the signal current is supplied from the terminal c.

Figure 8A:
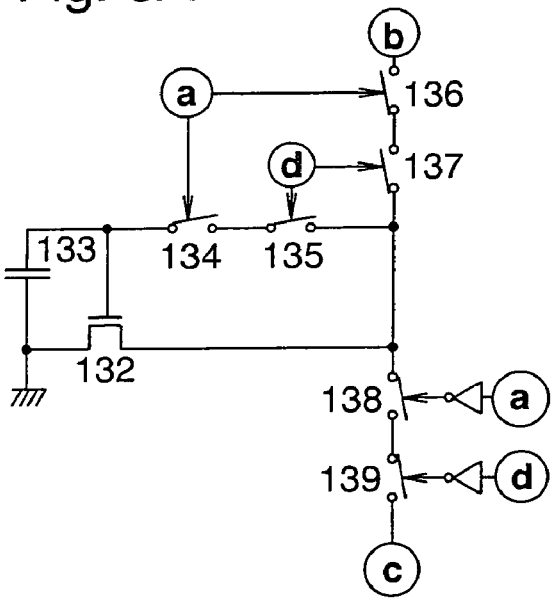
FIGS. 8A-8B are circuit diagrams of current source circuits.

In FIG. 8A, the circuit including the switch 134 to the switch 139, the transistor 132 (n channel), and the capacitive element 133 for holding the voltage $V_{GS}$ between the gate/source of the above transistor 132 corresponds to the first current source circuit 421 or the second current source circuit 422.

The switch 134 and the switch 136 are turned on according to the signal entered through the terminal a, in the first current source circuit 421 or the second current source circuit 422. Further, the switch 135 and the switch 137 are turned on according to the signal entered from the control line through the terminal d. Then, the current is supplied from the constant current source 109 for video signal connected to the current line through the terminal b, and the electric charges are held in the capacitive element 133. The electric charges are held into the capacitive element 133 until the signal current $I_{data}$ flowing from the constant current source 109 becomes equal to the drain current of the transistor 132.

Next, the switches 134 to 137 are turned off. Then, since a predetermined amount of electric charges are held in the capacitive element 133, the transistor 132 has the ability of running the current for the size of the signal current $I_{data}$. If the switch 101, the switch 138, and the switch 139 are in a conductive state, the current flows into the pixel connected to the signal line through the terminal c. At this time, since the gate voltage of the transistor 132 is kept at a predetermined gate voltage by the capacitive element 133, the drain current flows in the drain region of the transistor 132 depending on the signal current $I_{data}$. Therefore, it is possible to control the influence of the characteristic dispersion among the transistors forming the signal line driving circuit and control the current amount flowing in the pixel.

Figure 8B:
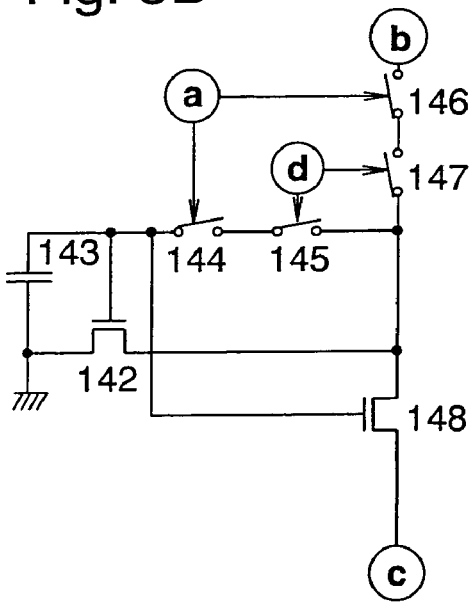

In FIG. 8B, the circuit including the switch 144 to switch 147, the transistor 142 (n channel), the capacitive element 143 for holding the voltage $V_{GS}$ between the gate/source of the above transistor 142, and the transistor 148 (n channel) corresponds to the first current source circuit 421 or the second current source circuit 422.

The switch 144 and the switch 146 are turned on according to the signal entered through the terminal a, in the first current source circuit 421 or the second current source circuit 422. Further, the switch 145 and the switch 147 are turned on according to the signal entered from the control line through the terminal d. Then, the current is supplied from the constant current source 109 connected to the current line, through the terminal b, and the electric charges are held in the capacitive element 143. The electric charges are held into the capacitive element 143 until the signal current $I_{data}$ flowing from the constant current source 109 becomes equal to the drain current of the transistor 142. When the switch 144 and the switch 145 are turned on, since the voltage $V_{GS}$ between the gate/source of the transistor 148 becomes 0V, the transistor 148 turns off.

Next, the switches 144 to 147 are turned off. Then, since the signal current $I_{data}$ is held in the capacitive element 143, the transistor 142 has the ability of running the current for the size of the signal current $I_{data}$. If the switch 101 is in a conductive state, the current flows into the pixel connected to the signal line through the terminal c. At this time, since the gate voltage of the transistor 142 is kept at a predetermined gate voltage by the capacitive element 143, the drain current flows in the drain region of the transistor 142 depending on the signal current $I_{data}$. Therefore, it is possible to control the current amount flowing in the pixel, independent of the characteristic dispersion among the transistor forming the signal line driving circuit.

When the switch 144 and the switch 145 are turned off, the potential becomes different between the gate and the source of the transistor 148. As a result, the electric charges held in the capacitive element 143 are distributed to the transistor 148, and the transistor 148 is automatically turned on. Here, the transistors 142 and 148 are connected in series and the mutual gates are connected with each other. Accordingly, the transistors 142 and 148 work as the transistor of multi-gate. Namely, in the setting operation time and the input operation time, the gate length L of each transistor is different. Accordingly, the current value supplied from the terminal b at the setting operation time can be larger than the current value supplied from the terminal c at the input operation time. Therefore, various loads (wiring resistance, crossing capacity and the like) disposed between the terminal b and the current generator for video can be filled sooner. Therefore, the setting operation can be finished quickly.

Here, FIG. 8A corresponds to the structure of adding the terminal d to FIG. 6A. FIG. 8B corresponds to the structure of adding the terminal d to FIG. 6B. Thus, the switch is added in series to change the structure, which results in the structure with the terminal d added. Thus, by arranging the two switches in series in the first current source circuit 421 or the second current source circuit 422 in FIG. 2, it is possible to optionally use the current source circuits of any structure as shown in FIG. 6, FIG. 7, FIG. 29, FIG. 30, FIG. 32, and the like.

In FIG. 2, although the structure having the current source circuit 420 including the two current source circuits of the first current source circuit 421 and the second current source circuit 422 for every one signal line has been described, the invention is not restricted to this. For example, three current source circuits 420 may be provided in every one signal line. The signal currents in the respective current source circuits 420 may be set according to the different constant current sources 109 for video signal. For example, the signal current may be set by using the constant current source for one-bit video signal in one current source circuit 420, the signal current may be set by using the constant current source for two-bit video signal in another current source circuit 420, and the signal current may be set by using the constant current source for three-bit video signal in the other current source circuit 420.

This embodiment form may be freely combined with any of the embodiments 1 to 4. Namely, instead of each one current source circuit arranged in each line, as illustrated in FIG. 4, FIG. 5, FIG. 26, and FIG. 27, two current source circuits of FIG. 6A may be arranged in each line, as illustrated in FIG. 2. Thus, assuming that the current supplied from the current source circuit 421 in FIG. 2 is, for example, 4.9 A and that the current supplied from the current source circuit 422 is 5.1 A, the dispersion of the current source circuits can be evened by arranging in that the current is supplied from one of the current source circuit 421 and the current source circuit 422 in every frame.

Embodiment Form 6

The constant current source 109 for video signal each shown in FIG. 2 to FIG. 5 may be integrated with the signal line driving circuit on the substrate, or a constant current may be entered from the outside of the substrate by using IC and the like, as the current 109 for video signal. When forming it integrally on the substrate, any of the current source circuits shown in FIGS. 6 to 8, FIG. 29, FIG. 30, FIG. 32, and the like may be used. In the embodiment form, a description will be made in the case of forming the current generator 109 for three-bit video signal with the current source circuit of the current mirror circuit as shown in FIG. 6C, by using FIG. 23 to FIG. 25.

The direction of the current flow varies depending on the structure of the pixel and the like. In this case, it is possible to cope with the above situation easily, by changing the polarity of the transistor and the like.

Figure 23:
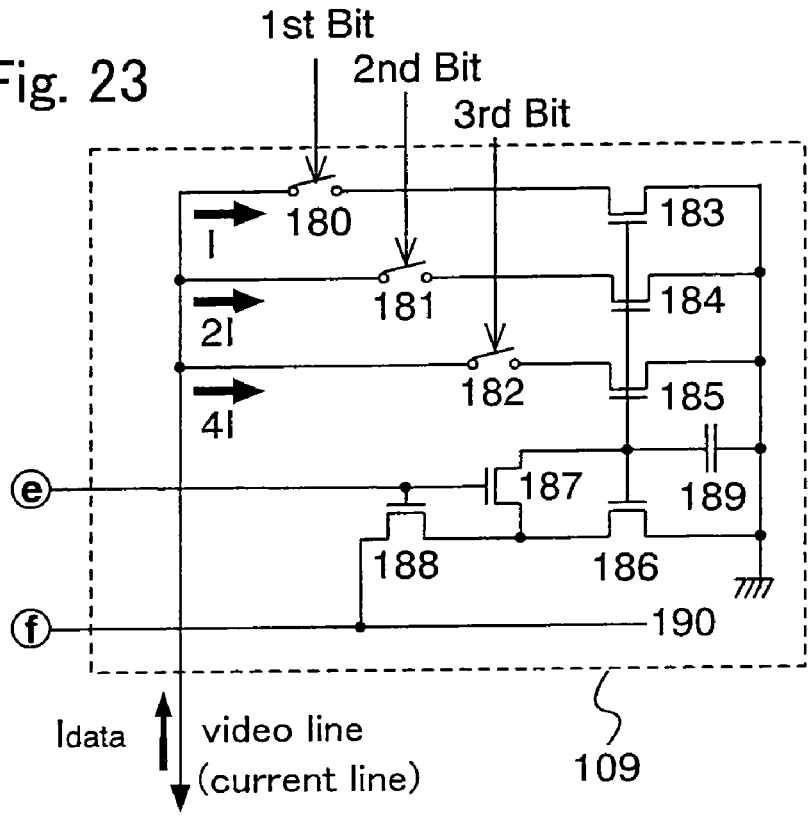
FIG. 23 is a view of a signal line driving circuit (3-bit).

In FIG. 23, in the constant current source 109 for video signal, whether or not the predetermined signal current $I_{data}$ is supplied to the video line (Video data line) (current line) is controlled according to the information of High or Low belonging to the digital video signal for three bits (Digital Data 1 to Digital Data 3).

The constant current source 109 for video signal has the switch 180 to the switch 182, the transistor 183 to the transistor 188, and the capacitive element 189. In this embodiment form, assume that the transistors 180 to 188 are all of the n-channel type.

The switch 180 is controlled by the digital video signal of one bit. The switch 181 is controlled by the digital video signal of two bits. The switch 183 is controlled by the digital video signal of three bits.

Of the source region and the drain region of each transistor 183 to 185, one is connected to $V_{SS}$ and the other is connected to one terminal of each switch 180 to 182. Of the source region and the drain region of the transistor 186, one is connected to $V_{SS}$ and the other is connected to one of the source region and the drain region of the transistor 188.

A signal is entered into the gate electrodes of the transistor 187 and the transistor 188 from the outside through the terminal e. The current is supplied into the current line 190 from the outside through the terminal f.

In the source region and the drain region of the transistor 187, one is connected to one of the source region and the drain region and the other is connected to one electrode of the capacitive element 189. In the source region and the drain region of the transistor 188, one is connected to the current line 190 and the other is connected to one of the source region and the drain region of the transistor 186.

One electrode of the capacitive element 189 is connected to the gate electrodes of the transistor 183 to the transistor 186, and the other electrode thereof is connected to $V_{SS}$. The capacitive element 189 serves to hold the voltage between each gate/source of the transistor 183 to the transistor 186.

When the transistor 187 and the transistor 188 are turned on according to the signal entered from the terminal e, in the constant current source 109 for video signal, the current supplied through the terminal f flows into the capacitive element 189 through the current line 190.

The electric charges are gradually accumulated into the capacitive element 189, hence to produce a potential difference between the both electrodes. When the potential difference between the both electrodes becomes $V_{th}$, the transistors 183 to 186 are turned on.

In the capacitive element 189, the electric charges are continuously accumulated until the voltage between each gate/source of the transistor 183 to the transistor 186 comes to a predetermined voltage. In other words, accumulation of the electric charges is continued until the transistors 183 to 186 are in a position to flow the signal current.

When the accumulation of the electric charges is finished, the transistors 183 to 186 are completely turned on.

In the constant current source 109 for video signal, conductive or non-conductive state of each switch 180 to switch 182 is selected according to the digital video signal of three bits. For example, when all the switches 180 to 182 are in the conductive state, the current supplied to the current line becomes the total sum of the drain current of the transistor 183, the drain current of the transistor 184, and the drain current of the transistor 185. When only the switch 180 is in the conductive state, only the drain current of the transistor 183 is supplied to the current line.

At this time, when the drain current of the transistor 183, the drain current of the transistor 184, and the drain current of the transistor 185 are set at 1:2:4, it is possible to control the current amount in $2^3$=8 steps. Therefore, when the transistors 183 to 185 are designed in that each W(channel width)/L (channel length) ratio can be 1:2:4, each on current becomes 1:2:4.

Figure 41:
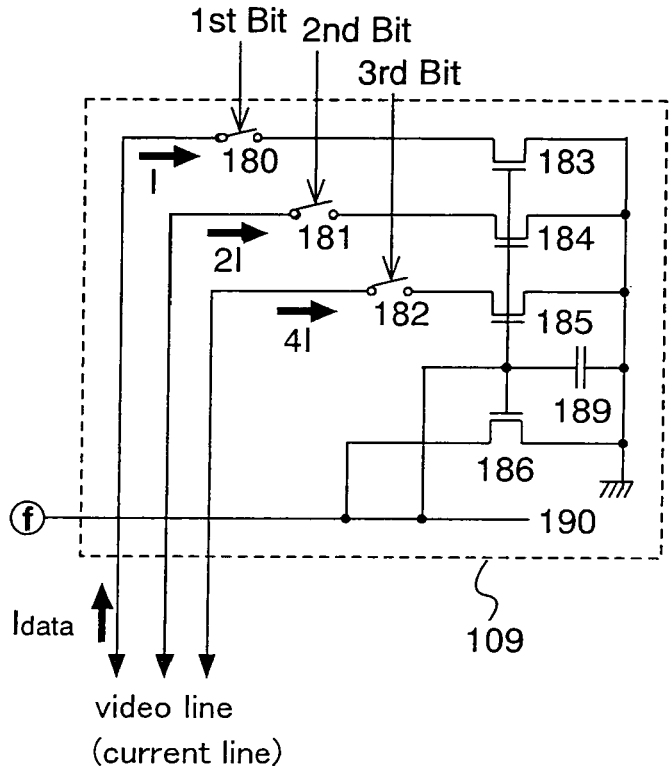
FIG. 41 is a circuit diagram of a constant current source for video signal.

In FIG. 23, the description has been made in the case of one current (video) line. However, depending on whether the structure of the signal line driving circuit for supplying the current is of the circuit as shown in FIG. 4 or the circuit as shown in FIG. 26 or FIG. 27, the number of the current lines (video lines) varies. Then, the case of including a plurality of the current lines (video lines) in the circuit of FIG. 23 is shown in FIG. 41.

Figure 24:
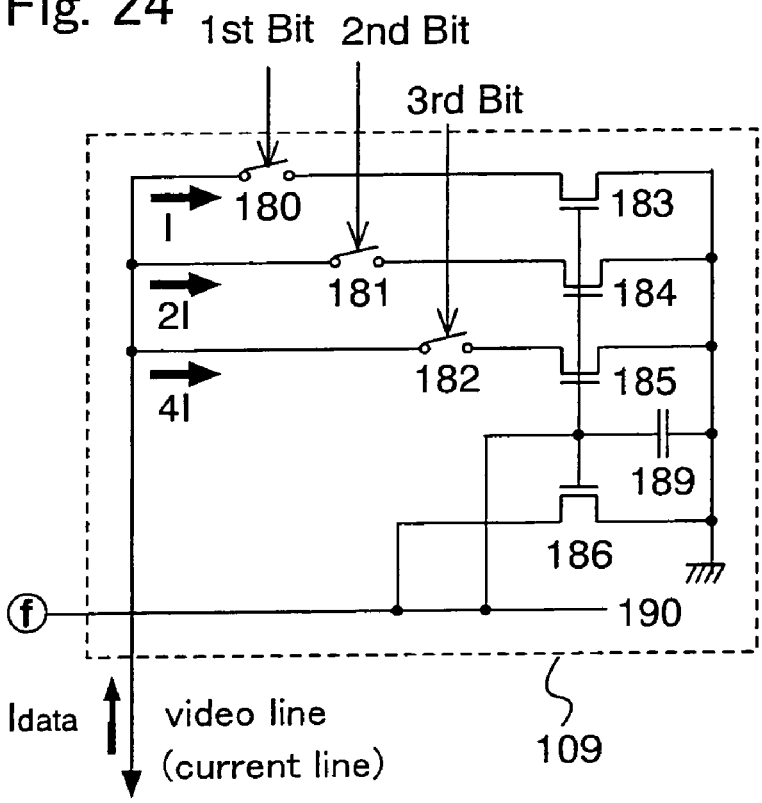
FIG. 24 is a view of a signal line driving circuit (3-bit).

The current generator 109 for video signal having the different structure from FIG. 23 is shown in FIG. 24. In FIG. 24, compared with the current generator 109 for video signal shown in FIG. 23, the operation is the same as the operation of the current generator 109 for video signal shown in FIG. 23, except that the transistors 187 and 188 are removed and that one terminal of the capacitive element 189 is connected to the current line 190, and therefore, its description is omitted in this embodiment form.

In the structure of FIG. 24, during continuing supplying the current to the video line (current line), it is necessary to continue receiving the signal (current) through the terminal f. If the input of the current flowing from the terminal f is stopped, the electric charges in the capacitive element 189 are discharged through the transistor 186. As a result, the potential of the gate electrode of the transistor 186 is decreased, the correct current cannot be supplied from the transistors 183 to 185. While, in the case of the structure of FIG. 23, since predetermined electric charges are held in the capacitive element 189, it is not necessary to continue receiving the signal (current) through the terminal f, during the current supply to the video line (current line). Therefore, in the structure of FIG. 24, the capacitive element 189 may be omitted.

Figure 42:
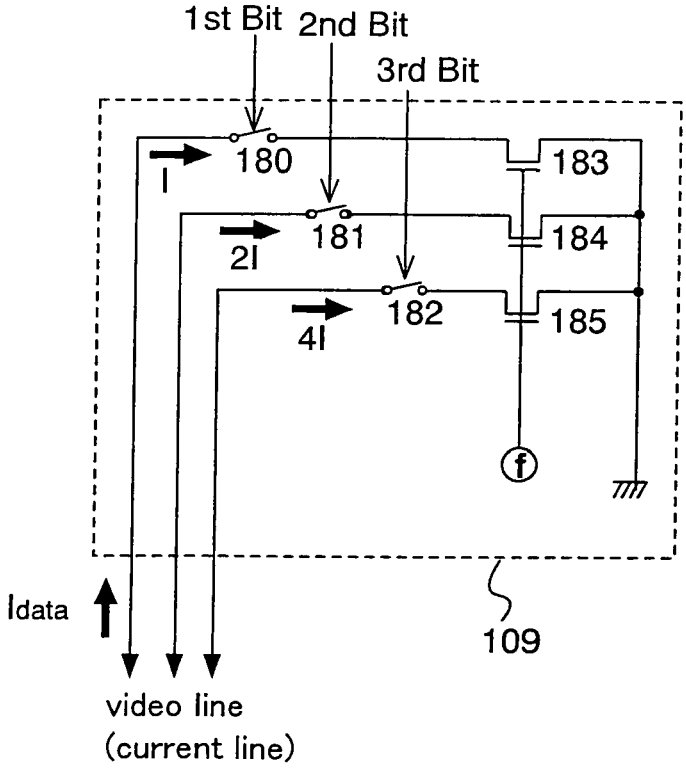
FIG. 42 is a circuit diagram of a constant current source for video signal.

In FIG. 24, the case of one current (video) line has been described. However, depending on whether it is the circuit as shown in FIG. 4, or the circuit as shown in FIG. 26 or FIG. 27, the number of the current lines (video lines) varies. Then, a view in the case of including a plurality of current lines (video lines) in the circuit of FIG. 24 is shown in FIG. 42.

Continuously, the current generator 109 for video signal having the different structure from those of FIG. 23 and FIG.

Figure 25:
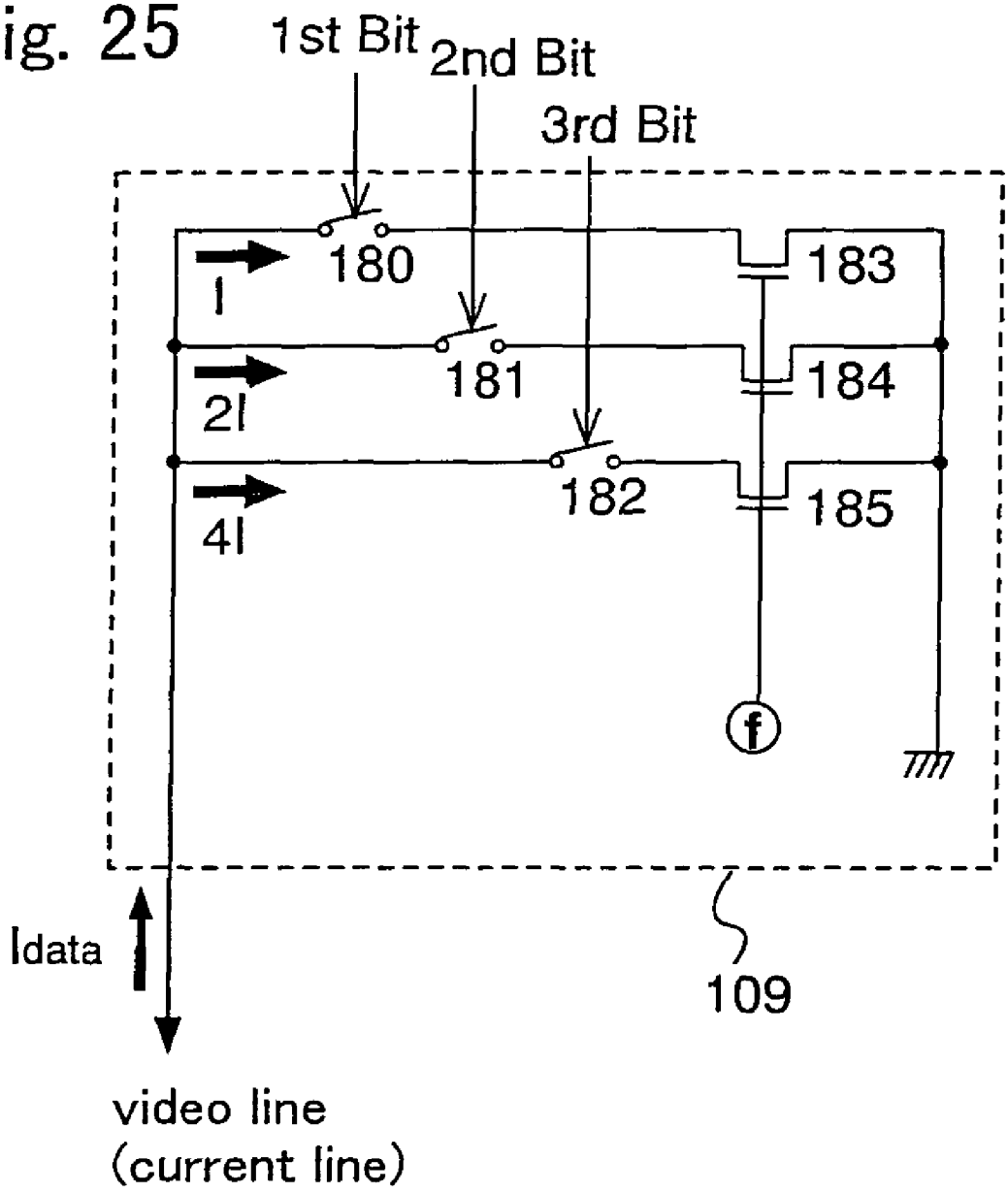
FIG. 25 is a circuit diagram of a constant current source for video signal.

24 is shown in FIG. 25. In FIG. 25, compared with the current generator 109 for video signal shown in FIG. 23, the operation is the same as the operation of the current generator 109 for video signal shown in FIG. 23, except that the transistors 186, 187, and 188 and the capacitive element 189 are removed and that a constant voltage is applied from the electrode to each gate electrode of the transistor 183 to the transistor 185 through the terminal f, and therefore its description is omitted in this embodiment form.

In the case of FIG. 25, a voltage (gate voltage) is applied to each gate electrode of the transistors 183 to 185 through the terminal f. However, even if the same voltage is applied to the transistors 183 to 185, if the characteristics of the transistors 183 to 185 are dispersed, the current values flowing between each source/drain of the transistors 183 to 185 are dispersed. Accordingly, the currents flowing into the video line (current line) are dispersed. Further, since the characteristics are varied also depending on the temperature, the current values will be varied.

On the other hand, in the case of FIG. 23 and FIG. 24, through the terminal f, not only the voltage but also the current can be applied. In the case of adding the current, if the characteristics of the transistors 183 to 186 are uniform, the current values will never be dispersed. Even if the characteristics are varied depending on the temperature, since the characteristics of the transistors 183 to 186 are varied to the same degree, the current values will not be varied.

Figure 43:
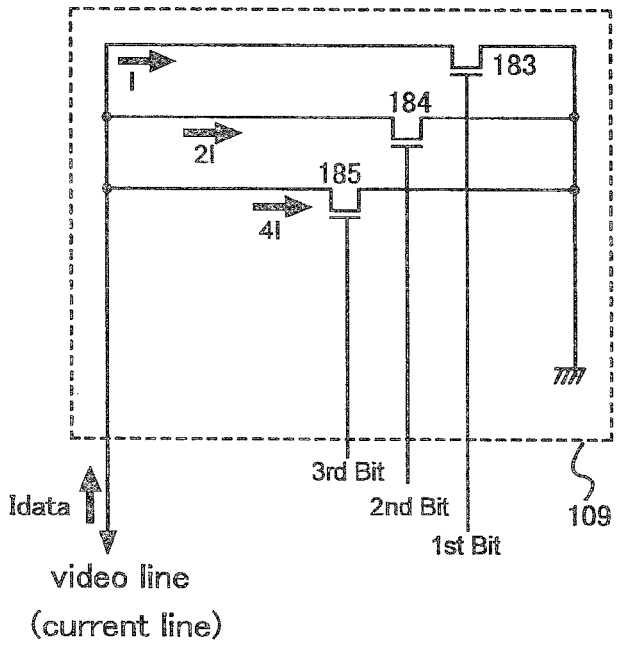
FIG. 43 is a circuit diagram of a constant current source for video signal.
Figure 44:
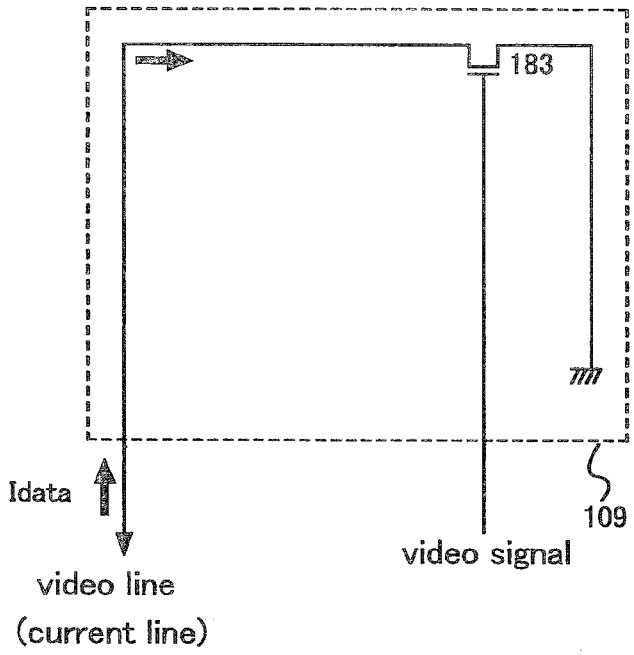
FIG. 44 is a circuit diagram of a constant current source for video signal.

In the case of FIG. 25, though the voltage (gate voltage) is added to the transistors 183 to 185, through the terminal f, the voltage is not varied according to the video signal. In FIG. 25, the video signal controls whether or not the current flows to the current line, by controlling the switches 180 to 182. Then, as shown in FIG. 43, the voltage (gate voltage) may be added to each gate electrode of the transistors 183 to 185 and the voltage may be varied depending on the video signal. Thus, the amount of the current for video signal can be varied. Further, as shown in FIG. 44, the voltage (gate voltage) to be added to the gate electrode of the transistor 183 may be converted into analog voltage and the voltage may be varied according to the gradation, thereby varying the current.

Figure 9:
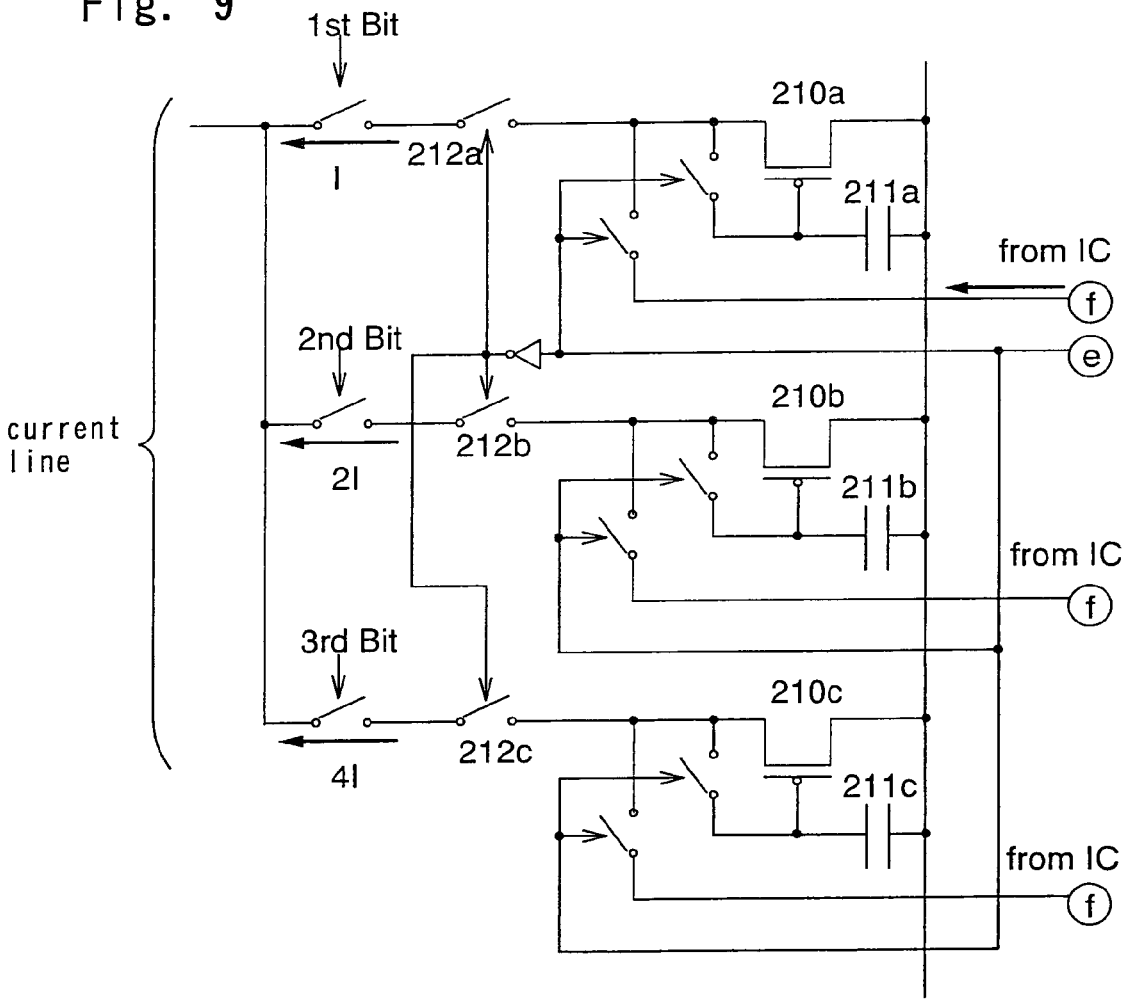
FIG. 9 is a circuit diagram of a constant current source for a video signal.

Continuously, the current generator 109 for video signal having the different structure from those of FIGS. 23, 24, and 25 is shown in FIG. 9. Although the current source circuit of FIG. 6C has been adopted in FIG. 23, the current source circuit of FIG. 6A is adopted in FIG. 9.

Figure 10:
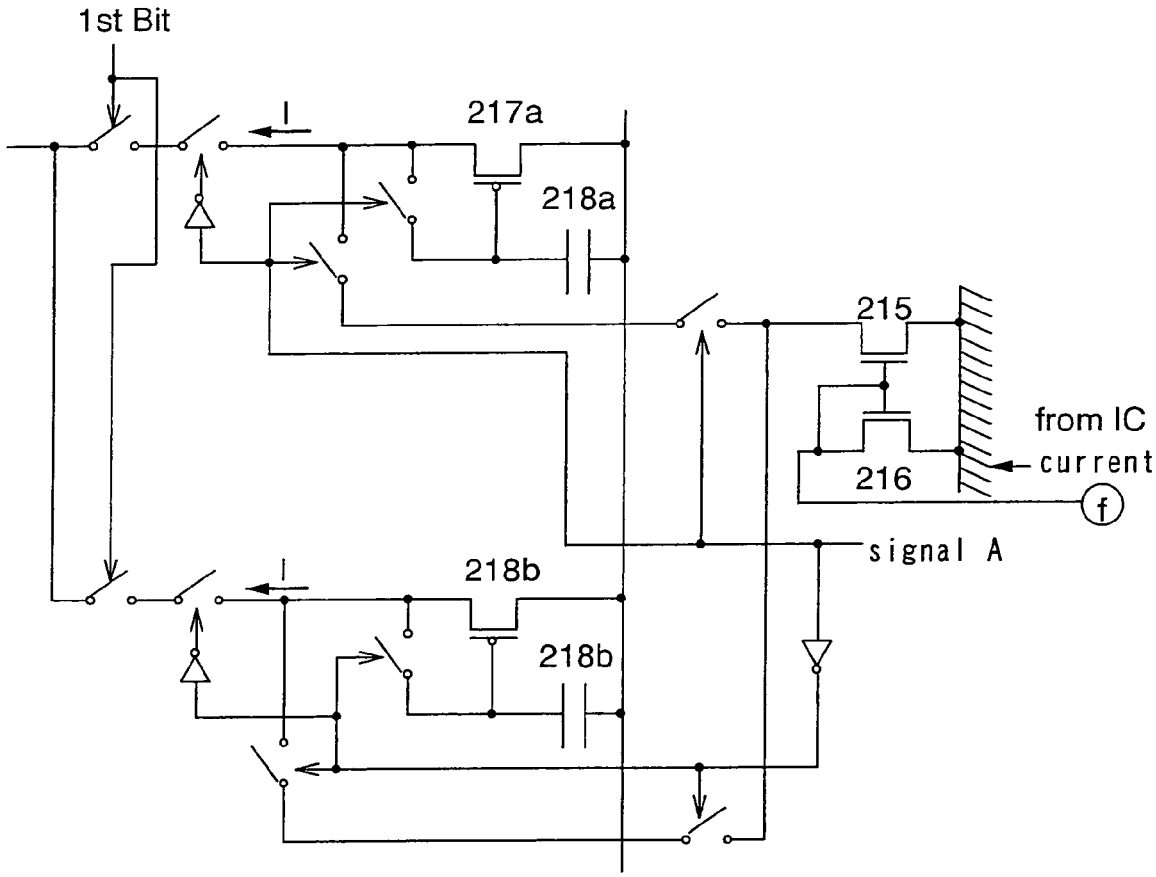
FIG. 10 is a circuit diagram of a constant current source for a video signal.

In the case of FIG. 23, if the characteristics of the transistors 183 to 186 are dispersed, the current values are dispersed. While, in FIG. 9, the setting operation is performed on the respective current sources. Accordingly, ill effect from the dispersion of the transistors can be lessened. In the case of FIG. 9, however, while the setting operation is performed, the input operation (operation for supplying the current to the current line) cannot be performed at the same time. Accordingly, the setting operation must be performed while the input operation is not performed. In order to make the setting operation possible during the performance of the input operation, a plurality of current source circuits may be arranged as shown in FIG. 10, and while one part of the current source circuits are performing the setting operation, the input operation may be performed by the other part of the current source circuits.

This embodiment form can be freely combined with any of the embodiment forms 1 to 5.

Embodiment Form 7

Figure 11A:
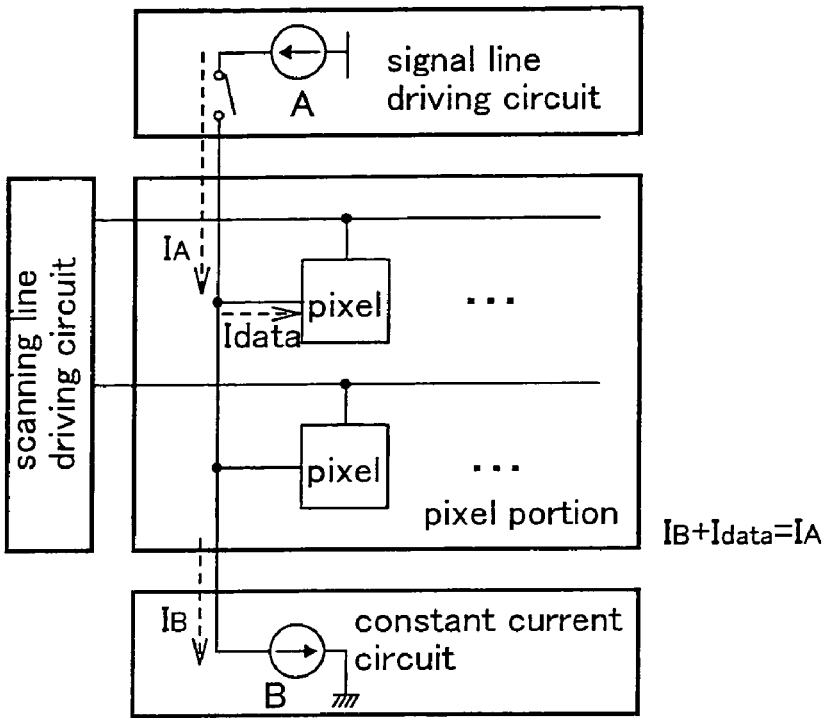
FIGS. 11A-11B are diagrams showing a light emitting device.

This embodiment form of the invention will be described by using FIG. 11. In FIG. 11A, the signal line driving circuit is arranged in the upper portion above the pixel unit, the constant current circuit is arranged in the lower portion, the current source A is arranged in the signal line driving circuit, and the current source B is arranged in the constant current source. Assuming that the currents supplied respectively from the current sources A and B are fixed as $I_A$ and $I_B$ and the signal current supplied to the pixel is $I_{data}$, $I_A=I_B+I_{data}$ is satisfied. Then, when writing the signal current into the pixel, it is designed to supply the current from the both of the current sources A and B. At this time, when $I_A$ and $I_B$ are made larger, a speed of writing the signal current into the pixel can be increased.

At this time, the setting operation of the current source B is performed by using the current source A. The current obtained by subtracting the current of the current source B from the current of the current source A flows in the pixel. Accordingly, by performing the setting operation of the current source B by using the current source A, various ill effects such as noise and the like can be decreased.

Figure 11B:
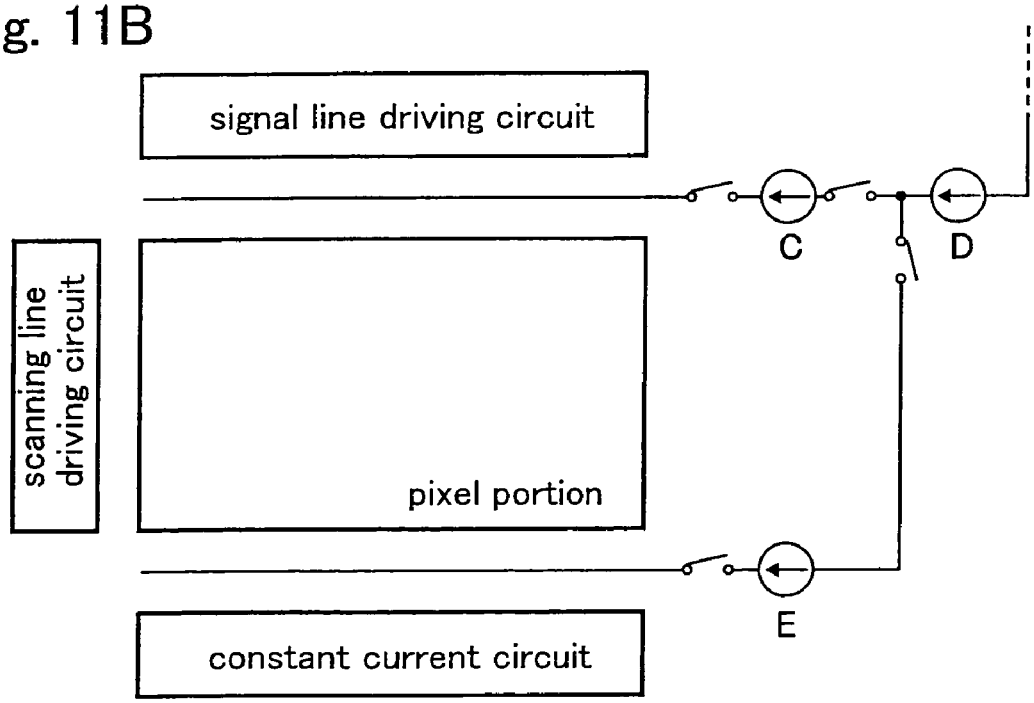

In FIG. 11B, the constant current sources for video signal (hereinafter, represented as a constant current source) C and E are arranged above or below the pixel unit. The setting operation of each current source circuit arranged in the signal line driving circuit and the constant current circuit is performed by using the current generators C and E. The current source D corresponds to the current source for setting the current generators C and E, and the current for video signal is supplied from the outside.

In FIG. 11B, the constant current circuit arranged in the lower portion may be the signal line driving circuit. Thus, the signal line driving circuits can be arranged in the both upper and lower portions. Then, the respective ones are served to control the respective upper half and the lower half portions of the screen (the whole pixel unit). In this way, the pixels for two lines can be controlled at once. Therefore, a long time can be taken for the setting operation (signal input operation) of the current source of the signal line driving circuit, the pixel, and the current source of the pixel. Therefore, they can be set more accurately.

This embodiment form can be freely combined with any of the embodiment forms 1 to 6.

Embodiment 1

Figure 14A:
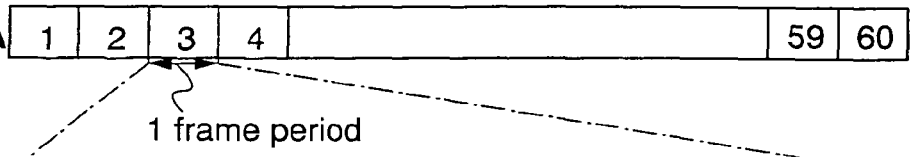
FIGS. 14A-14D are explanatory views of a driving method of the present invention.

In this embodiment, the time gradation method will be described in detail with reference to FIG. 14. In display devices such as liquid crystal display devices and light emitting devices, a frame frequency is about 60 (Hz). That is, as shown in FIG. 14A, screen rendering is performed about 60 times per second. This enables flickers (flickering of a screen) not to be recognized by the human eye. At this time, a period during which screen rendering is performed once is called one frame period.

Figure 14B:
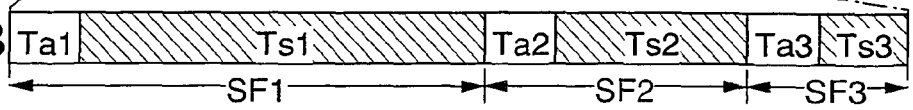

As an example, in this embodiment, a description will be made of a time gradation method disclosed in the publication as Patent Document 1. In the time gradation method, one frame period is divided into a plurality of subframe periods. In many cases, the number of divisions is identical to the number of gradation bits. For the sake of a simple description, a case where the number of divisions is identical to the number of gradation bits. Specifically, since the 3-bit gradation is employed in this embodiment, an example is shown in which one frame period is divided into three subframe periods SF1 to SF3 (FIG. 14B).

Each of the subframe periods includes an address (writing) period Ta and a sustain (light emission) period (Ts). The address period is a period during which a video signal is written to a pixel, and the length thereof is the same among respective subframe periods. The sustain period is a period during which the light emitting element emits light in response to the video signal written in the address period Ta. At this time, the sustain periods SF1 to SF3 are set at a length ratio of Ts1:Ts2:Ts3=4:2:1. More specifically, the length ratio of n sustain periods is set to $2^{(n-1)}:2^{(n-2)}: \ldots :2^1:2^0$. Depending on whether a light emitting element performs emission in which one of the sustain periods, the length of the period during which each pixel emits light in one frame period is determined, and the gradation representation is thus performed.

Figure 16A:
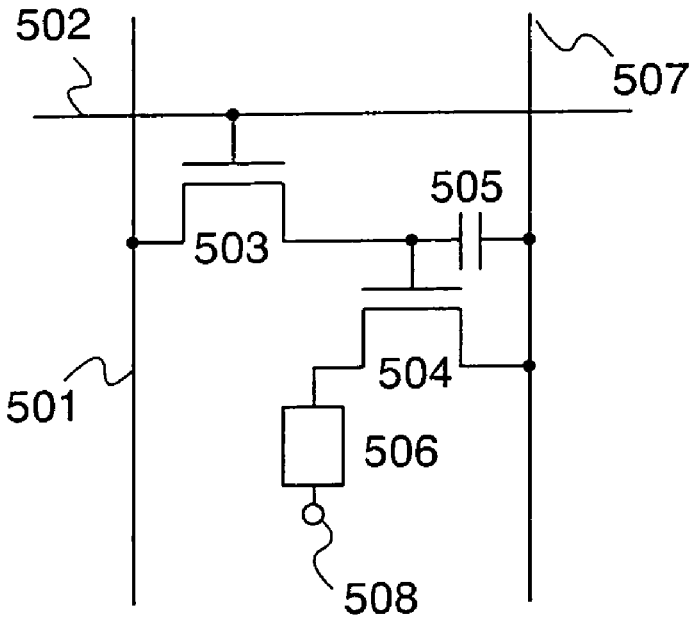
FIGS. 16A-16B are circuit diagrams of pixels of a light emitting device.
Figure 16B:
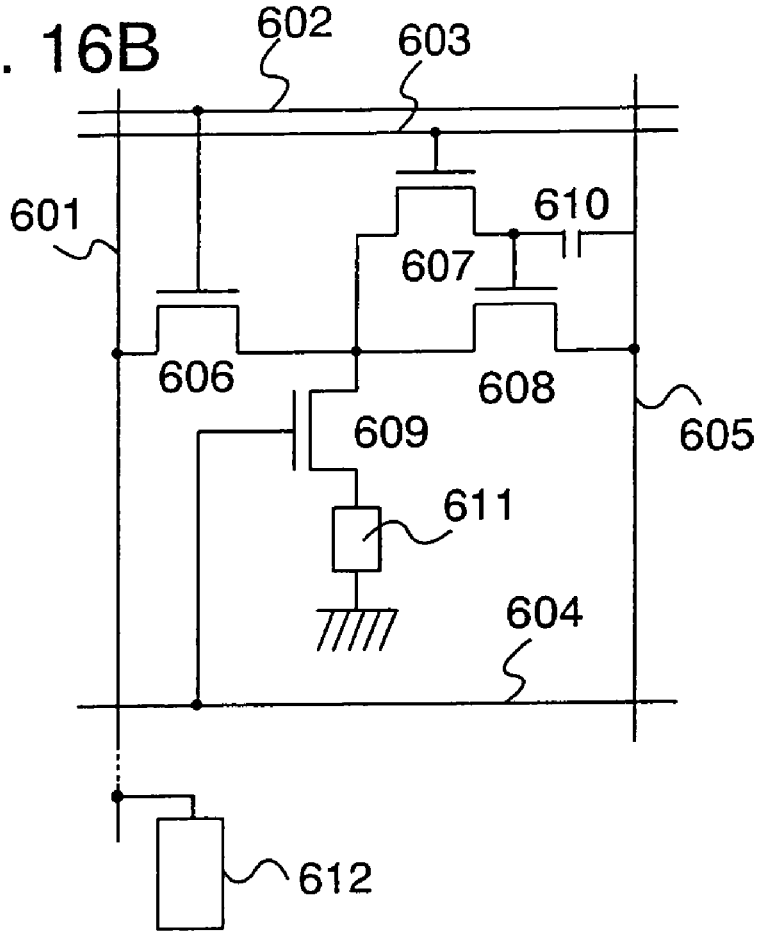
Figure 18A:
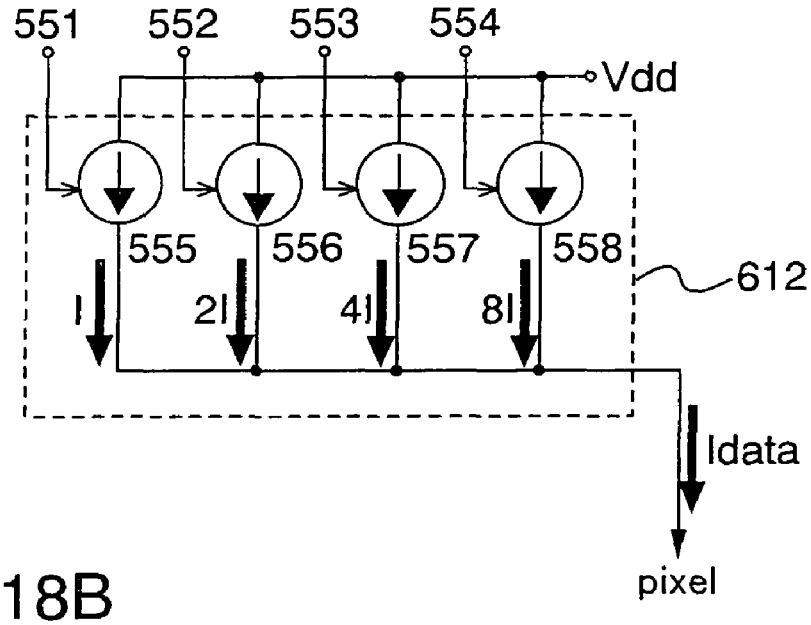
FIGS. 18A-18B are views of a current source circuit.
Figure 18B:
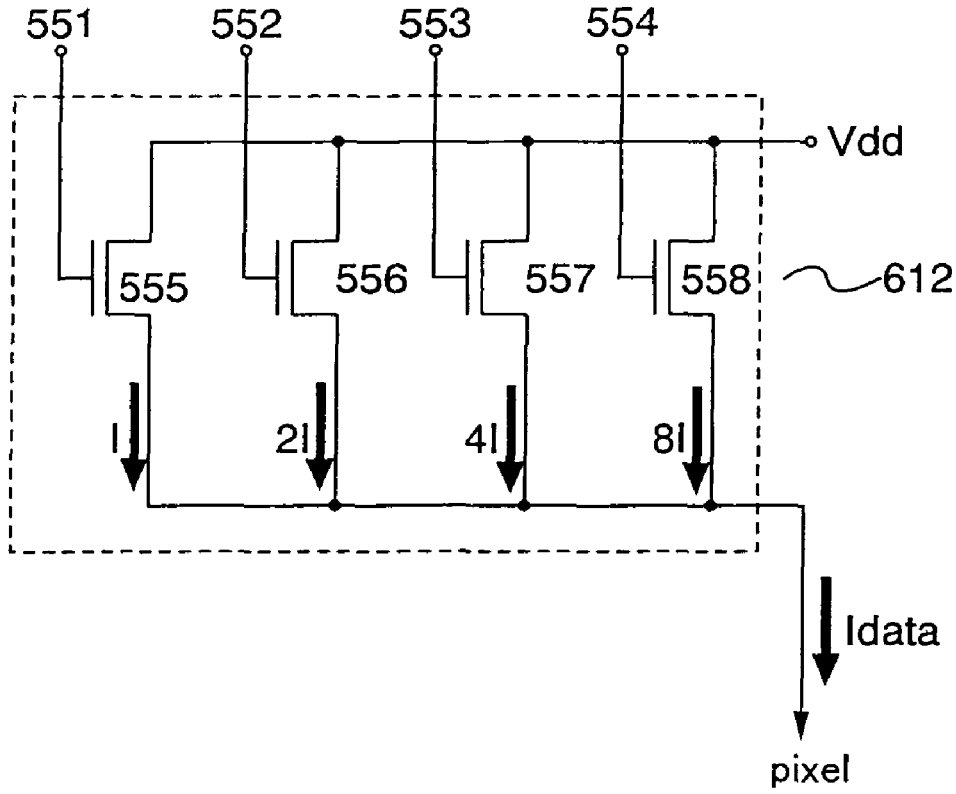

Next, a specific operation of a pixel employing the time gradation method will be described. In this embodiment, a description thereof will be made referring to the pixel shown in FIG. 16B. A current input method is applied to the pixel shown in FIG. 16B.

First, the following operation is performed during the address period Ta. A first scanning line 602 and a second scanning line 603 are selected, and TFTs 606 and 607 are turned ON. A current flowing through a signal line 601 at this time is used as a signal current $I_{data}$. Then, when a predetermined charge has been accumulated in a capacitor element 610, selection of the first and second scanning lines 602 and 603 is terminated, and the TFTs 606 and 607 are turned OFF.

Subsequently, the following operation is performed in the sustain period Ts. A scanning line 604 is selected, and a TFT 609 is turned ON. Since the predetermined charge that has been written is stored in the capacitor element 610, the TFT 608 is already turned ON, and a current identical with the signal current $I_{data}$ flows thereto from a current line 605. Thus, a light emitting element 611 emits light.

Figure 14C:
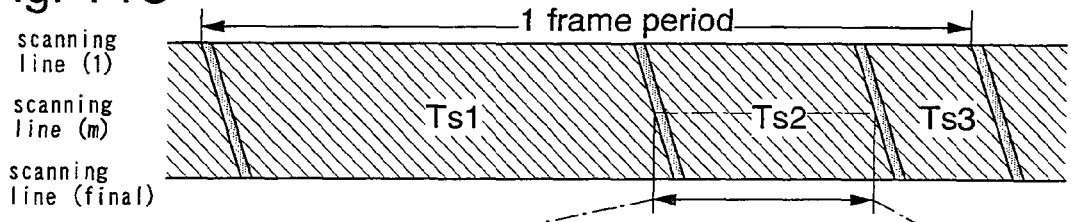

The operations described above are performed in each subframe period, thereby forming one frame period. According to this method, the number of divisions for subframe periods may be increased to increase the number of display gradations. The order of the subframe periods does not necessarily need to be the order from an upper bit to a lower bit as shown in FIGS. 14B and 14C, and the subframe periods may be disposed at random within one frame period. In addition, the order may be variable within each frame period.

Figure 14D:
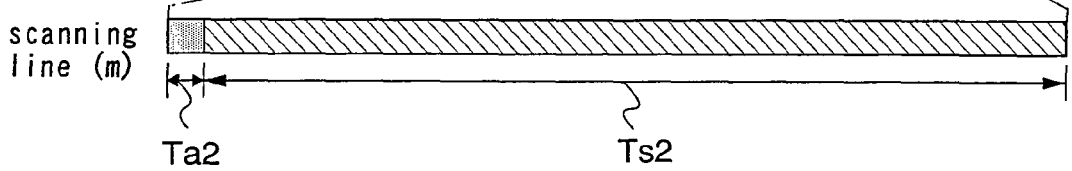

Further, a subframe period SF2 of an m-th scanning line is shown in FIG. 14D. As shown in FIG. 14D, in the pixel, upon termination of an address period Ta2, a sustain period Ts2 is immediately started.

This embodiment may be arbitrarily combined with Embodiment forms 1 to 7.

Embodiment 2

In this embodiment, example structures of pixel circuits provided in the pixel portion will be described with reference to FIG. 13.

Note that a pixel of any structure may be applicable as long as the structure includes a current input portion.

Figure 13A:
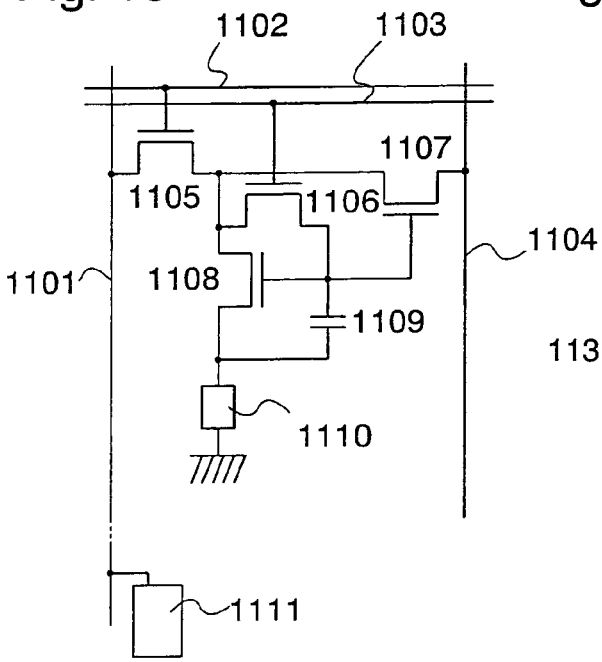
FIGS. 13A-13C are circuit diagrams of pixels of a light emitting device.

A pixel shown in FIG. 13A includes a signal line 1101, first and second scanning lines 1102 and 1103, a current line (power supply line) 1104, a switching TFT 1105, a holding TFT 1106, a driving TFT 1107, a conversion driving TFT 1108, a capacitor element 1109, and a light emitting element 1110. Each signal line is connected to a current source circuit 1111.

Note that the current source circuit 1111 corresponds to the current source circuit 420 disposed in the signal line driving circuit 403.

The gate electrode of the switching TFT 1105 is connected to the first scanning line 1102, a first electrode thereof is connected to the signal line 1101, and a second electrode thereof is connected to a first electrode of the driving TFT 1107 and a first electrode of the conversion driving TFT 1108. The gate electrode of the holding TFT 1106 is connected to the second scanning line 1103, a first electrode thereof is connected to the signal line 1102, and a second electrode thereof is connected to the gate electrode of the driving TFT 1107 and the gate electrode of the conversion driving TFT 1108. A second electrode of the driving TFT 1107 is connected to the current line (power supply line) 1104, and a second electrode of the conversion driving TFT 1108 is connected to one of the electrodes of the light emitting element 1110. The capacitor element 1109 is connected between the gate electrode of the conversion driving TFT 1108 and a second electrode thereof, and retains a gate-source voltage of the conversion driving TFT 1108. The current line (power supply line) 1104 and the other electrode of the light emitting element 1110 are respectively input with predetermined potentials and have mutually different potentials.

The pixel of FIG. 13A corresponds to the case where a circuit of FIG. 30B is applied to a pixel. However, since the current-flow direction is different, the transistor polarity is reverse. The driving TFT 1107 of FIG. 13A corresponds to a TFT 126 of FIG. 30B, the conversion driving TFT 1108 of FIG. 13A corresponds to a TFT 122 of FIG. 30B, and the holding TFT 1106 of FIG. 13A corresponds to the TFT 124 of FIG. 30B.

Figure 13B:
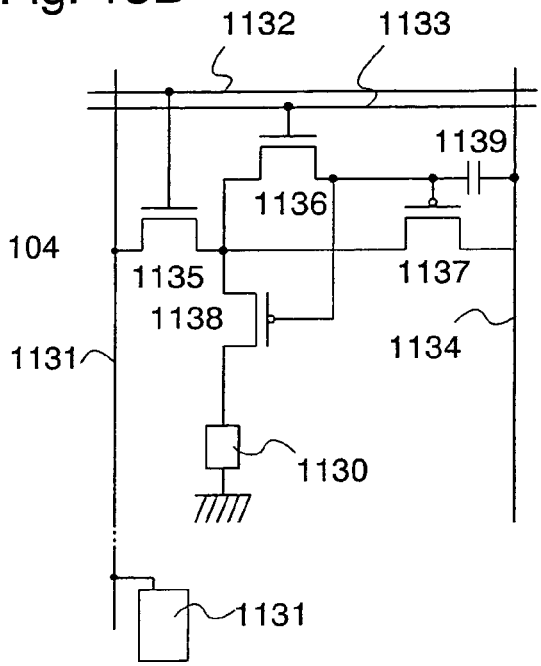

A pixel shown in FIG. 13B includes a signal line 1151, first and second scanning lines 1142 and 1143, a current line (power supply line) 1144, a switching TFT 1145, a holding TFT 1146, a conversion driving TFT 1147, a driving TFT 1148, a capacitor element 1149, and a light emitting element 1140. The signal line 1151 is connected to a current source circuit 1141.

Note that the current source circuit 1141 corresponds to the current source circuit 420 disposed in the signal line driving circuit 403.

The gate electrode of the switching TFT 1145 is connected to the first scanning line 1142, a first electrode thereof is connected to the signal line 1151, and a second electrode thereof is connected to a first electrode of the driving TFT 1148 and a first electrode of the conversion driving TFT 1148. The gate electrode of the holding TFT 1146 is connected to the second scanning line 1143, a first electrode thereof is connected to the first electrode of the driver TFT 1148, and a second electrode thereof is connected to the gate electrode of the driving TFT 1148 and the gate electrode of the conversion driving TFT 1147. A second electrode of the conversion driving TFT 1147 is connected to the current line (power supply line) 1144, and a second electrode of the conversion driving TFT 1147 is connected to one of the electrodes of the light emitting element 1140. The capacitor element 1149 is connected between the gate electrode of the conversion driving TFT 1147 and a second electrode thereof, and retains a gate-source voltage of the conversion driving TFT 1147. The current line (power supply line) 1144 and the other electrode of the light emitting element 1140 are respectively input with predetermined potentials and have mutually different potentials.

Note that the pixel of FIG. 13B corresponds to the case where a circuit of FIG. 6B is applied to a pixel. However, since the current-flow direction is different, the transistor polarity is reverse. The conversion driving TFT 1147 of FIG. 13B corresponds to a TFT 122 of FIG. 6B, the driving TFT 1138 of FIG. 13B corresponds to a TFT 126 of FIG. 6B, and the holding TFT 1136 of FIG. 13B corresponds to the TFT 124 of FIG. 6B.

Figure 13C:
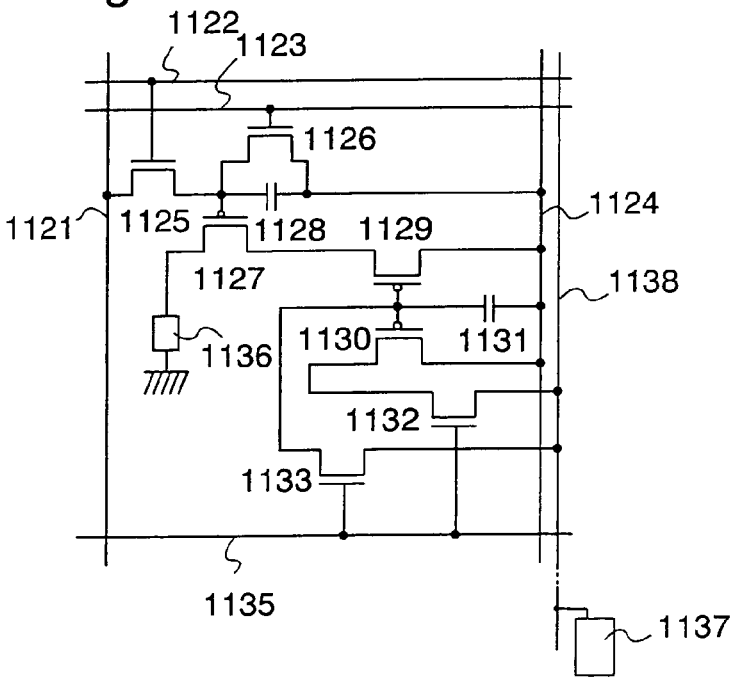

A pixel shown in FIG. 13C includes a signal line 1121, a first scanning line 1122, a second scanning line 1123, a third scanning line 1135, a current line (power supply line) 1124, a current line 1138, a switching TFT 1125, an erasing TFT 1126, a driving TFT 1127, a capacitor element 1128, a current-supply TFT 1129, a mirror TFT 1130, a capacitor element 1131, a current-input TFT 1132, a holding TFT 1133, and a light emitting element 1136. Each signal line is connected to a current source circuit 1137.

The gate electrode of the switching TFT 1125 is connected to the first scanning line 1122, a first electrode of the switching TFT 1125 is connected to the signal line 1121, and a second electrode of the switching TFT 1125 is connected to the gate electrode of the driving TFT 1127 and a first electrode of the erasing TFT 1126. The gate electrode of the erasing TFT 1126 is connected to the second scanning line 1123, and a second electrode of the erasing TFT 1126 is connected to the current line (power supply line) 1124. A first electrode of the driving TFT 1127 is connected to one of the electrodes of the light emitting element 1136, and a second electrode of the driving TFT 1127 is connected to a first electrode of the current-supply TFT 1129. A second electrode of the current-supply TFT 1129 is connected to the current line (power supply line) 1124. One of the electrodes of the capacitor element 1131 is connected to the gate electrode of the current-supply TFT 1129 and the gate electrode of the mirror TFT 1130 and the other electrode thereof is connected to the current line (power supply line) 1124. A first electrode of the mirror TFT 1130 is connected to the current line 1124, and a second electrode of the mirror TFT 1130 is connected to a first electrode of the current-input TFT 1132. A second electrode of the current-input TFT 1132 is connected to the current line (power supply line) 1124, and the gate electrode of the current-input TFT 1132 is connected to the third scanning line 1135. The gate electrode of the current holding TFT 1133 is connected to the third scanning line 1135, a first electrode of the current holding TFT 1133 is connected to the pixel current line 1138, a second electrode of the current holding TFT 1133 is connected to the gate electrode of the current-supply TFT 1129 and the gate electrode of the mirror TFT 1130. The current line (power supply line) 1124 and the other electrode of light emitting element 1136 are input with predetermined potentials and have mutually different potentials.

This embodiment may be arbitrarily combined with Embodiment forms 1 to 7 and Embodiment 1.

Embodiment 3

In this embodiment, technical devices when performing color display will be described.

With a light emitting element comprised of an organic EL element, the luminance can be variable depending on the color even though current having the same magnitude is supplied to the light emitting device. In addition, in the case where the light emitting element has deteriorated because of, for example, a time factor, the deterioration degree is variable depending on the color. Thus, when performing color display with a light emitting device using light emitting elements, various technical devices are required to adjust the white balance.

The simplest technique is to change the magnitude of the current that is input to the pixel. To achieve the technique, the magnitude of the constant current source for video signal should be changed depending on the color.

Another technique is to use circuits as shown in FIGS. 6C to 6E for the pixel, signal line driving circuit, constant current source for video signal, and the like. In the circuits as shown in FIGS. 6C to 6E, the W/L ratio of two transistors forming the current mirror circuit is changed depending on the color. Thus, the magnitude of the current to be input to the pixel can be changed depending on the cooler.

Still another technique is to change the length of a lightening period. The technique can be applied to either of the case where the time gradation method is employed and the case where the time gradation method is not employed. According to the technique, the luminance of each pixel can be adjusted.

The white balance can be easily adjusted by using any one of the techniques or a combination thereof.

This embodiment may be arbitrarily combined with Embodiment forms 1 to 7 and Embodiments 1 and 2.

Embodiment 4

Figure 12A:
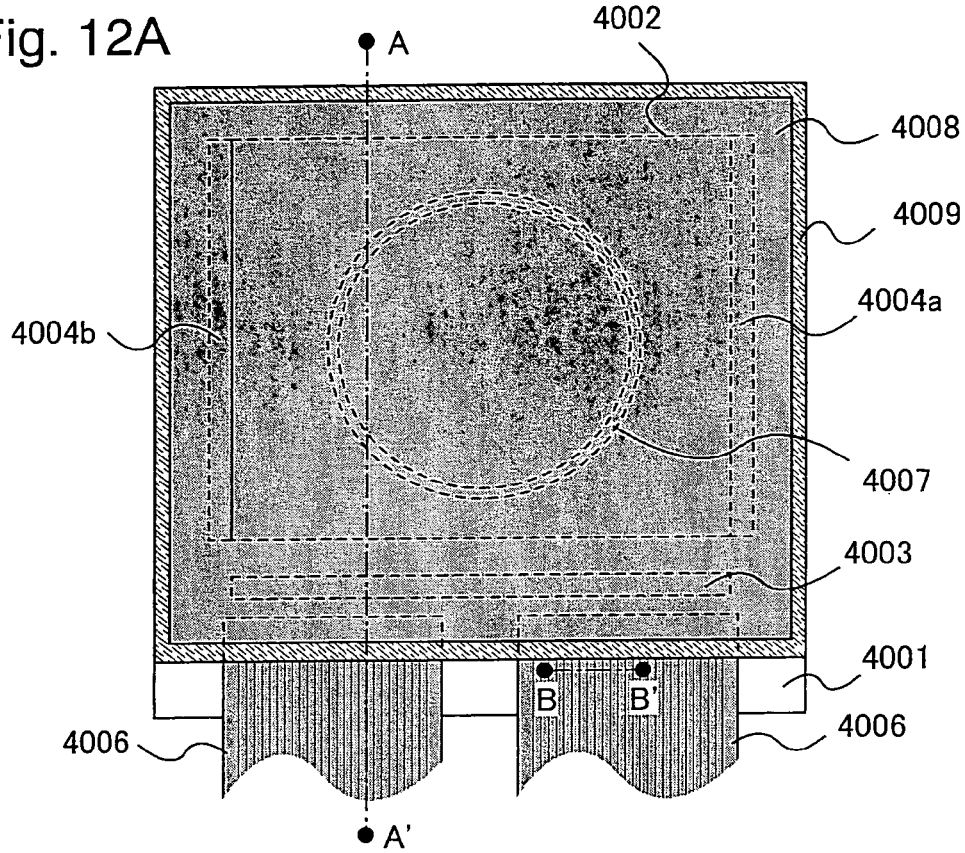
FIGS. 12A-12C are views of the appearance of a light emitting device.
Figure 12B:
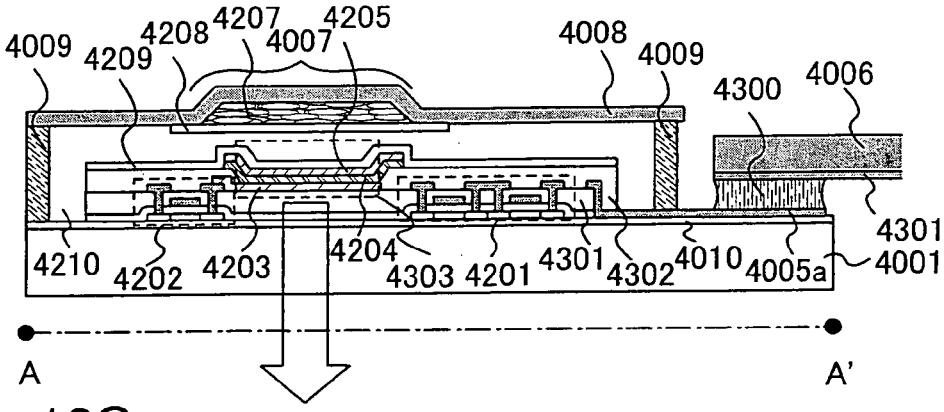
Figure 12C:
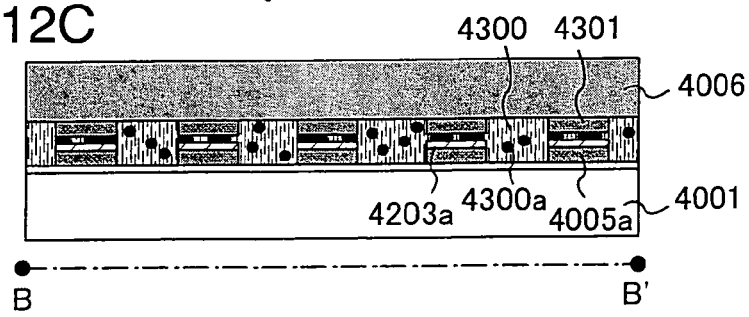

In this embodiment, the appearances of the light emitting devices (semiconductor devices) of the present invention will be described using FIG. 12. FIG. 12 is a top view of a light emitting device formed such that an element substrate on which transistors are formed is sealed with a sealing material; FIG. 12B is a cross-sectional view taken along the line A-A' of FIG. 12A; and FIG. 12C is a cross-sectional view taken along the line B-B' of FIG. 12A.

A sealing material 4009 is provided so as to enclose a pixel portion 4002, a source signal line driving circuit 4003, and gate signal line driving circuits 4004*a* and 4004*b* that are provided on a substrate 4001. In addition, a sealing material 4008 is provided over the pixel portion 4002, the source signal line driving circuit 4003, and the gate signal line driving circuits 4004*a* and 4004*b*. Thus, the pixel portion 4002, the source signal line driving circuit 4003, and the gate signal line driving circuits 4004*a* and 4004*b* are sealed by the substrate 4001, the sealing material 4009, and the sealing material 4008 with a filler material 4210.

The pixel portion 4002, the source signal line driving circuit 4003, and the gate signal line driving circuits 4004*a* and 4004*b*, which are provided over the substrate 4001, include a plurality of TFTs. FIG. 12B representatively shows a driving TFT (incidentally, an n-channel TFT and a p-channel TFT are shown in this example) 4201 included in the source signal line driving circuit 4003, and an erasing TFT 4202 included in the pixel portion 4002, which are formed on a base film 4010.

In this embodiment, a p-channel TFT or an n-channel TFT that is manufactured according to a known method is used for the driving TFT 4201, and an n-channel TFT manufactured according to a known method is used for the erasing TFT 4202.

An interlayer insulating film (leveling film) 4301 is formed on the driving TFT 4201 and the erasing TFT 4202, and a pixel electrode (anode) 4203 for being electrically connected to a drain of the erasing TFT 4202 is formed thereon. A transparent conductive film having a large work function is used for the pixel electrode 4203. For the transparent conductive film, a compound of indium oxide and tin oxide, a compound of indium oxide and zinc oxide, zinc oxide, tin oxide, or indium oxide can be used. Alternatively, the transparent conductive film added with gallium may be used.

An insulating film 4302 is formed on the pixel electrode 4203, and the insulating film 4302 is formed with an opening portion formed on the pixel electrode 4203. In the opening portion, a light emitting layer 4204 is formed on the pixel electrode 4203. The light emitting layer 4204 may be formed using a known light emitting material or inorganic light emitting material. As the light emitting material, either of a low molecular weight (monomer) material and a high molecular weight (polymer) material may be used.

As a forming method of the light emitting layer 4204, a known vapor deposition technique or coating technique may be used. The structure of the light emitting layer 4204 may be either a laminate structure, which is formed by arbitrarily combining a hole injection layer, a hole transportation layer, a light-emitting layer, an electron transportation layer, and an electron injection layer, or a single-layer structure.

Formed on the light emitting layer 4204 is a cathode 4205 formed of a conductive film (representatively, a conductive film containing aluminum, copper, or silver as its main constituent, or a laminate film of the conductive film and another conductive film) having a light shielding property. Moisture and oxygen existing on an interface of the cathode 4205 and the light emitting layer 4204 are desirably eliminated as much as possible. For this reason, a technical device is necessary in that the light emitting layer 4204 is formed in an nitrogen or noble gas atmosphere, and the cathode 4205 is formed without being exposed to oxygen, moisture, and the like. In this embodiment, the above-described film deposition is enabled using a multi-chamber method (cluster-tool method) film deposition apparatus. In addition, the cathode 4205 is applied with a predetermined voltage.

In the above-described manner, a light emitting element 4303 constituted by the pixel electrode (anode) 4203, the light emitting layer 4204, and the cathode 4205 is formed. A protective film is formed on the insulating film so as to cover the light emitting element 4303. The protective film is effective for preventing, for example, oxygen and moisture, from entering the light emitting element 4303.

Reference numeral 4005*a* denotes a drawing line that is connected to a power supply line and that is electrically connected to a source region of the erasing TFT 4202. The drawing line 4005*a* is passed between the sealing material 4009 and the substrate 4001 and is then electrically connected to an FPC line 4301 of an FPC 4006 via an anisotropic conductive film 4300.

As the sealing material 4008, a glass material, a metal material (representatively, a stainless steel material), ceramics material, or a plastic material (including a plastic film) may be used. As the plastic material, an FRP (fiberglass reinforced plastics) plate, a PVF (polyvinyl fluoride) film, a Mylar film, a polyester film, or an acrylic resin film may be used. Alternatively, a sheet having a structure in which an aluminum foil is sandwiched by the PVF film or the Mylar film may be used.

However, a cover material needs to be transparent when light emission is directed from the light emitting layer to the cover material. In this case, a transparent substance such as a glass plate, a plastic plate, a polyester film, or an acrylic film, is used.

Further, for the filler material 4210, ultraviolet curing resin or a thermosetting resin may be used in addition to an inactive gas, such as nitrogen or argon; and PVC (polyvinyl chloride), acrylic, polyimide, epoxy resin, silicon resin, PVBu (polyvinyl butyral), or EVA (ethylene vinyl acetate) may be used. In this embodiment, nitrogen was used for the filler material.

To keep the filler material 4210 to be exposed to a hygroscopic substance (preferably, barium oxide) or an oxygen-absorbable substance, a concave portion 4007 is provided on the surface of the sealing material 4008 on the side of the substrate 4001, and a hygroscopic substance or oxygen-absorbable substance 4207 is disposed. The hygroscopic substance or oxygen-absorbable substance 4207 is held in the concave portion 4007 via a concave-portion cover material 4208 such that the hygroscopic substance or oxygen-absorbable substance 4207 does not diffuse. The concave-portion cover material 4208 is in a fine mesh state and is formed to allow air and moisture to pass through and not to allow the hygroscopic substance or oxygen-absorbable substance 4207 to pass through. The provision of the hygroscopic substance or oxygen-absorbable substance 4207 enables the suppression of deterioration of the light emitting element 4303.

As shown in FIG. 12C, simultaneously with the formation of the pixel electrode 4203, a conductive film 4203*a* is formed so as to be contact with an upper portion of the drawing line 4005*a*.

In addition, the anisotropic conductive film 4300 includes a conductive filler 4300*a*. The substrate 4001 and the FPC 4006 are thermally press-bonded, whereby the conductive film 4203*a* on the substrate 4001 and the FPC line 4301 on the FPC 4006 are electrically connected via the conductive filler 4300*a*.

This embodiment may be arbitrarily combined with Embodiment forms 1 to 7 and Embodiments 1 to 3.

Embodiment 5

A light emitting device is of self-light emitting type, so that in comparison to a liquid crystal display, the light emitting device offers a better visibility in bright portions and a wider view angle. Hence, the light emitting device can be used in display portions of various electronic devices.

Electronic devices using the light emitting device of the present invention include, there are given, for example, video cameras, digital cameras, goggle type displays (head mount displays), navigation systems, audio reproducing devices (such as car audio and audio components), notebook personal computers, game machines, mobile information terminals (such as mobile computers, mobile telephones, portable game machines, and electronic books), and image reproducing devices provided with a recording medium (specifically, devices for reproducing a recording medium such as a digital versatile disc (DVD), which includes a display capable of displaying images). In particular, in the case of mobile information terminals, since the degree of the view angle is appreciated important, the terminals preferably use the light emitting device. Practical examples are shown in FIG. 22.

Figure 22A:
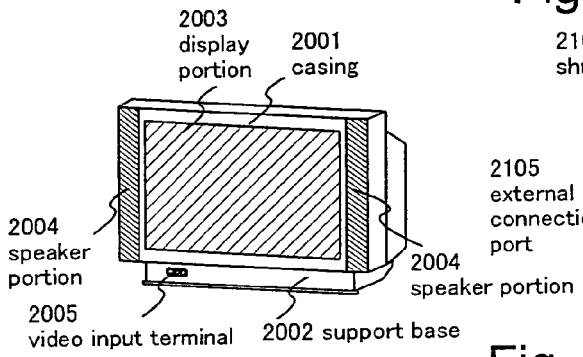
FIGS. 22A-22H are views of electronic devices to which the present invention is applied.

FIG. 22A shows a light emitting element, which contains a casing 2001, a support base 2002, a display portion 2003, a speaker portion 2004, a video input terminal 2005, and the like. The present invention can be applied to the display portion 2003. Further, the light emitting element shown in FIG. 22A is completed with the present invention. Since the light emitting element is of self-light emitting type, it does not need a back light, and therefore a display portion that is thinner than a liquid crystal display can be obtained. Note that light emitting elements include all information display devices, for example, personal computers, television broadcast transmitter-receivers, and advertisement displays.

Figure 22B:
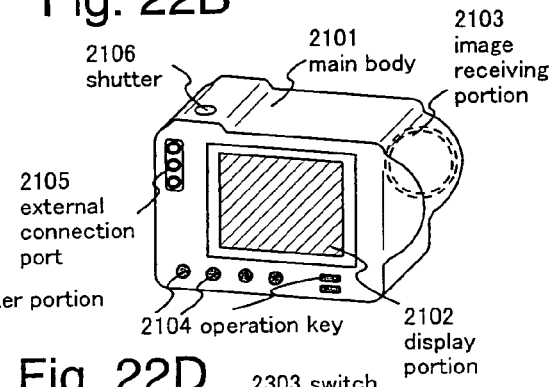

FIG. 22B shows a digital still camera, which contains a main body 2101, a display portion 2102, an image receiving portion 2103, operation keys 2104, an external connection port 2105, a shutter 2106, and the like. The present invention can be applied to the display portion 2102. Further, the digital still camera shown in FIG. 22B is completed with the present invention.

Figure 22C:
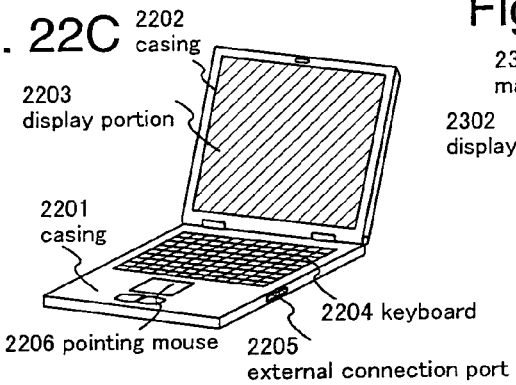

FIG. 22C shows a notebook personal computer, which contains a main body 2201, a casing 2202, a display portion 2203, a keyboard 2204, external connection ports 2205, a pointing mouse 2206, and the like. The present invention can be applied to the display portion 2203. Further, the light emitting element shown in FIG. 22C is completed with the present invention.

Figure 22D:
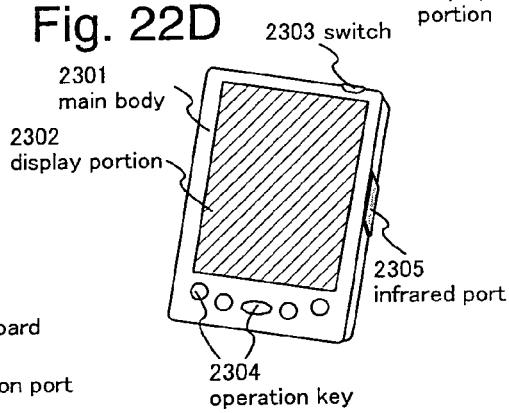

FIG. 22D shows a mobile computer, which contains a main body 2301, a display portion 2302, a switch 2303, operation keys 2304, an infrared port 2305, and the like. The present invention can be applied to the display portion 2303. Further, the mobile computer shown in FIG. 22D is completed with the present invention.

Figure 22E:
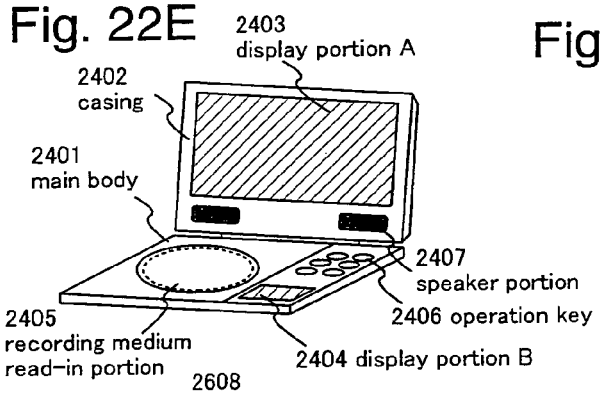

FIG. 22E shows a portable image reproducing device provided with a recording medium (specifically, a DVD reproducing device), which contains a main body 2401, a casing 2402, a display portion A 2403, a display portion B 2404, a recording medium (such as a DVD) read-in portion 2405, operation keys 2406, a speaker portion 2407, and the like. The display portion A 2403 mainly displays image information, and the display portion B 2404 mainly displays character information. The present invention can be used in the display portion A 2403 and in the display portion B 2404. Note that family game machines and the like are included in the image reproducing devices provided with a recording medium. Further, the DVD reproducing device shown in FIG. 22E is completed with the present invention.

Figure 22F:
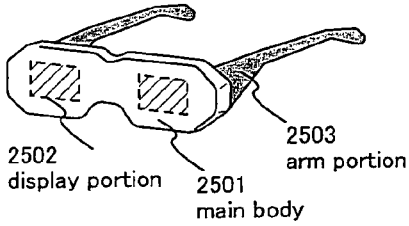

FIG. 22F shows a goggle type display (head mounted display), which contains a main body 2501, a display portion 2502, an arm portion 2503, and the like. The present invention can be used in the display portion 2502. The goggle type display shown in FIG. 22F is completed with the present invention.

Figure 22G:
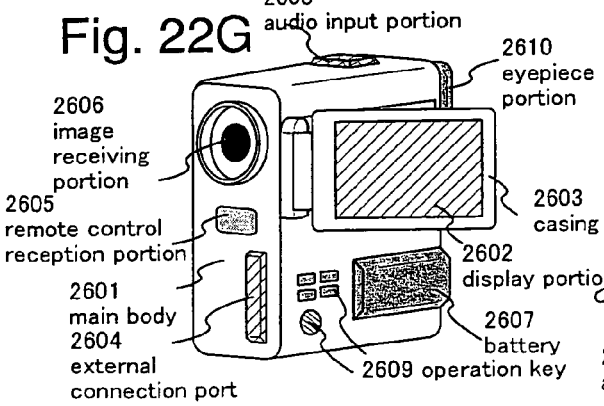

FIG. 22G shows a video camera, which contains a main body 2601, a display portion 2602, a casing 2603, external connection ports 2604, a remote control reception portion 2605, an image receiving portion 2606, a battery 2607, an audio input portion 2608, operation keys 2609, an eyepiece portion 2610, and the like. The present invention can be used in the display portion 2602. The video camera shown in FIG. 22G is completed with the present invention.

Figure 22H:
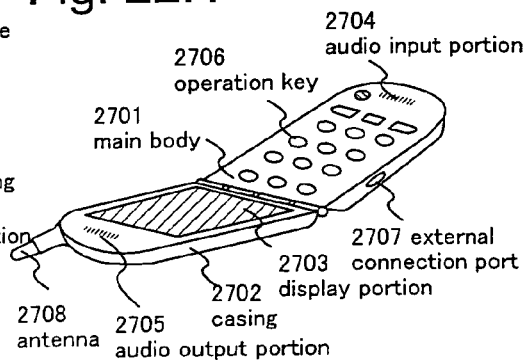

Here, FIG. 22H shows a mobile telephone, which contains a main body 2701, a casing 2702, a display portion 2703, an audio input portion 2704, an audio output portion 2705, operation keys 2706, external connection ports 2707, an antenna 2708, and the like. The present invention can be used in the display portion 2703. Note that, by displaying white characters on a black background, the display portion 2703 can suppress the consumption current of the mobile telephone. Further, the mobile telephone shown in FIG. 22H is completed with the present invention.

When the emission luminance of light emitting materials are increased in the future, the light emitting element will be able to be applied to a front or rear type projector by expanding and projecting light containing image information having been output lenses or the like.

Cases are increasing in which the above-described electronic devices display information distributed via electronic communication lines such as the Internet and CATVs (cable TVs). Particularly increased are cases where moving picture information is displayed. Since the response speed of the light emitting material is very high, the light emitting device is preferably used for moving picture display.

Since the light emitting device consumes the power in light emitting portions, information is desirably displayed so that the light emitting portions are reduced as much as possible. Thus, in the case where the light emitting device is used for a display portion of a mobile information terminal, particularly, a mobile telephone, an audio playback device, or the like, which primarily displays character information, it is preferable that the character information be formed in the light emitting portions with the non-light emitting portions being used as the background.

As described above, the application range of the present invention is very wide, so that the invention can be used for electronic devices in all of fields. The electronic devices according to this embodiment may use the light emitting device with the structure according to any one of Embodiment forms 1 to 7 and Embodiments 1 to 4.

The present invention can suppress influence of variation in characteristics of the TFTs, and offer a signal line driving circuit which can supply a desired signal current to the outside.

Further, in the signal line driving circuit of the invention, a first and a second latches having respective current source circuits are disposed. In a case where a structure having a current mirror circuit is adopted as the current source circuit, a large current can be supplied from a constant current source for video signal by changing W/L thereof appropriately. As a result, setting operation can be done quickly and accurately. Further more, in the first current source circuit of the first latch and the second current source circuit of the second latch, since it becomes possible that one does the setting operation while the other does the input operation, the two operations can de done at the same time.

What is claimed is:

1. A semiconductor device comprising:

a first current source circuit comprising a first transistor, a second transistor and a capacitor;

a second current source circuit comprising a first transistor, a second transistor and a capacitor; and a third current source circuit comprising a first transistor, a second transistor and a capacitor, wherein a first current is inputted to the first current source circuit, wherein a second current is inputted from the first current source circuit to the second current source circuit, and wherein a third current is inputted from the second current source circuit to the third current source circuit.

2. A semiconductor device according to claim 1, wherein the semiconductor device is a display device.

3. A semiconductor device according to claim 2, wherein the display device is an EL display device.

4. A semiconductor device according to claim 1, wherein the semiconductor device is a signal line driving circuit.

5. A semiconductor device according to claim 1, wherein a fourth current is inputted from the third current source circuit to an EL element.

6. The semiconductor device according to claim 1, wherein either or both the first current source circuit and the second current source circuit comprise a current mirror circuit.

7. The semiconductor device according to claim 1, wherein a value of the second current is approximately same as that of the third current.

8. The semiconductor device according to claim 1, wherein a value of the third current is in proportion to that of the second current.

9. The semiconductor device according to claim 1 further comprising a switch, wherein the switch is provided between the first current source circuit and the second current source circuit.

10. The semiconductor device according to claim 1, wherein the capacitor of the first current source circuit is configured to preserve a potential of a gate of the first transistor.

11. A semiconductor device comprising:

a first current source circuit comprising a first transistor, a second transistor and a capacitor;

a second current source circuit comprising a first transistor, a second transistor and a capacitor; and a pixel circuit comprising a first transistor, a second transistor and a capacitor, wherein a first current is inputted to the first current source circuit, wherein a second current is inputted from the first current source circuit to the second current source circuit, and wherein a third current is inputted from the second current source circuit to the pixel circuit.

12. A semiconductor device according to claim 11, wherein the semiconductor device is a display device.

13. A semiconductor device according to claim 12, wherein the semiconductor device is an EL display device.

14. A semiconductor device according to claim 11, wherein the semiconductor device is a signal line driving circuit.

15. A semiconductor device according to claim 11, wherein the pixel circuit comprises an EL element.

16. A semiconductor device according to claim 11, wherein a value of the second current is in proportion to that of the first current.

17. A semiconductor device according to claim 11, wherein a value of the third current is in proportion to that of the second current.

18. The semiconductor device according to claim 11, wherein either or both of the first current source circuit and the second current source circuit comprise a current mirror circuit.

19. The semiconductor device according to claim 11 further comprising a switch, wherein the switch is provided between the first current source circuit and the second current source circuit.

20. The semiconductor device according to claim 11, wherein the capacitor of the first current source circuit is configured to preserve a potential of a gate of the first transistor.

* * * * *